US011267159B2

(12) United States Patent
Johnson

(10) Patent No.: US 11,267,159 B2
(45) Date of Patent: Mar. 8, 2022

(54) MOBILE ASSEMBLY FOR CUTTING WOOD

(71) Applicant: Justin William Johnson, Raleigh, NC (US)

(72) Inventor: Justin William Johnson, Raleigh, NC (US)

( * ) Notice: Subject to any disclaimer, the term of this patent is extended or adjusted under 35 U.S.C. 154(b) by 65 days.

(21) Appl. No.: 16/573,127

(22) Filed: Sep. 17, 2019

(65) Prior Publication Data

US 2020/0114538 A1 Apr. 16, 2020

Related U.S. Application Data

(60) Provisional application No. 62/746,272, filed on Oct. 16, 2018.

(51) Int. Cl.
*B27B 17/00* (2006.01)
*B27B 17/08* (2006.01)
*B27B 17/12* (2006.01)

(52) U.S. Cl.
CPC ..... *B27B 17/0091* (2013.01); *B27B 17/083* (2013.01); *B27B 17/12* (2013.01)

(58) Field of Classification Search
CPC ... B27B 17/0091; B27B 17/083; B27B 17/12; B27B 17/005; B27B 17/0058; B27B 1/00
USPC ..... 144/73, 72, 363; 83/928, 574
See application file for complete search history.

(56) References Cited

U.S. PATENT DOCUMENTS 2,746,492 A 5/1956 De Hardit
3,366,801 A * 1/1968 Rulseh ..... G04C 23/36 307/117
3,865,213 A * 2/1975 McDermott ..... F02B 63/02 123/196 CP
4,350,067 A * 9/1982 Picard ..... B27B 17/0058 269/296
4,606,252 A 8/1986 Lahti
4,722,258 A 2/1988 Johnson
5,784,941 A 7/1998 Sanborn
7,237,585 B2 7/2007 McKnight
8,479,628 B2 7/2013 Dale et al.
9,648,565 B1 * 5/2017 Mawson ..... H04W 52/0241
2009/0205750 A1 8/2009 Wright
2012/0037276 A1 * 2/2012 Granberg ..... B27B 17/005 144/378
2014/0047723 A1 2/2014 Vidale Wade
2016/0353669 A1 12/2016 Xavier et al.
2017/0165827 A1 6/2017 Smollar

FOREIGN PATENT DOCUMENTS

EP 2106692 A1 10/2009

* cited by examiner

*Primary Examiner* — Evan H Macfarlane
*Assistant Examiner* — Liang Dong
(74) *Attorney, Agent, or Firm* — NK Patent Law

(57) ABSTRACT

Mobile assembly for cutting wood includes a base supported by wheels, and a plurality of posts extending upwards from the base. A frame is removably coupled to a distal post and a proximal post. The frame configured to pivot relative to at least one of the distal and proximal posts when coupled thereto, the frame configured for positioning at different heights along the at least one of the distal and proximal posts. An arm is supported by the frame, the arm configured for sliding about, and parallel to, the frame. The arm includes a chainsaw attached to a distal region of the arm.

14 Claims, 76 Drawing Sheets

202
201
210
208
211
211
202
208
201
210

210
201
209
202
208
211
211
211
211

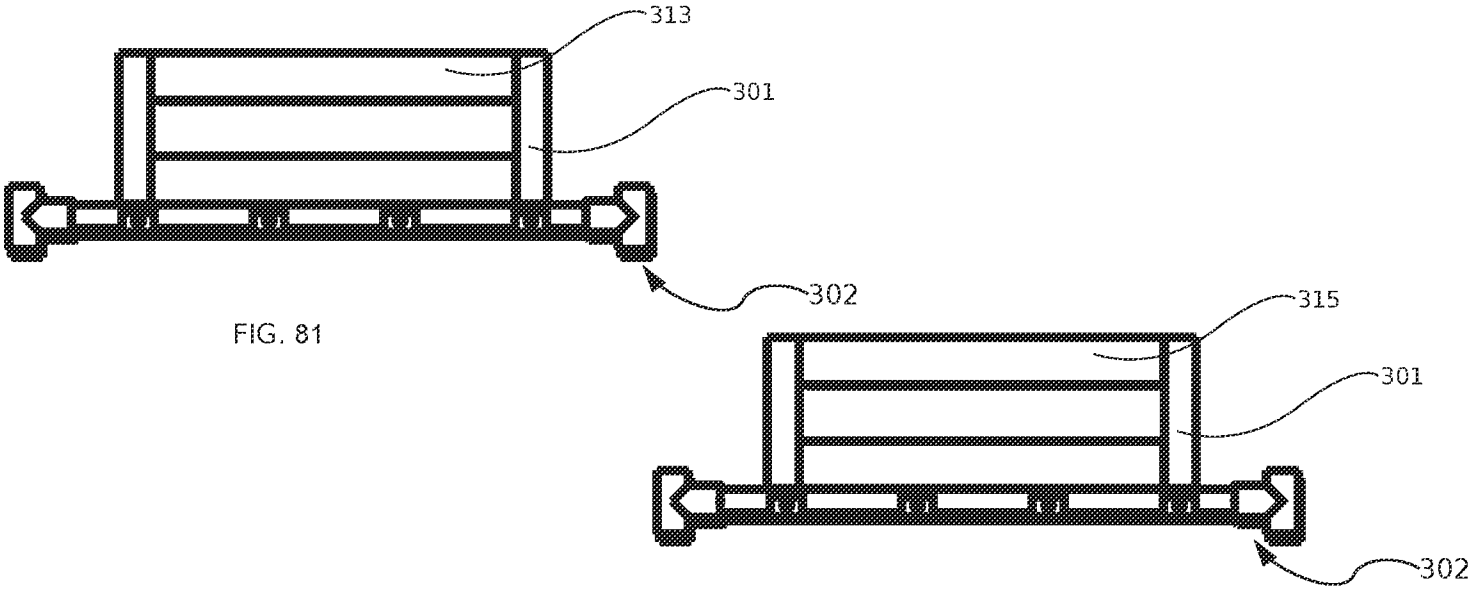
FIG. 81
FIG. 82a
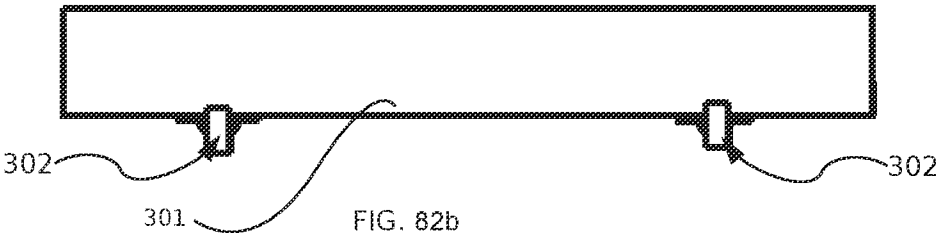
FIG. 82b

MOBILE ASSEMBLY FOR CUTTING WOOD

CROSS-REFERENCE TO RELATED APPLICATIONS

This application claims priority to U.S. Provisional Patent Application No. 62/746,272 filed on Oct. 16, 2018, the entire contents of which is incorporated by reference herein.

TECHNICAL FIELD

This disclosure relates to a cutting device assembly and, particularly to a mobile assembly including a chainsaw for cutting timber and other materials soft enough for a chainsaw to cut through.

BACKGROUND

A typically followed method for cutting up a fallen tree is for a chainsaw operator to hold a chainsaw and cut the tree trunk or limb with the chainsaw while continuing to hold the chainsaw all the way through the cut. This requires the operator to continue to exert physical force while holding the turned-on chainsaw with both hands. Cutting with a chainsaw involves the risk of the chainsaw kicking back and injuring the chainsaw operator; similarly, when a fallen tree is being cut with a chainsaw if a portion of the fallen tree is on a slope or is raised off the ground, for example, there is the further risk of the tree rolling onto the foot of the chainsaw operator when the cut is completed.

Therefore, a need exists for an improved cutting technic that overcomes the above-noted limitations.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

Disclosed herein is a mobile assembly for cutting wood. In various embodiments, the mobile assembly includes a base supported by wheels, the wheels configured for moving the assembly during cutting operations and during transporting of the assembly. The mobile assembly further includes a plurality of posts extending upwards from the base, and, a frame removably coupled to a distal post and a proximal post. The frame is configured to pivot relative to at least one of the distal and proximal posts when coupled thereto. The frame is also configured for positioning at different heights along the at least one of the distal and proximal posts. The assembly further includes an arm supported by the frame. The arm configured for sliding about, and parallel to, the frame. The arm also includes a chainsaw attached to a distal region of the arm.

According to one or more embodiments, the assembly further comprises two lateral bars, each lateral bar extending between two posts, each lateral bar supporting an underside of the frame, each end of the lateral bar removably secured to a post, wherein the frame is pivotally attached to the lateral bar.

According to one or more embodiments, the frame is attached to the lateral bar by one or more braces.

According to one or more embodiments, the assembly further comprises a lubricant reservoir attachable to a lubricant receiving opening of the chainsaw.

According to one or more embodiments, the assembly further comprises a stopping leg extending downwardly from the arm, the stopping leg configured to prevent a chainsaw blade from descending below a predetermined height from a ground surface.

According to one or more embodiments, the stopping leg includes an opening therethrough for receiving a sliding weight therein, wherein one end of a cable is removably attached to a chainsaw trigger and another end of the cable is coupled to the sliding weight, wherein the chainsaw is stopped when a bottom end of the sliding weight contacts a ground or other solid surface.

According to one or more embodiments, the chainsaw is electrically operated, wherein the stopping leg includes a chainsaw turn-off switch at a bottom end of the stopping leg, wherein the chainsaw is stopped when a bottom end of the turn-off switch contacts a ground or other solid surface.

According to one or more embodiments, a bottom end of the stopping leg includes a power cut-off switch, wherein the chainsaw is stopped when a bottom end of the power cut-off switch contacts a ground or other solid surface.

According to one or more embodiments, the chainsaw is electrically operated, wherein the chainsaw includes a surge protector configured to stop the chainsaw when a power draw at the chainsaw is greater than a predetermined value.

According to one or more embodiments, the chainsaw is electrically operated, wherein the chainsaw includes a recycle timer configured to cycle the chainsaw between predetermined turn-on and turn-off periods.

According to one or more embodiments, the assembly further comprises at least one camera configured to capture progress of a wood-cutting operation.

According to one or more embodiments, the assembly further comprises a reservoir configured to hold a lubricant for lubricating the chainsaw, wherein the reservoir is in fluid communication with a lubricant receiving opening of the chainsaw.

According to one or more embodiments, the assembly further comprises a counterweight positioned near a distal end of the arm for increasing a force applied by a chainsaw blade against an article being cut.

According to one or more embodiments, the assembly further comprises a counterweight positioned near a proximal end of the arm for reducing a force applied by a chainsaw blade against an article being cut.

According to one or more embodiments, the assembly is self-powered, wherein the assembly includes a wireless transceiver, wherein the assembly is configured to be moved from a first location to a second location via a remote control mechanism.

According to one or more embodiments, the arm further comprises a caster at a distal end, the caster positioned below the chainsaw, the caster configured to roll on a surface that it comes in contact with.

According to one or more embodiments, the chainsaw is removably attached to the arm by one or more of a ratchet strap, and a latching mechanism.

According to one or more embodiments, the frame is configured to slide up and down about the posts, and wherein the frame is configured to pivotally couple to a post via one or more hitch pins.

According to one or more embodiments, each post includes a plurality of openings, each opening configured to receive a hitch pin.

According to one or more embodiments, a sliding arm is positioned between two posts for supporting the frame thereon, wherein a hitch pin is inserted into an opening of a post for securing the sliding arm to the post.

Disclosed herein is an assembly for cutting wood. In various embodiments, the assembly includes: a base; at least one post extending upwards from the base; a frame removably coupled to the post, the frame configured to pivot relative to the post when coupled thereto, the frame configured for positioning at different heights along the post; and, an arm supported by the frame, the arm configured for sliding about, and parallel to, the frame, the arm including a chainsaw attached to a distal region of the arm.

BRIEF DESCRIPTION OF THE DRAWINGS

The foregoing, as well as the following Detailed Description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed.

The embodiments illustrated, described, and discussed herein are illustrative of the present invention. As these embodiments of the present invention are described with reference to illustrations, various modifications or adaptations of the methods and or specific structures described may become apparent to those skilled in the art. It will be appreciated that modifications and variations are covered by the above teachings and within the scope of the appended claims without departing from the spirit and intended scope thereof. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

FIG. 56 is a bottom perspective view of the arm 200;

FIG. 81 is a front view of the frame 300;

FIG. 82*a* is a rear view of the frame 300; and, FIG. 82*b* is a side view of the frame 300, according to one or more embodiments of the disclosed subject matter.

FIG. 151 is a perspective view of FIG. 150;

Figure 153:
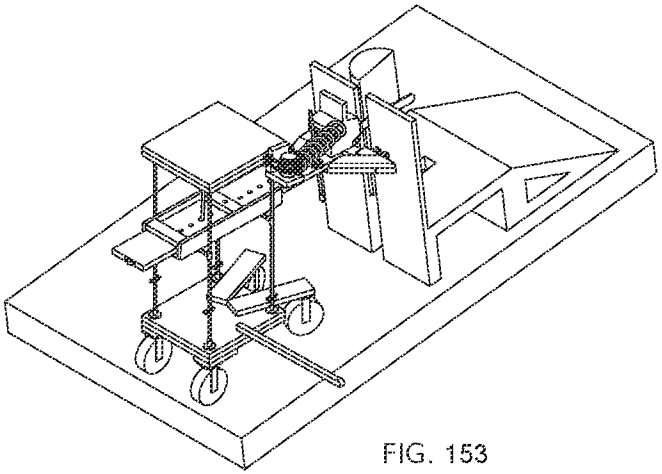
Figure 152:
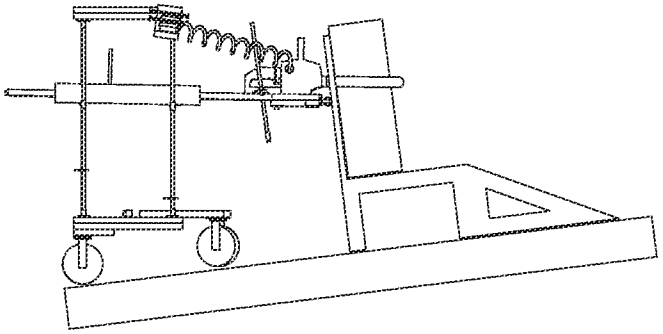

FIG. 152 is a side view of a material 503 being cut on the log stand 506 as seen by the blade position of chainsaw 208; and, FIG. 153 is a perspective view of FIG. 152, according to one or more embodiments of the disclosed subject matter.

Figure 155:
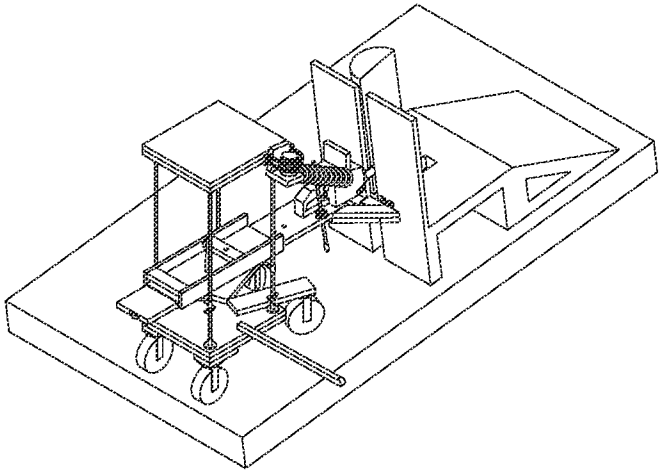
Figure 154:
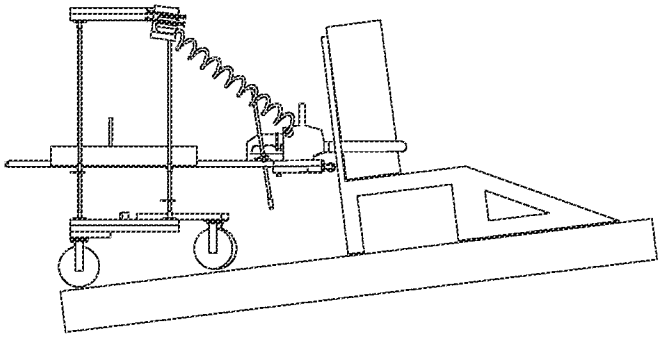
Figure 157:
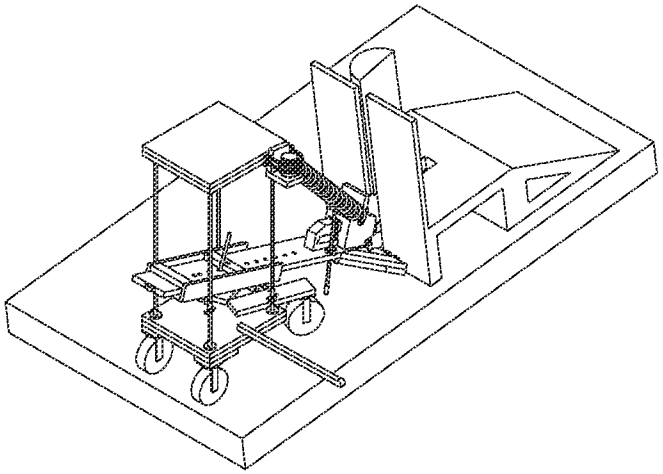
Figure 156:
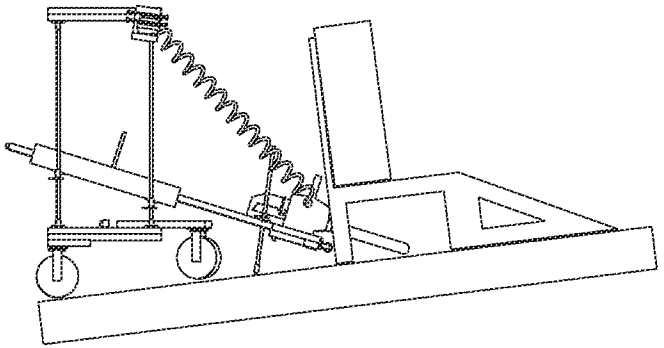

FIG. 154 is a side view of a material 503 being split using the log stand 506; and, FIG. 155 is a perspective view of FIG. 154;

FIG. 156 is a side view of a material 503 being split using the log stand 506; and, FIG. 157 is a perspective view of FIG. 156, according to one or more embodiments of the disclosed subject matter.

Figure 159:
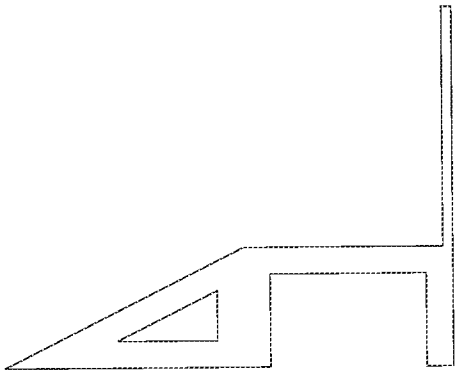
Figure 161:
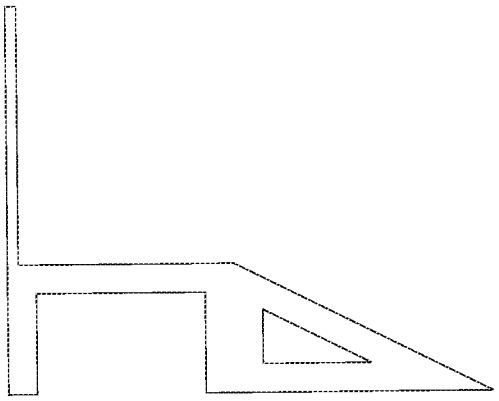
Figure 158:
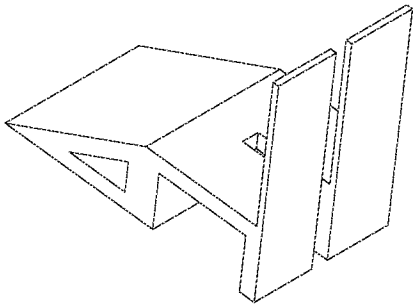
Figure 160:
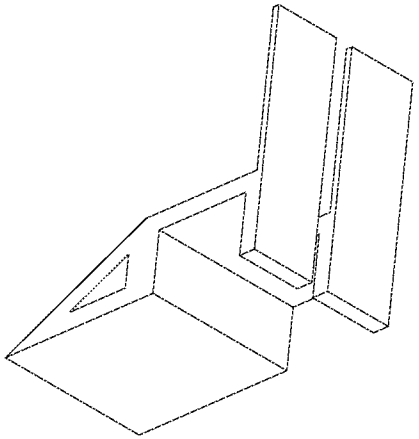

FIG. 158 is a top left angle view of the log stand 506;

FIG. 159 is a left side view of the log stand 506;

FIG. 160 is a bottom left angle view of the log stand 506; and,

FIG. 161 is a right-side view of the log stand 506 (i.e., when the log stand viewed from the right side), according to one or more embodiments of the disclosed subject matter.

Figure 165:
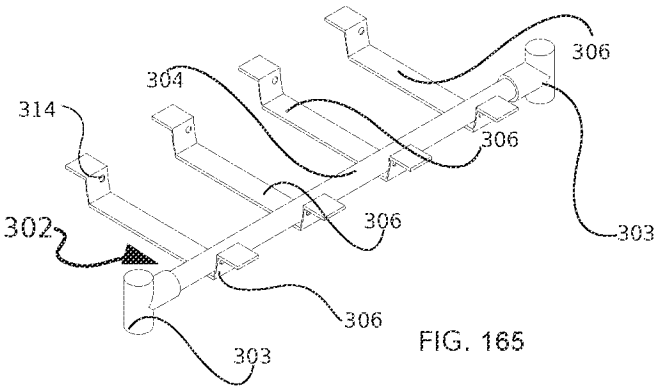
Figure 162:
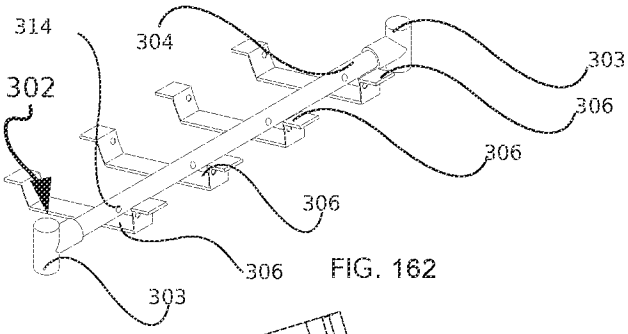
Figure 163:
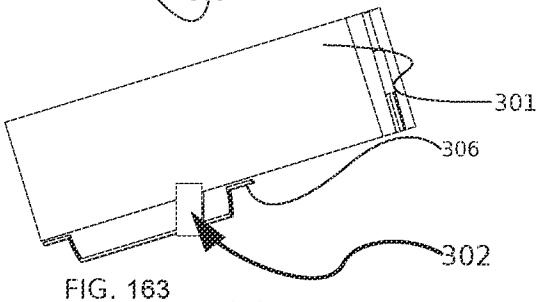
Figure 164:
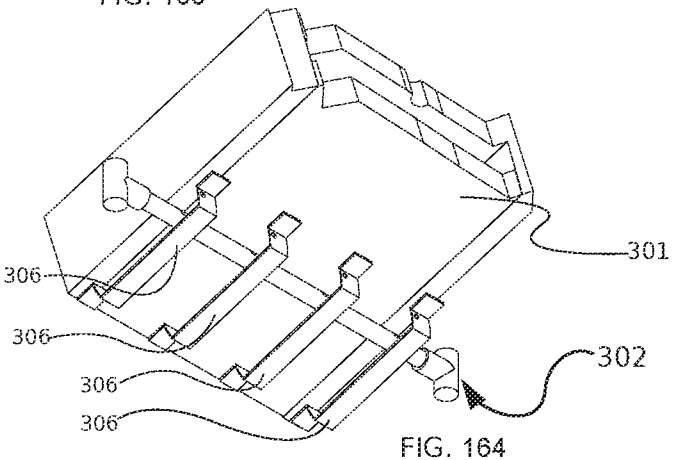

FIG. 162 is a perspective view of the longer braces 306 with the front sliding lateral bar 302 in the middle;

FIG. 163 is a side view of FIG. 162 with the longer braces 306 mounted to the bottom of a cross cut of the frame structure 301;

FIG. 164 is a perspective view of FIG. 163; and,

FIG. 165 is a perspective view of the longer braces 306 with the front sliding lateral bar 302 back as far as possible in rear of the longer braces 306, according to one or more embodiments of the disclosed subject matter.

Figure 166:
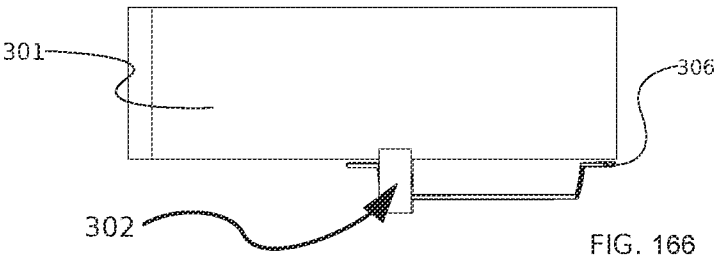
Figure 167:
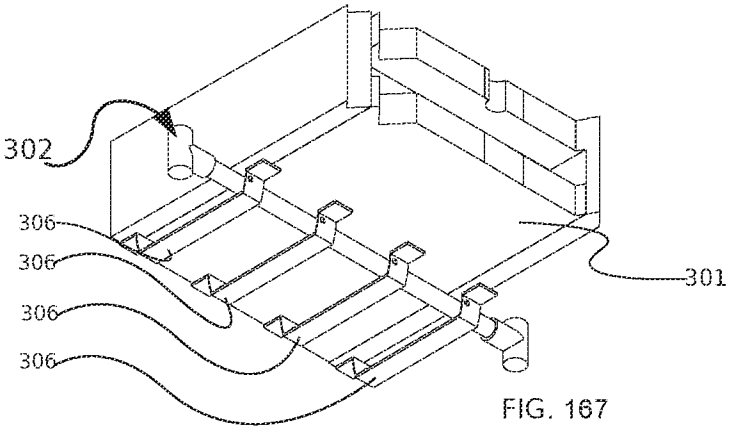

FIG. 166 is a side view of FIG. 165 with the longer braces 306 mounted to the bottom of a crosscut of the frame structure 301; and, FIG. 167 is a perspective view of 584, according to one or more embodiments of the disclosed subject matter.

Figure 169:
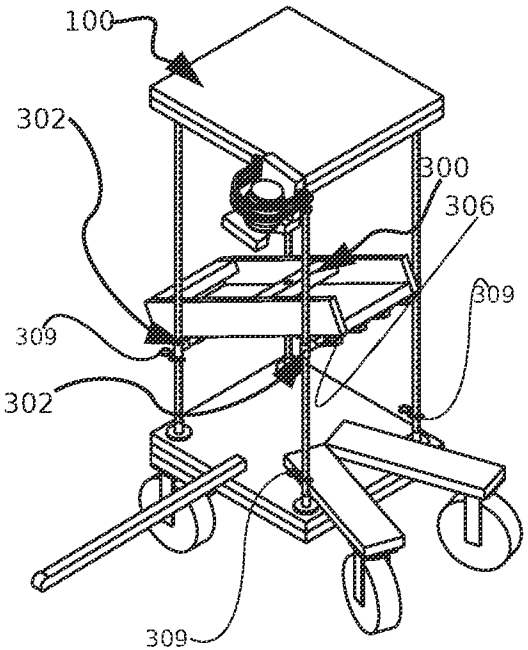
Figure 168:
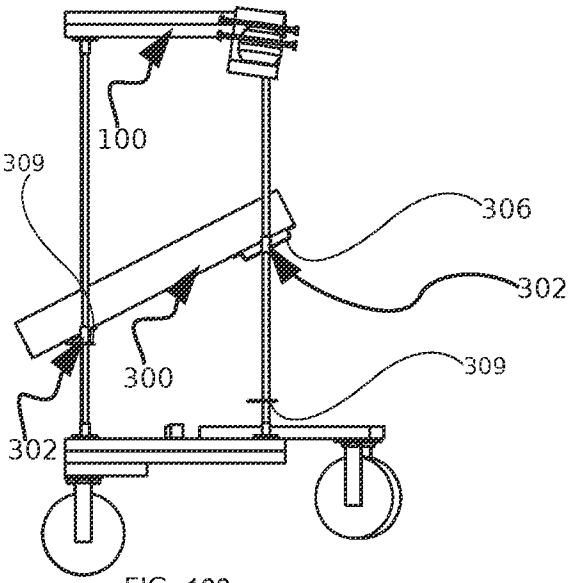
Figure 170:
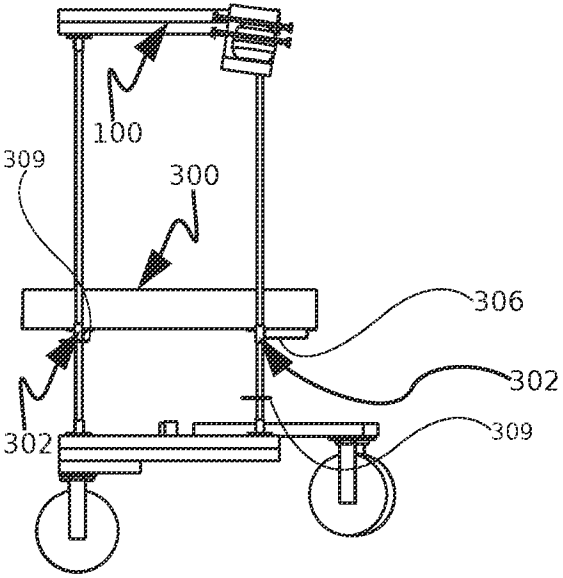

FIG. 168 is a side view of the mobile assembly 100 with the frame 300 aimed upwards;

FIG. 169 is a bottom perspective view of FIG. 168; and,

FIG. 170 is a side view of the mobile assembly 100 with the frame 300 level, according to one or more embodiments of the disclosed subject matter.

Figure 171:
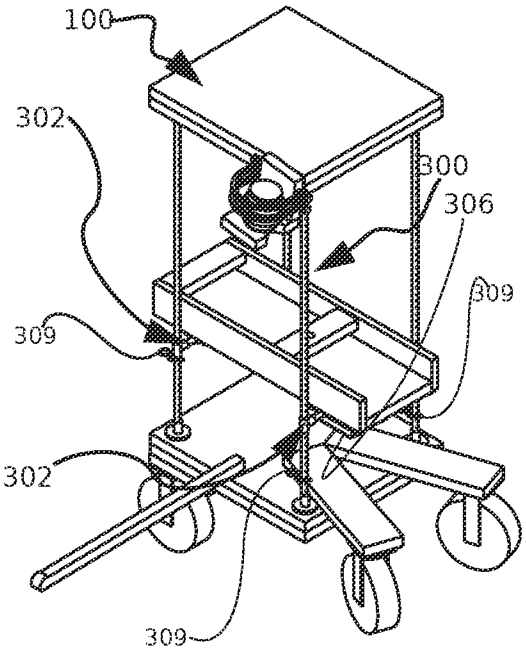
Figure 173:
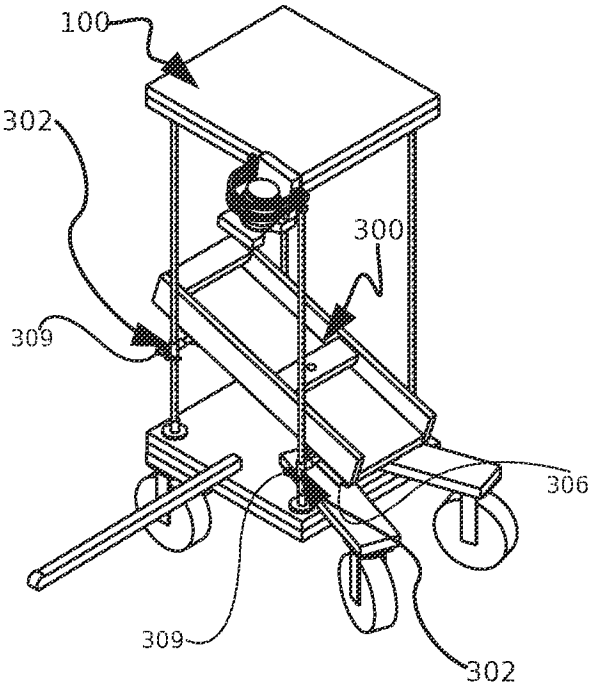
Figure 172:
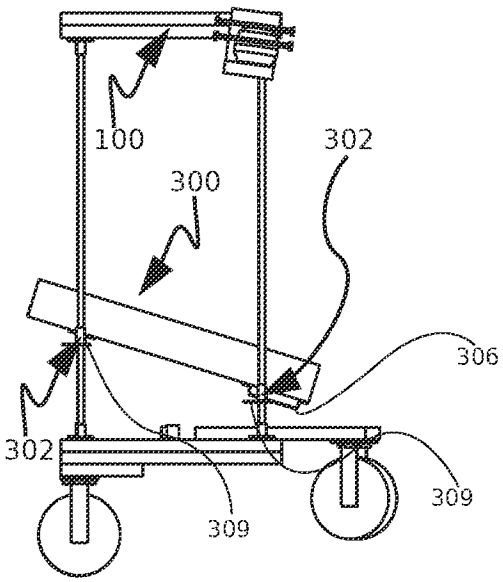

FIG. 171 is a bottom perspective view of FIG. 170;

FIG. 172 is a side view of the mobile assembly 100 with the frame 300 aimed downwards; and, FIG. 173 is a bottom perspective view of FIG. 172, according to one or more embodiments of the disclosed subject matter.

Figure 175:
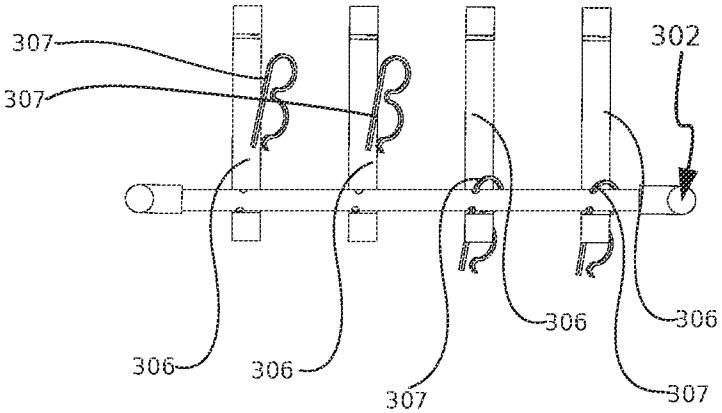
Figure 177:
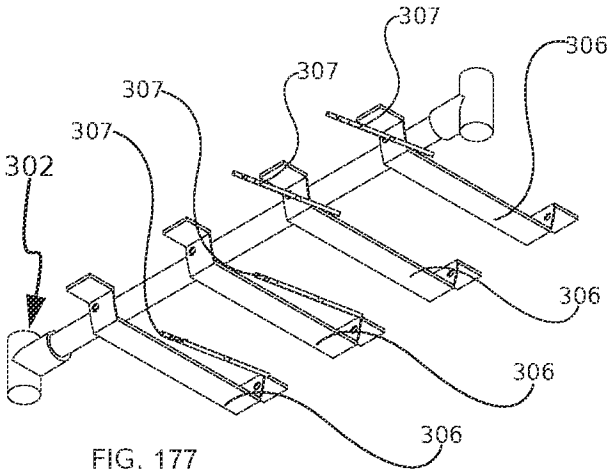
Figure 174:
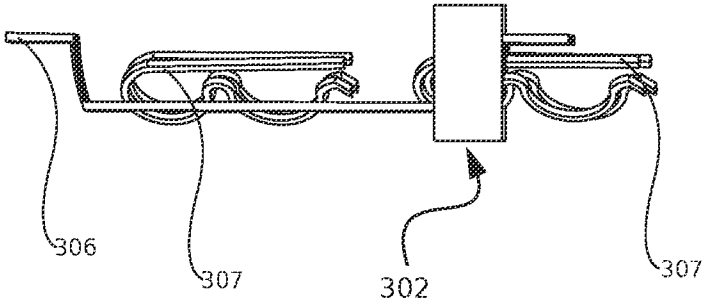
Figure 176:
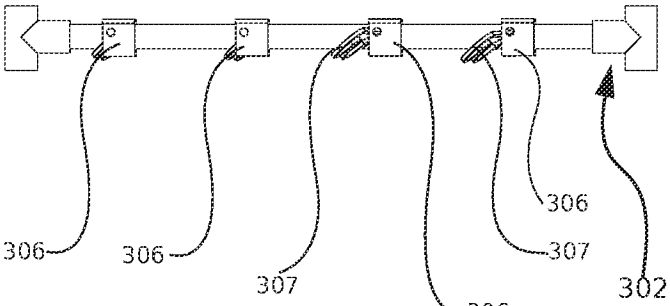

FIG. 174 is a left-side view of the longer brace 306 (i.e., when longer brace 306 is viewed from the left side) with two inserted front post hitch pins 307, and two front post hitch pins 307 before they are inserted;

FIG. 175 is a top view of FIG. 174;

FIG. 176 is a front view of FIG. 175; and,

FIG. 177 is a perspective view of FIG. 174, according to one or more embodiments of the disclosed subject matter.

Figure 179:
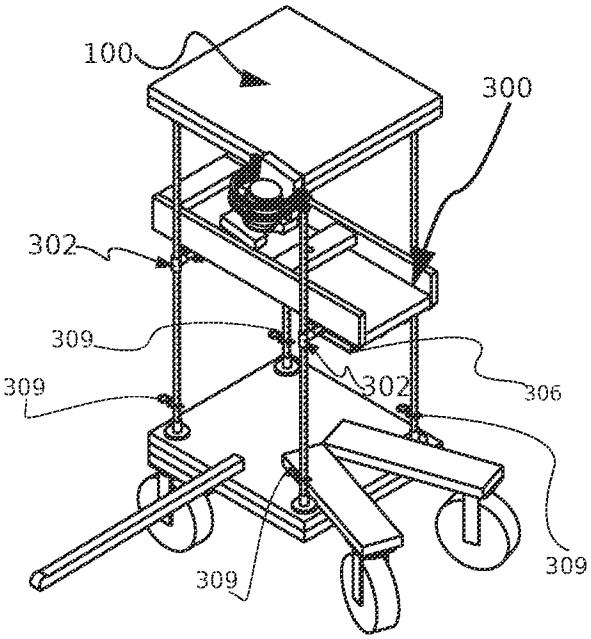
Figure 178:
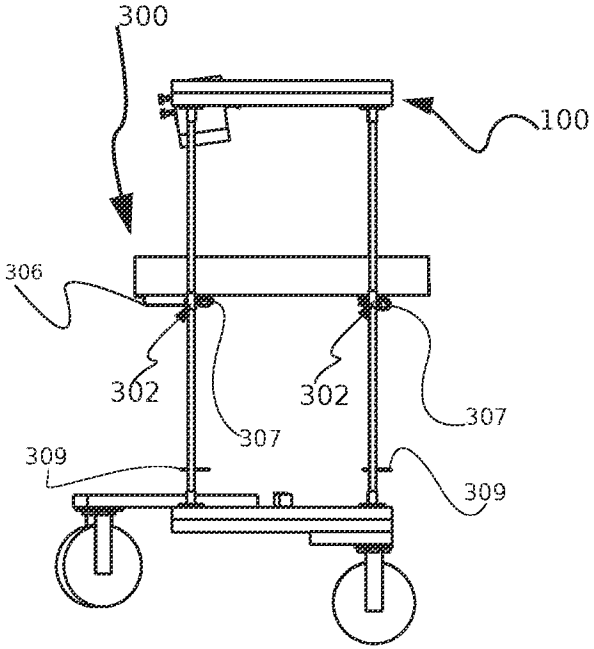
Figure 181:
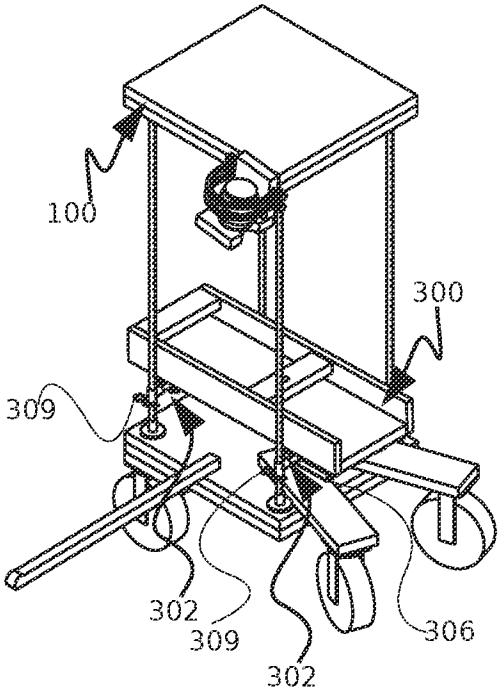
Figure 180:
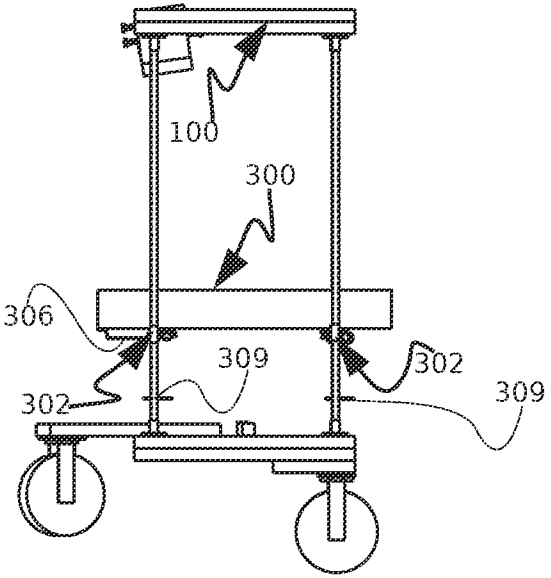

FIG. 178 is a side view of the mobile assembly 100 and frame 300 with front post hitch pins 307 inserted into the longer braces 306 while being elevated;

FIG. 179 is a perspective view of FIG. 178;

FIG. 180 is a side view of the mobile assembly 100 and frame 300 with front post hitch pins 307 inserted into the longer braces 306; and, FIG. 181 is a perspective view of FIG. 180, according to one or more embodiments of the disclosed subject matter.

Figure 183:
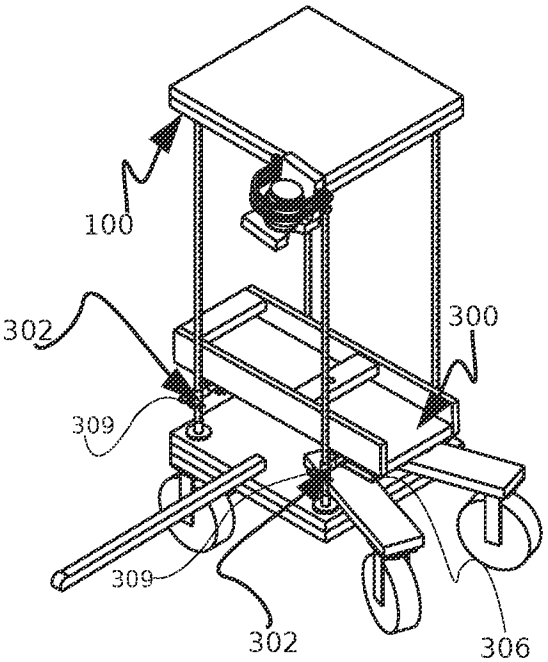
Figure 182:
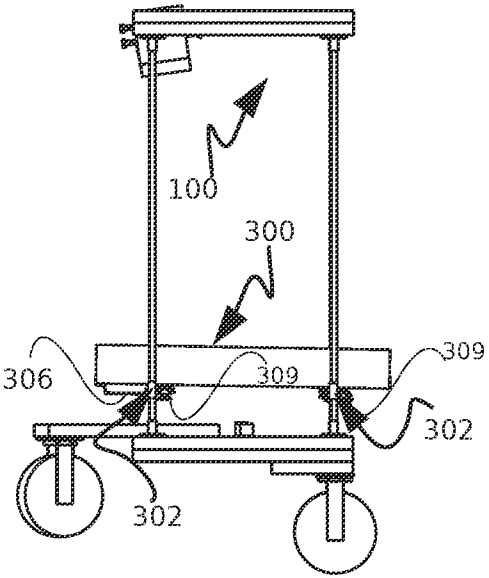

FIG. 182 is a side view of the mobile assembly 100 and frame 300 with front post hitch pins 307 inserted into the longer braces 306 after dropping down the posts 109 from the position illustrated in FIG. 180; and, FIG. 183 is a perspective view of FIG. 182, according to one or more embodiments of the disclosed subject matter.

DETAILED DESCRIPTION OF THE EMBODIMENTS

Figure 1:
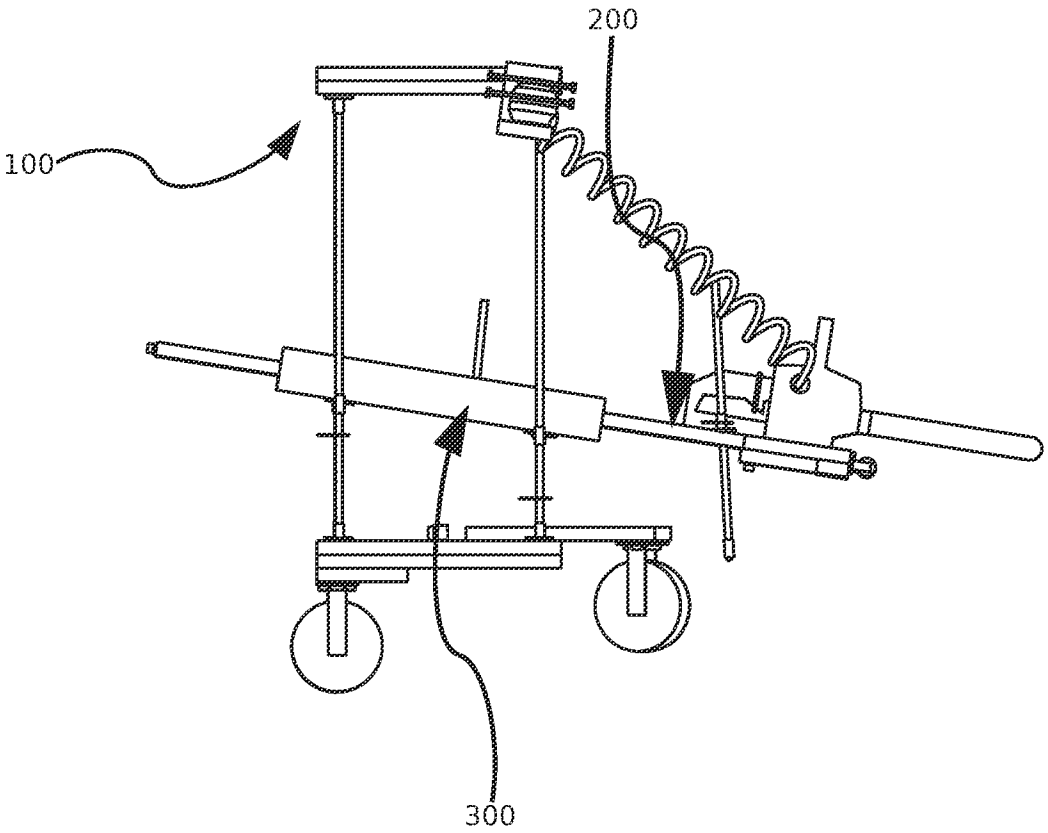
FIG. 1 is a side view of a mobile assembly, according to one or more embodiments of the disclosed subject matter.
Figure 3:
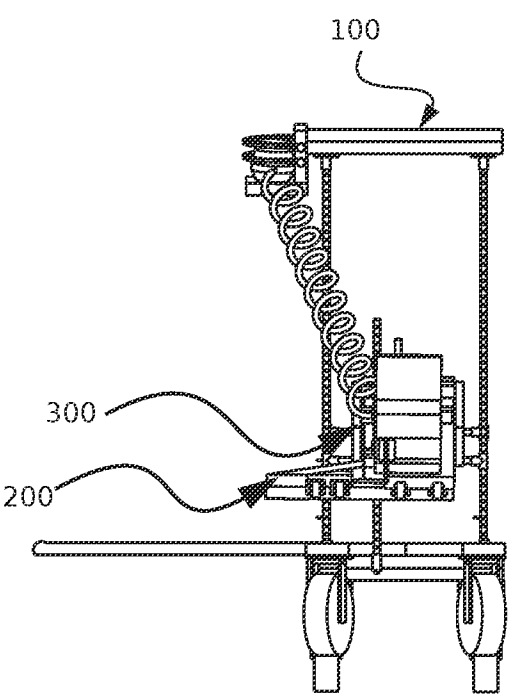
FIG. 3 is a front view.
Figure 2:
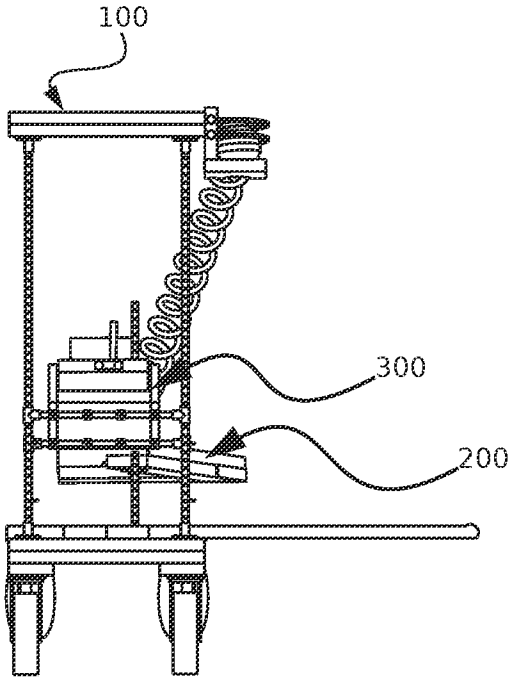
FIG. 2 is a rear view.
Figure 4:
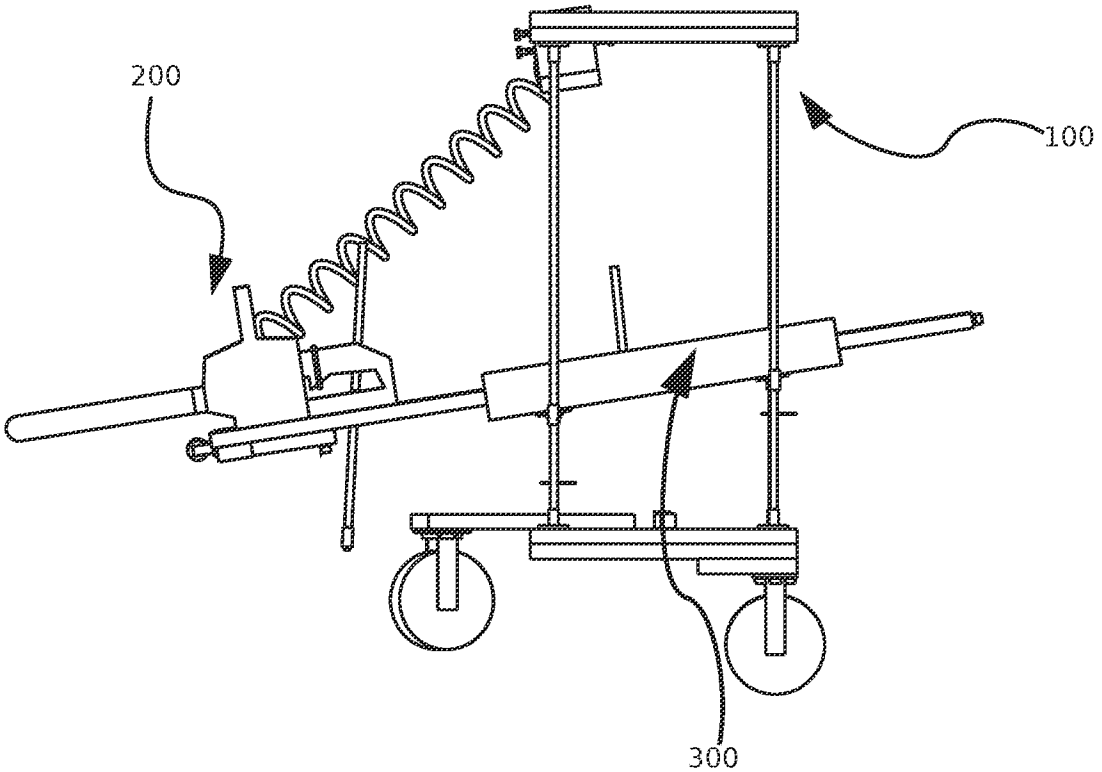
FIG. 4 is a side view.
Figure 6:
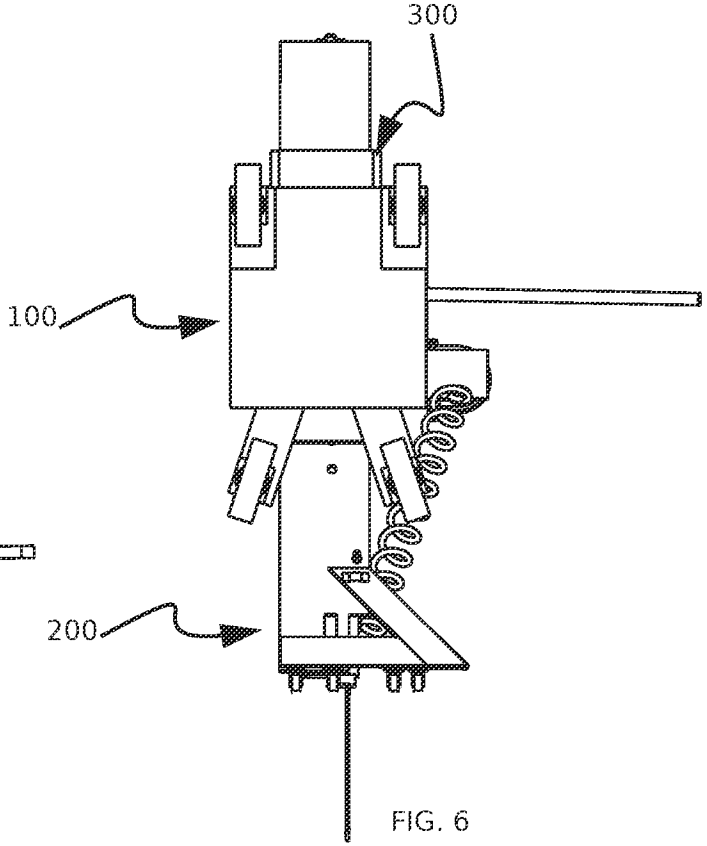
FIG. 6 is a bottom view corresponding to the mobile assembly of FIG. 1, according to one or more embodiments of the disclosed subject matter.
Figure 5:
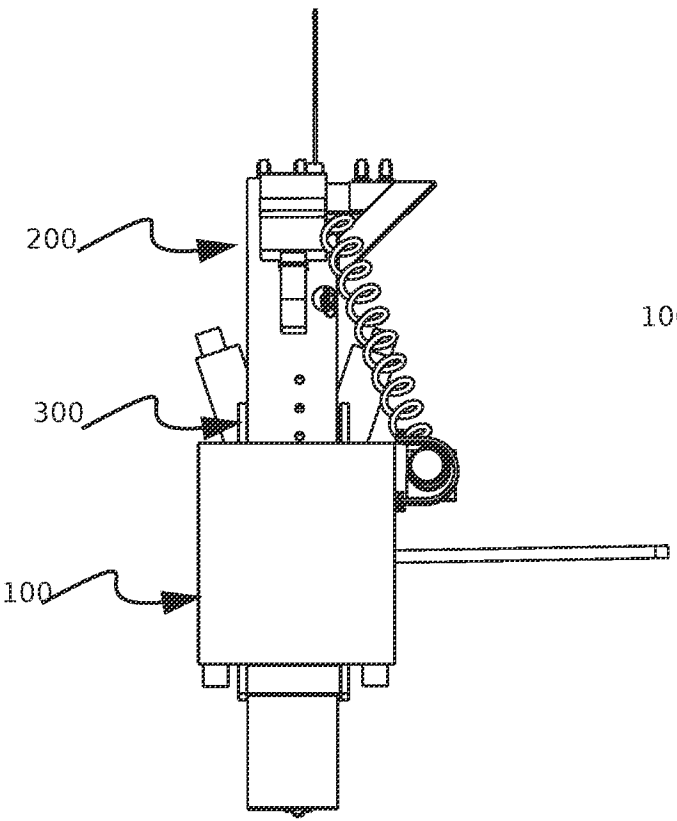
FIG. 5 is a top view.
Figure 8:
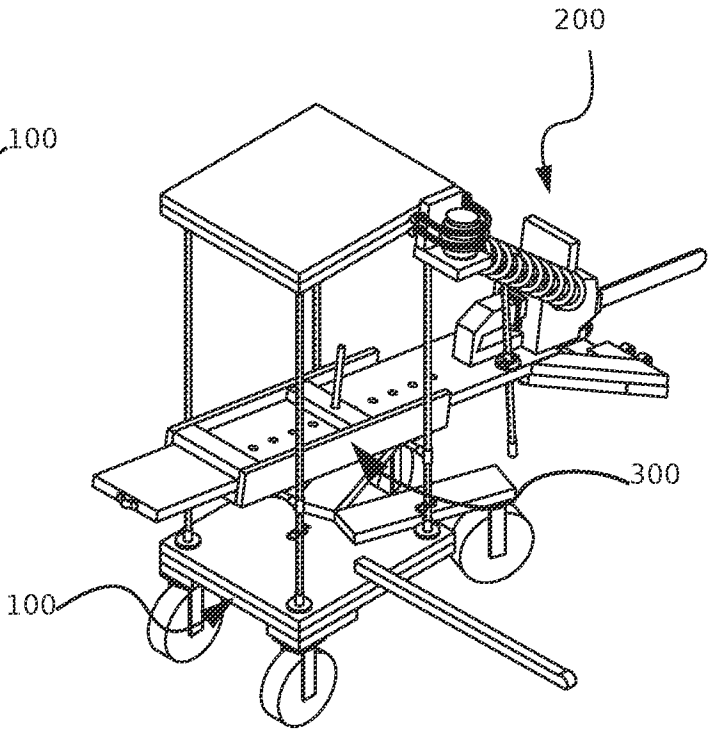
FIG. 7 and FIG. 8 are top perspective views.

Below, the technical solutions in the examples of the present invention are depicted clearly and comprehensively with reference to the figures according to the examples of the present invention. Obviously, the examples depicted here are merely some examples, but not all examples of the present invention. In general, the components in the examples of the present invention depicted and shown in the figures herein can be arranged and designed according to different configurations. Thus, detailed description of the examples of the present invention provided in the figures below are not intended to limit the scope of the present invention as claimed, but merely represent selected examples of the present invention. On the basis of the examples of the present invention, all of other examples that could be obtained by a person skilled in the art without using inventive efforts will fall within the scope of protection of the present invention. The present invention will be further described with reference to the accompanying drawings:

A mobile assembly 100 (also referred to herein as "assembly 100" or simply "assembly" of "device") for cutting wood is provided herein. According to various embodiments, the mobile assembly 100 as described herein includes a base 102 supported by wheels. The wheels are configured for moving the assembly during cutting operations and during transporting of the assembly. In some embodiments, the assembly may not include wheels. The assembly also includes one or more posts 109 extending upwards from the base 102 (see FIG. 1, for example). In various embodiments, each upstanding post 109 includes a plurality of openings such as pin holes 118. Each pin hole 118 is configured for receiving a hitch pin 309 (see FIGS. 25 through 28, for example). The assembly further includes a frame 300 that removably coupled to at least one distal post 109 and one proximal post 109. The frame 300 is configured to pivot relative to at least one of the distal and proximal posts when coupled thereto. The frame 300 is also configured for positioning at different heights along the at least one of the distal and proximal posts. In some embodiments, there is only is only one post provided; in other words, the assembly consists of only one post. In some embodiments, there is a single distal post and a single proximal post.

Figure 22:
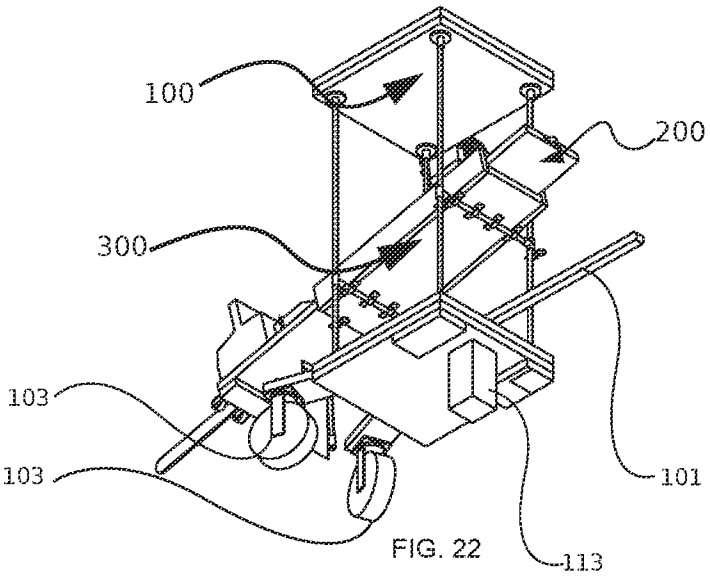
FIG. 22 is a bottom perspective view corresponding to the assembly of FIG. 1, according to one or more embodiments of the disclosed subject matter.

In various embodiments, lateral bars 302 are provided for supporting the frame on its underside (see FIG. 22, for example). In various embodiments, the frame is pivotally attached to one or more lateral bars 302. Each lateral bar 302 can extend between two posts 109, with each end of a lateral bar 302 removably secured to a post 109 by means of one or more hitch pins 309. In one embodiment, a front lateral bar attaches to the frame by one or more front braces 312 and a rear lateral bar attaches to the frame by one or more rear braces 311. The hitch pins and pin holes can be replaced by any other similar securing mechanisms, as a person of skill in the art would understand. Similarly, the braces can be replaced by any other similar securing mechanisms, as a person of skill in the art would understand. In various embodiments, each lateral bar can include a t-joint pipe 117 at its ends, wherein a vertical section of the t-joint pipe 117 is configured to slide about a post 109. The t-joint pipes can be replaced by any other similar securing mechanisms, as a person of skill in the art would understand. Accordingly, in various embodiments, each lateral bar can be coupled to a pair of posts 109 by inserting hitch pins 309 into an associated pin hole 118 (or a similar other mechanism) provided on the post 109. In one embodiment, a hitch pin 309 can pass through t-joint pipe 117 to secure each end of the lateral bar to the post 109.

FIGS. 25 through 28 illustrate a post 109. In one embodiment, the post 109 can consist of a pipe with pin holes 118 going all the way through the center of the post 109. The pin holes 118 can be arranged lengthwise on post 109 with about one inch spacing between them, for example. Each pin hole 118 can allow a post hitch pin to go through it. Optional top and bottom mounts 116 can further be provided on both sides of the pipe to assist with mounting the post in a fixed position.

Figure 29:
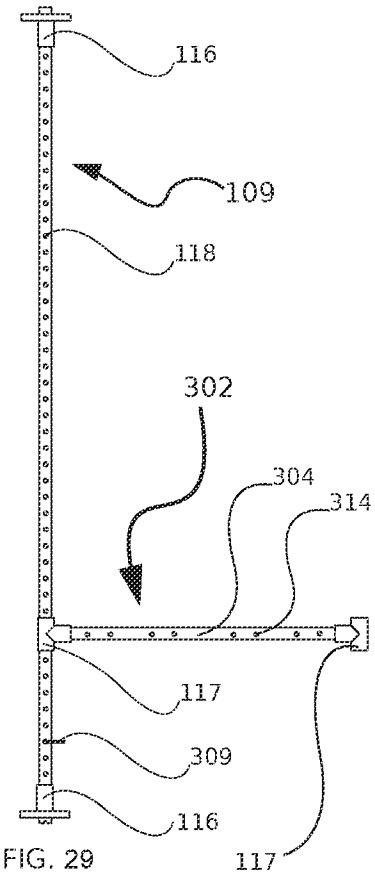
FIG. 29 is a front view of post 109 with a front first post hitch pin 309 inserted in one of the pin holes 118 at the bottom of the post 109.

FIGS. 29 through 32 show a post 109 with a sliding lateral bar 302 around the post 109. FIG. 29 is a front view of post 109 with a front first post hitch pin 309 inserted in one of the pin holes 118 at the bottom of the post 109. Additionally, there is a sliding lateral bar 302 coupled to the post 109. In some embodiments, as illustrated in FIG. 29, the sliding lateral bar 302 consists of a pipe 304 with t-joint pipe 117 at its ends. Pin holes 118 spread out lengthwise uniformly along the post 109. The t-joint pipe 17 encircling the posts 109 can slide up and down the post 109 freely until stopped by a front first post hitch pin 309, in one embodiment. FIG. 29 shows the sliding lateral bar 302 elevated about a half foot above the front first post hitch pin 309. The lateral bar 302 can be positioned between two front posts or between two rear posts for supporting the frame 300 thereon, wherein hitch pins inserted into openings provided on the posts 109 can hold each sliding lateral bar 302 in position. Accordingly, in various embodiments, the frame is configured to slide up and down about the posts by way of the ability of the lateral bars to be secured at different heights on the posts by selecting the appropriate set of pin holes to secure hitch pins 309 thereto. The frame is accordingly configured to slide up and down about the posts, with the frame being pivotally secured to the posts via one or more hitch pins. In various embodiments, the frame is also configured to pivot about each of a front lateral bar and a rear lateral bar that are attached to the frame respectively by way of one or more front braces 312 and one or more rear braces 311.

Figure 7:
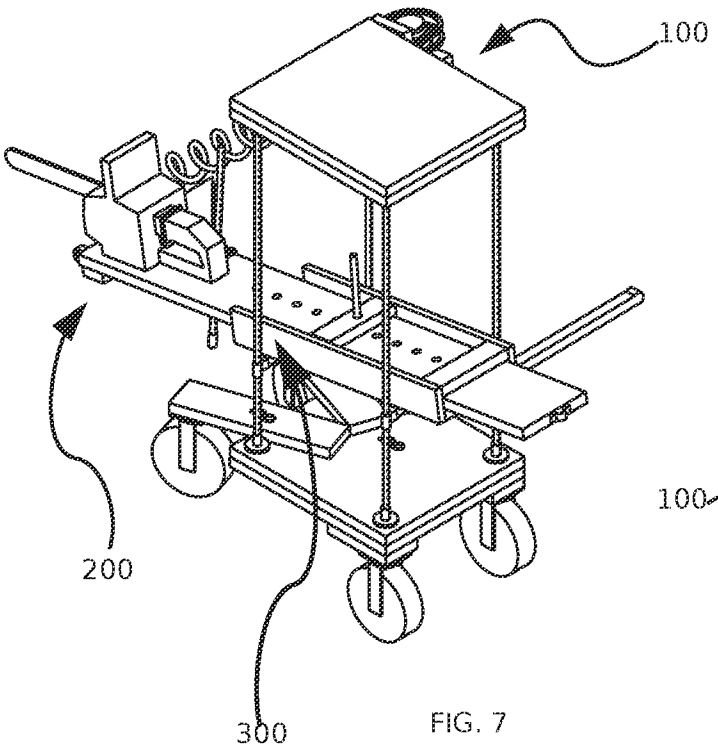
Figure 10:
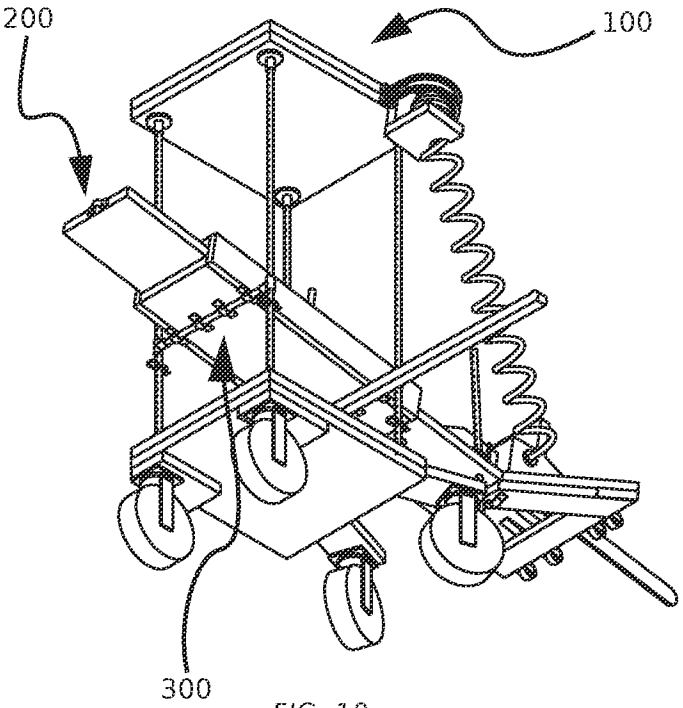
FIG. 9 and FIG. 10 are bottom perspective views corresponding to the mobile assembly of FIG. 1, according to one or more embodiments of the disclosed subject matter.
Figure 9:
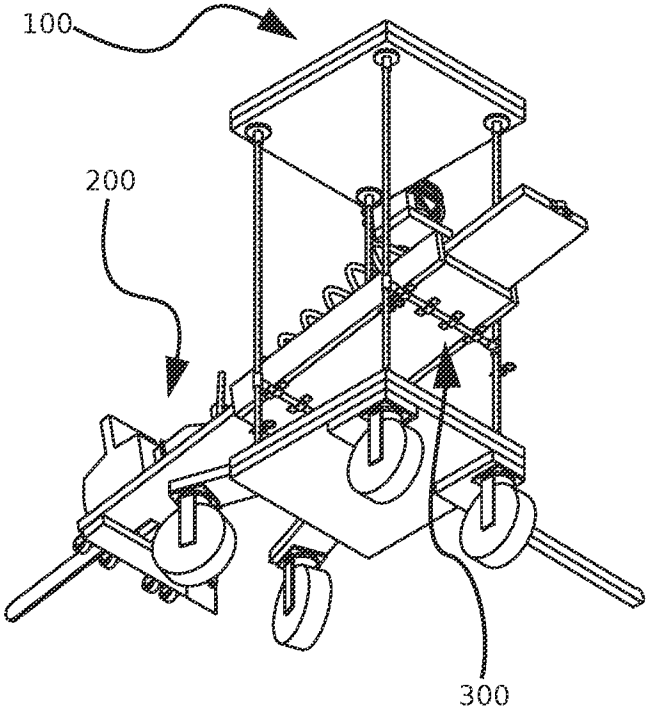
Figures 11, 12, 13:
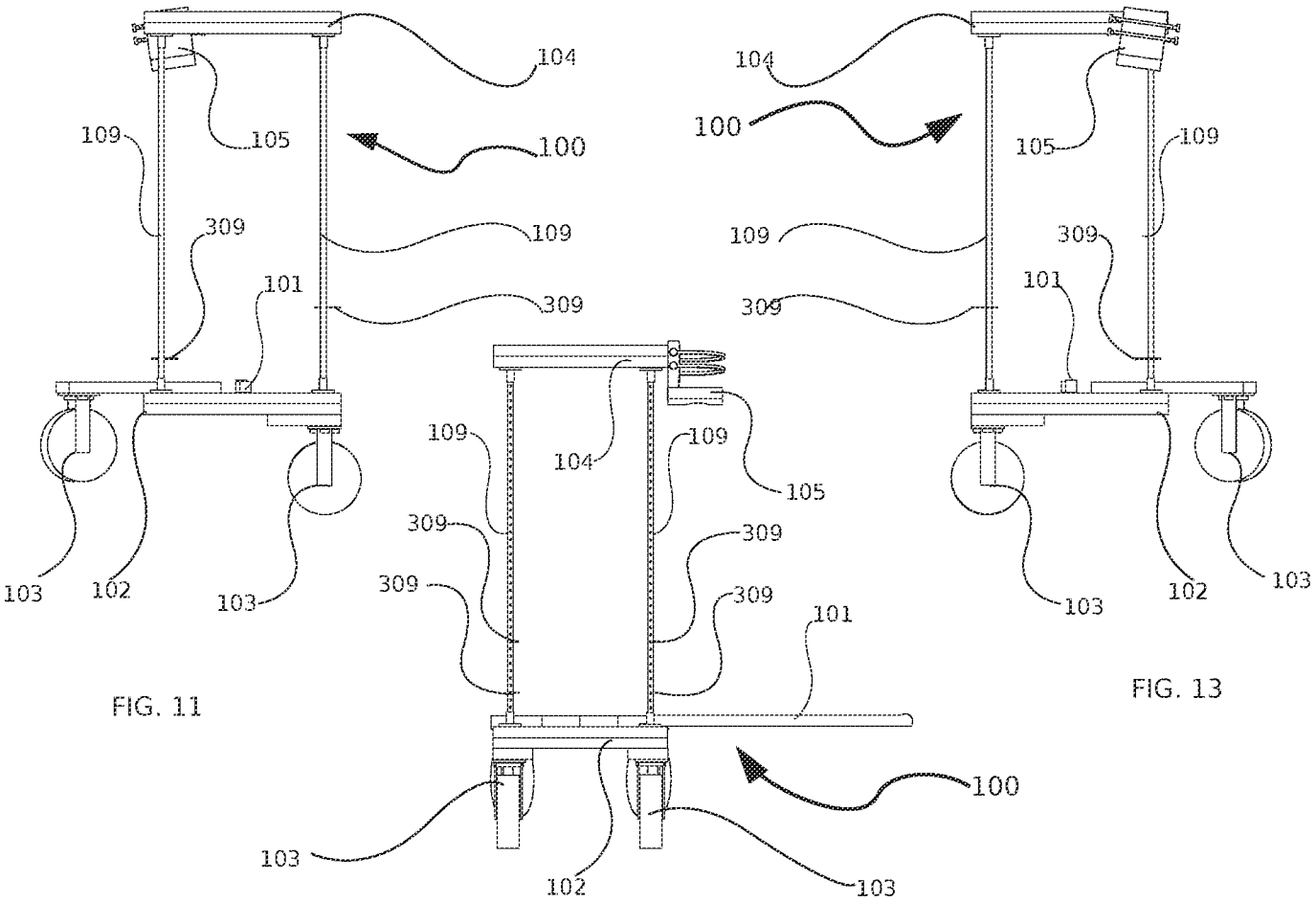
FIG. 11 is a side view of a stand associated with mobile assembly, according to one or more embodiments of the disclosed subject matter.
FIG. 12 is a rear view.
FIG. 13 is a side view.
Figure 16:
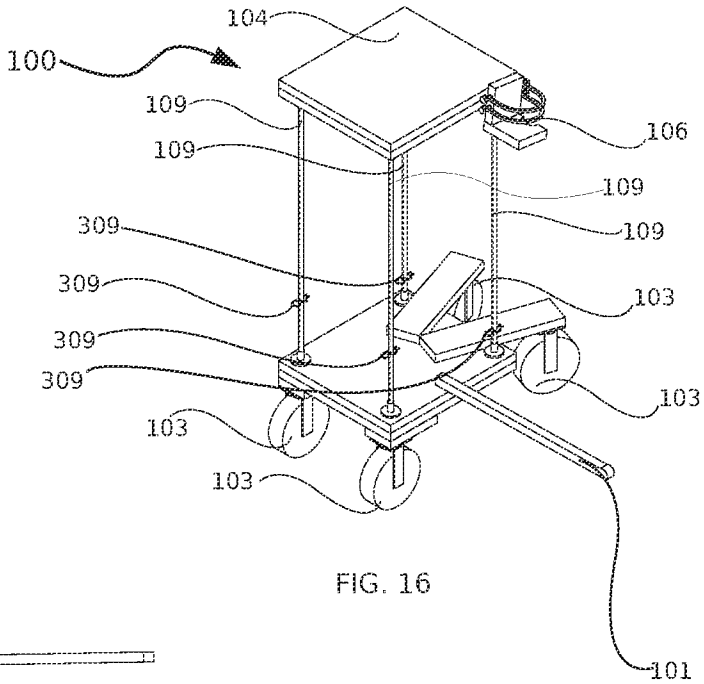
FIG. 16 is a top perspective view.
Figure 15:
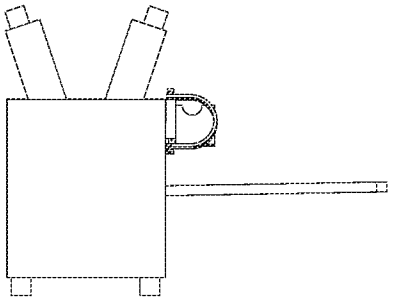
FIG. 15 is a top plan view.
Figure 53:
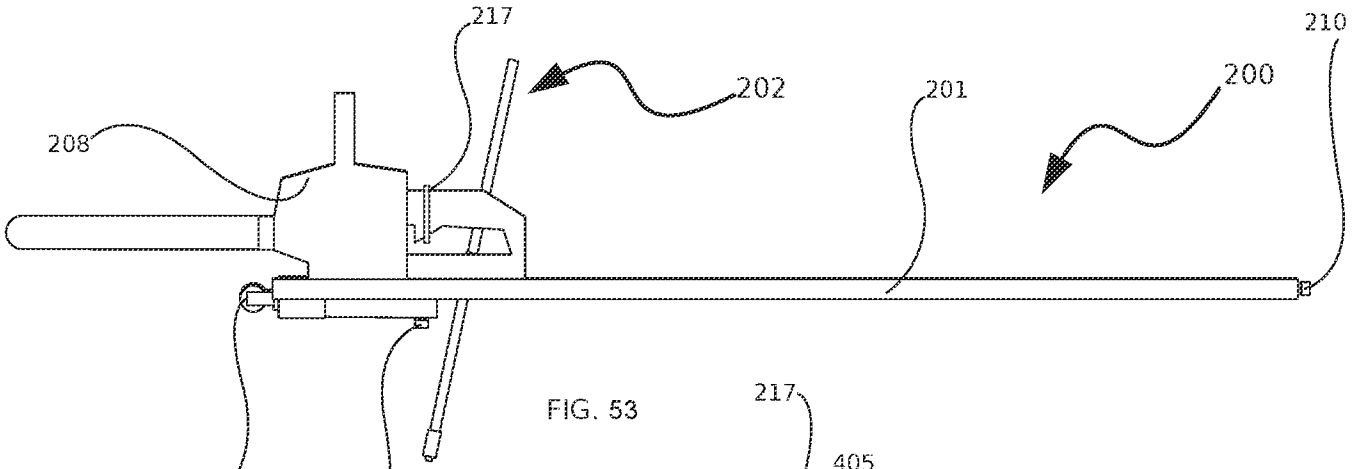
FIG. 53 and FIG. 54 are side views of the arm 200.
Figure 54:
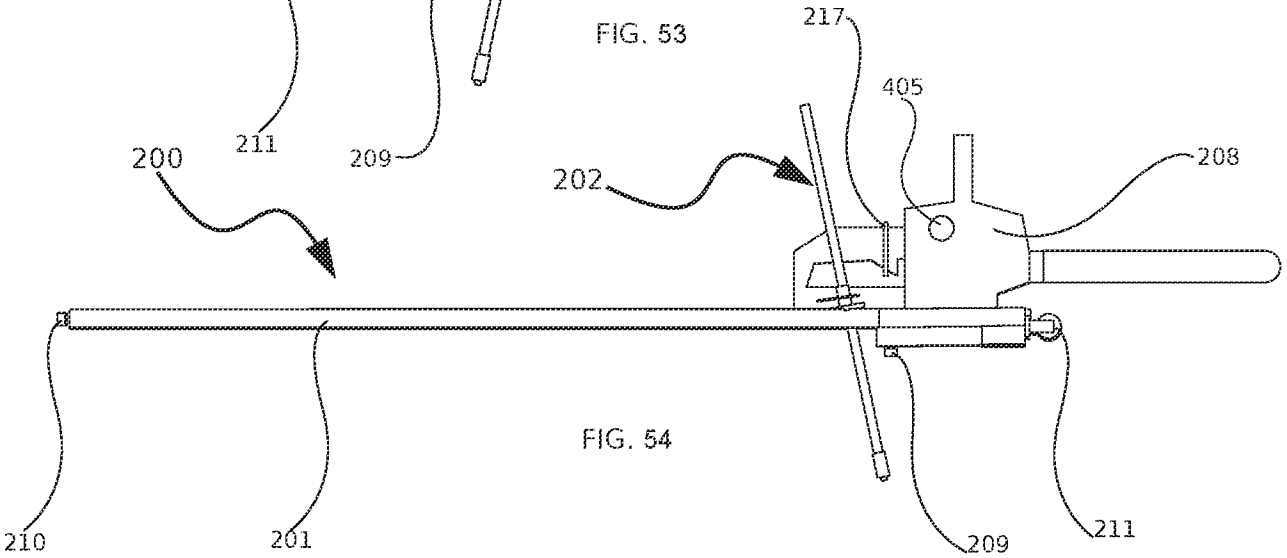
Figure 55:
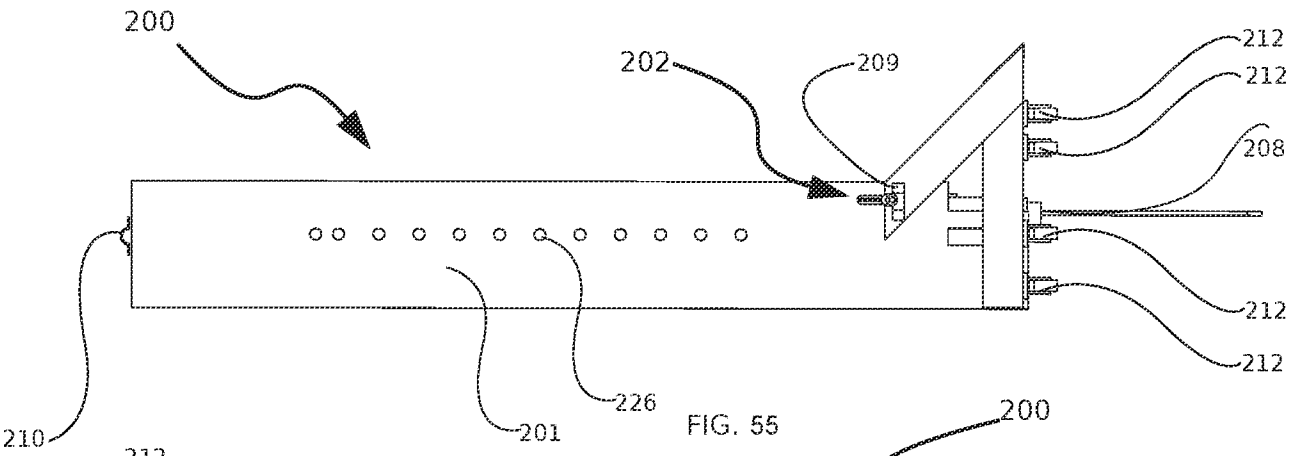
FIG. 55 is a bottom view of the arm 200.
Figure 56:
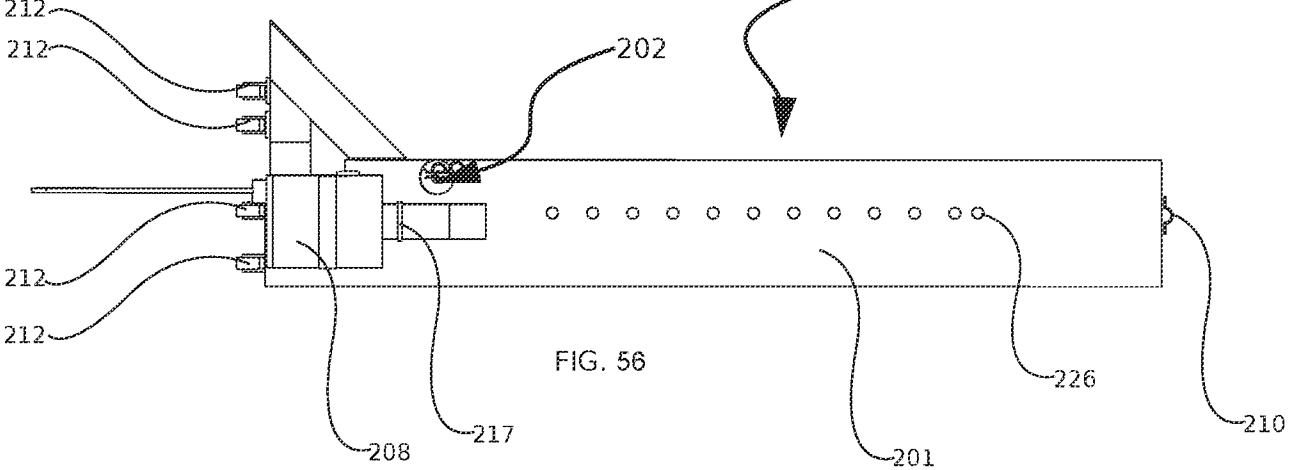
FIG. 56 is a top view of the arm 200.
Figures 57, 58, 59:
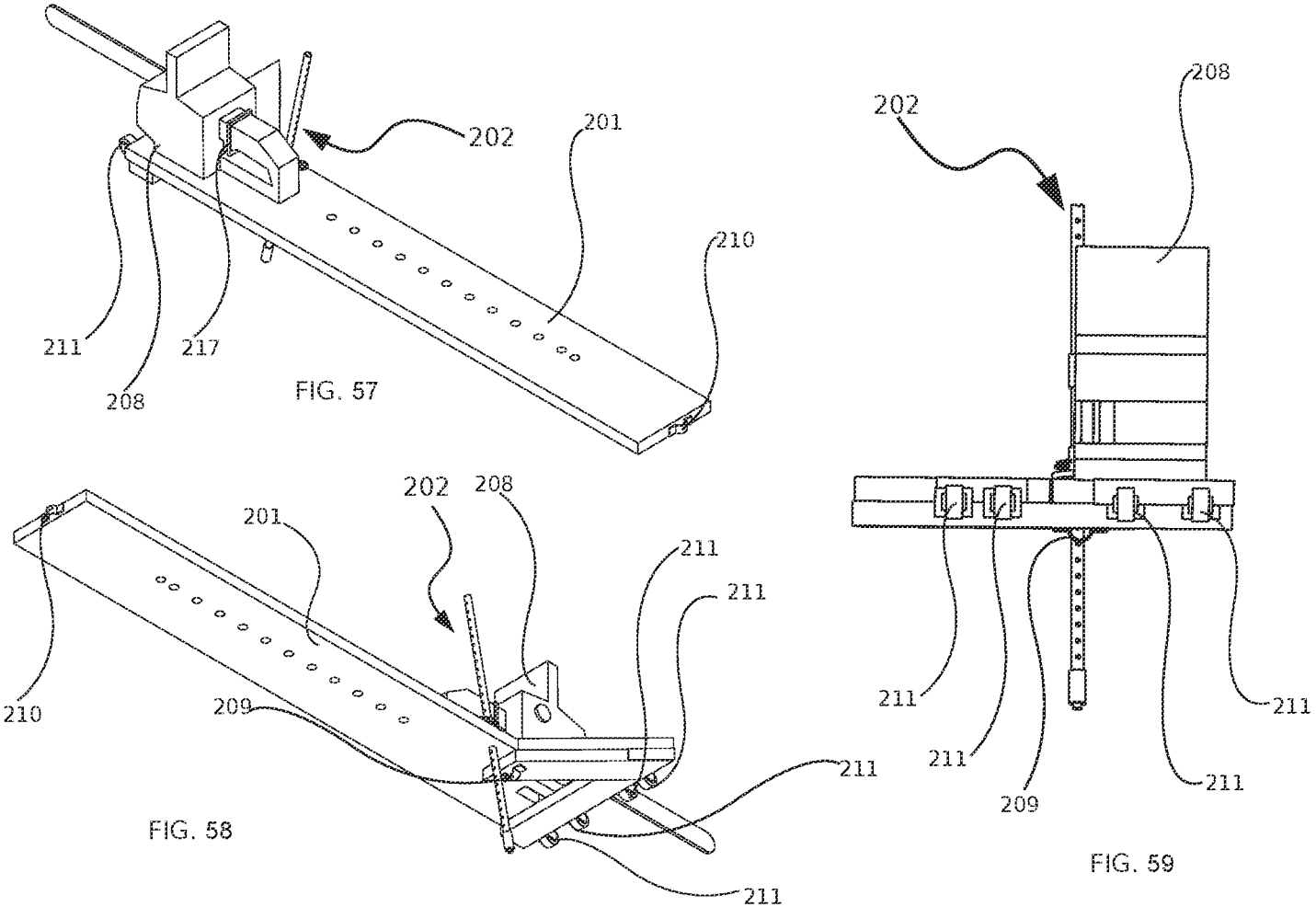
FIG. 57 is a top perspective view of the arm 200.
FIG. 59 is a front view of the arm 200.
Figures 60, 61, 62:
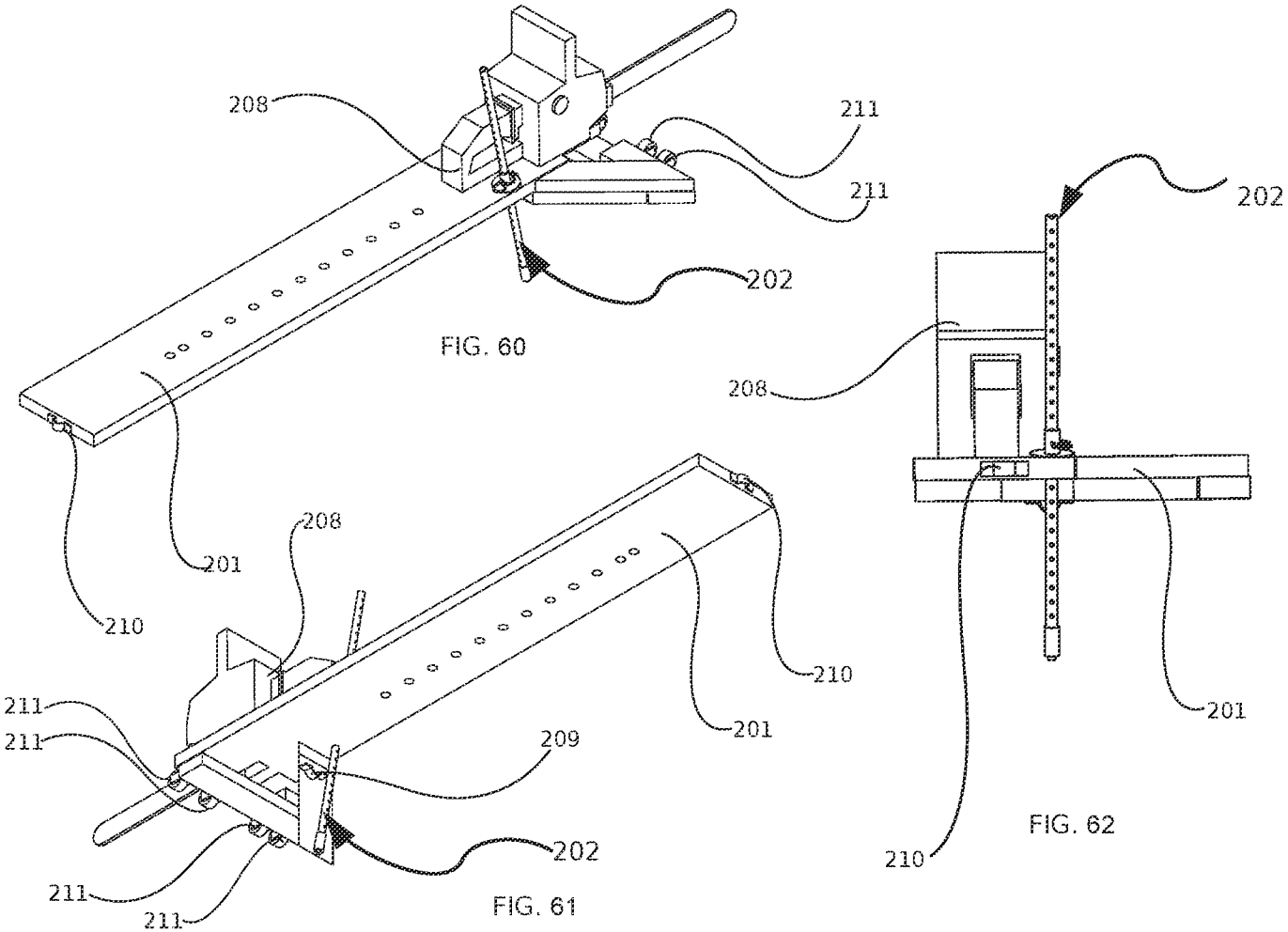
FIG. 60 is a perspective view of the arm 200.
FIG. 61 is a bottom perspective view of the arm 200.
FIG. 62 is a rear view of the arm 200, according to one or more embodiments of the disclosed subject matter.
Figure 64:
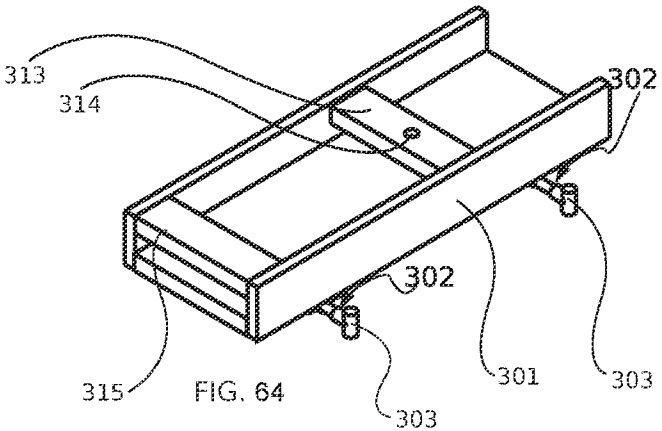
FIG. 64 is a perspective view of the frame 300.
Figure 63:
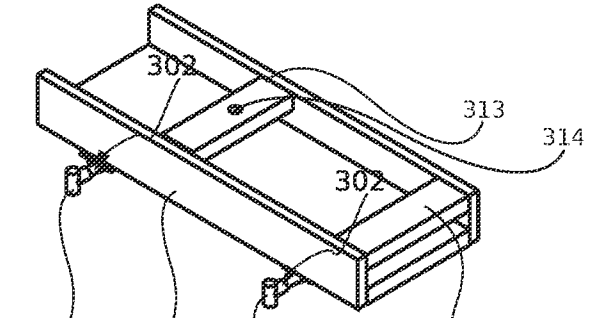
FIG. 63 is a perspective view of the frame 300.
Figure 65:
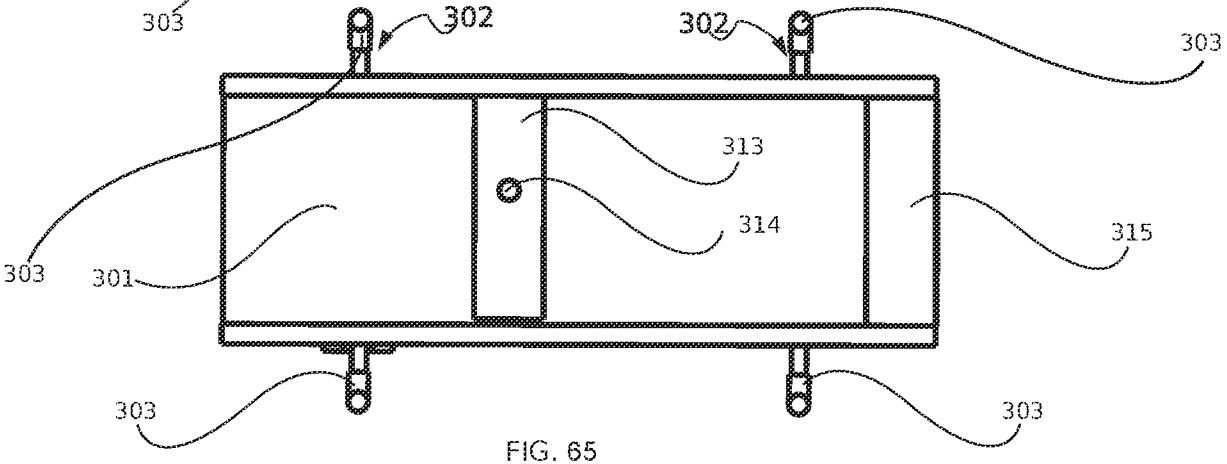
FIG. 65 is a top view of the frame 300.
Figure 67:
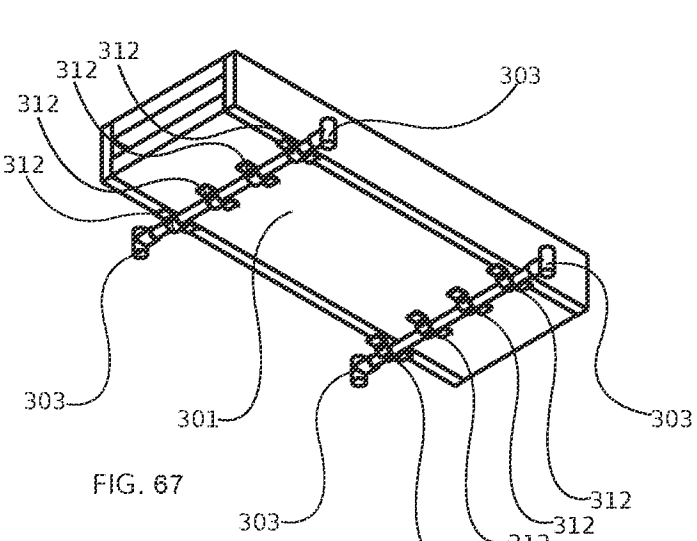
FIG. 67 is a bottom perspective view of the frame 300.
Figure 66:
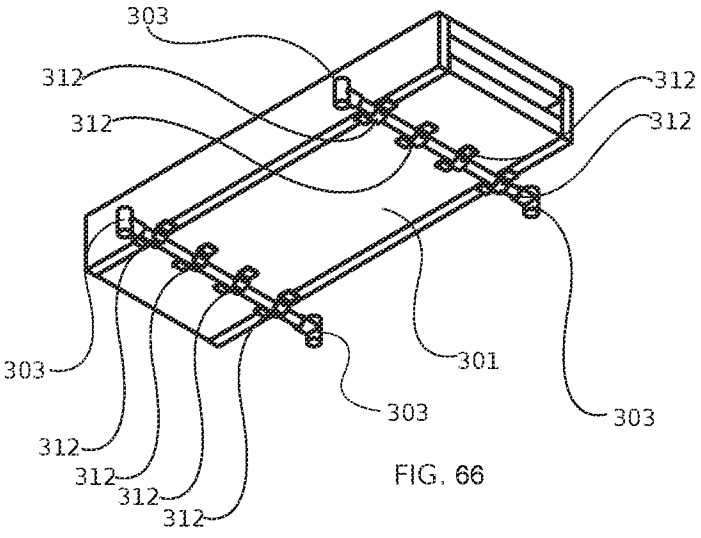
FIG. 66 is a bottom perspective view of the frame 300.
Figure 68:
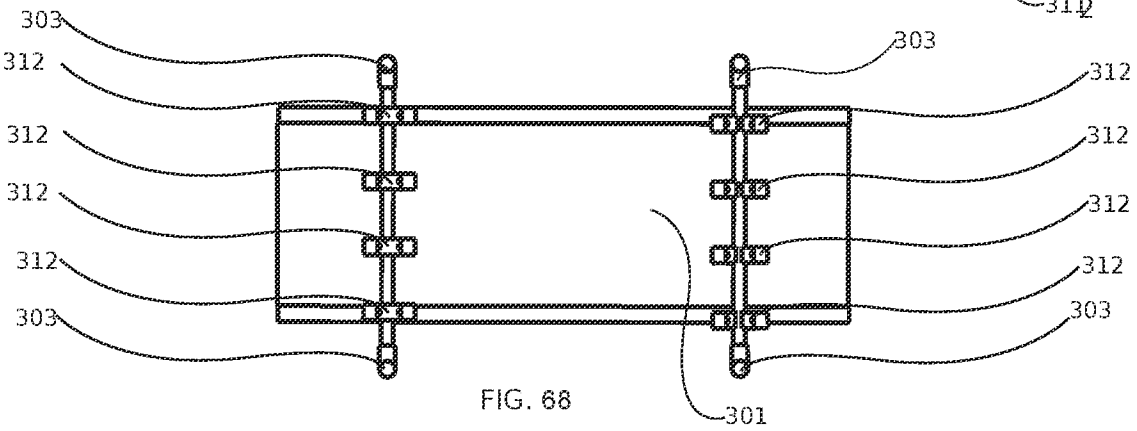
FIG. 68 is a bottom view of the frame 300, according to one or more embodiments of the disclosed subject matter.
Figure 71:
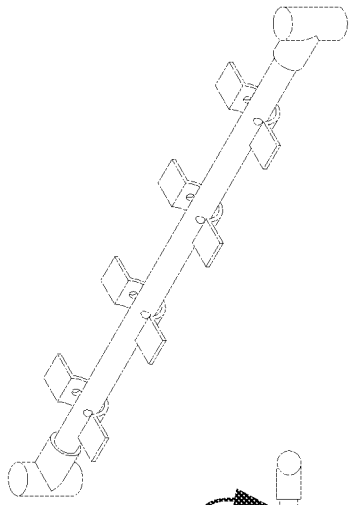
FIG. 71 is a further perspective view of FIG. 69, according to one or more embodiments of the disclosed subject matter.
Figure 70:
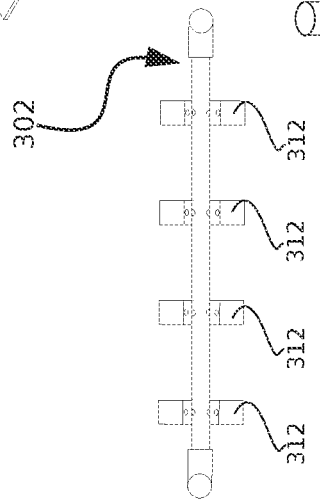
FIG. 70 is a top view corresponding to FIG. 69.
Figure 74:
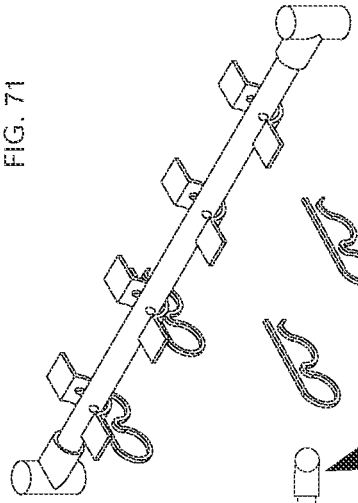
FIG. 74 is another perspective view corresponding to FIG. 72, according to one or more embodiments of the disclosed subject matter.
Figure 73:
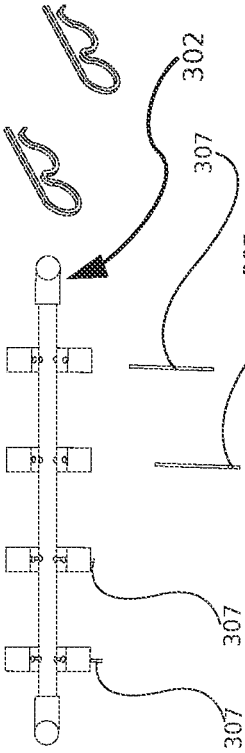
FIG. 73 is a top view corresponding to FIG. 72.

The assembly also includes an arm 200 supported by the frame 300. The arm 200 is configured for sliding about, and parallel to, the frame 300. In one embodiment, the arm 200 is located on the frame 300 as shown, for example, in FIG. 7. In one embodiment, the arm 200 slides into and extends on either side of the frame 300. The arm 200 can include a chainsaw 208 attached to a distal region of the arm (see FIGS. 1 and 53, for example). In other words, the chainsaw 208 is attachable to a distal end of the arm 200 extending out of the frame 300. In one embodiment, arm 200 includes a main board 201. The main board 201 includes holes 226 spaced about two inches apart, for example, the holes 226 being provided along the entire top center of the board 201. These holes 226 are able to line up with holes 314 provided in the middle support 313 of the frame 300, with a stopping leg 212 capable of being inserted through a hole 226 and a hole 314. The stopping leg 212 can extend downwards from the arm (and the frame), with the stopping leg being configured to prevent the chainsaw blade from descending below a predetermined height above a ground surface.

Longer braces 306 are longer than front braces 312 and rear braces 311. Longer braces 306 are configured to be locked in with pins as shown in FIGS. 174 to 177. FIG. 174 is a left view of a longer brace 306 with two inserted front post hitch pins 307, and two front post hitch pins 307 before they are inserted. The post hitch pins 307 go through the front sliding lateral bar 302 and the longer braces 306. As shown in FIGS. 162 to 183, a longer brace 306 helps the hinge motion to occur in a smoother manner as compared to that which occurs with front braces 312 and rear braces 311. If there is no flexibility in the materials of the mobile assembly, particularly as it relates to the posts 109, there is risk the frame 300 could get stuck if there is not enough of a gap where the round arrays of rear braces 311 go around the sliding lateral bars 302. As can be understood, as the chainsaw cuts deeper into a log, for example, the distance between the rear sliding lateral bar 302 and the front sliding lateral bars 302 changes as the frame 300 tilts as shown in FIGS. 168 and 170; the longer braces 306 conveniently supply flexibility as the frame 300 tilts.

In various embodiments, the chainsaw 208 is mounted above the casters 211 with a major portion of the blade of chainsaw 208 sticking out past the main board 201. Stated differently, a blade portion of the chainsaw extends beyond the distal end of the arm. The chainsaw 208 can be attached to the arm 200 in numerous ways. In one embodiment, a latching mechanism is provided on the arm 200 such that the chainsaw 208 can be removed separate from the arm 200 by unlatching and used independently, if desired. There are many ways of attaching the chainsaw 208 to the arm 200. One method is parallel to how a rechargeable volt drill battery slides into a slot provided on a typical 20 volt drill and locks therein. Another method is by providing straight loop draw latches that line up on the chainsaw 208 and the main board 201. Accordingly, in some embodiments, the chainsaw can be removably attached to the arm by a ratchet strap or a latching mechanism. In various embodiments, casters 211 can be provided in the front of a distal end of the arm 200 just below the chainsaw 208. The casters 211 can allow the arm 200 to roll down a tree or other surfaces, and thus help with the arm not getting caught when cutting through uneven surfaces. A caster 211 is accordingly provided at a distal end of the arm, with the caster positioned below the chainsaw, with the caster configured to roll on a surface that it comes in contact with.

Figures 121, 122, 123:
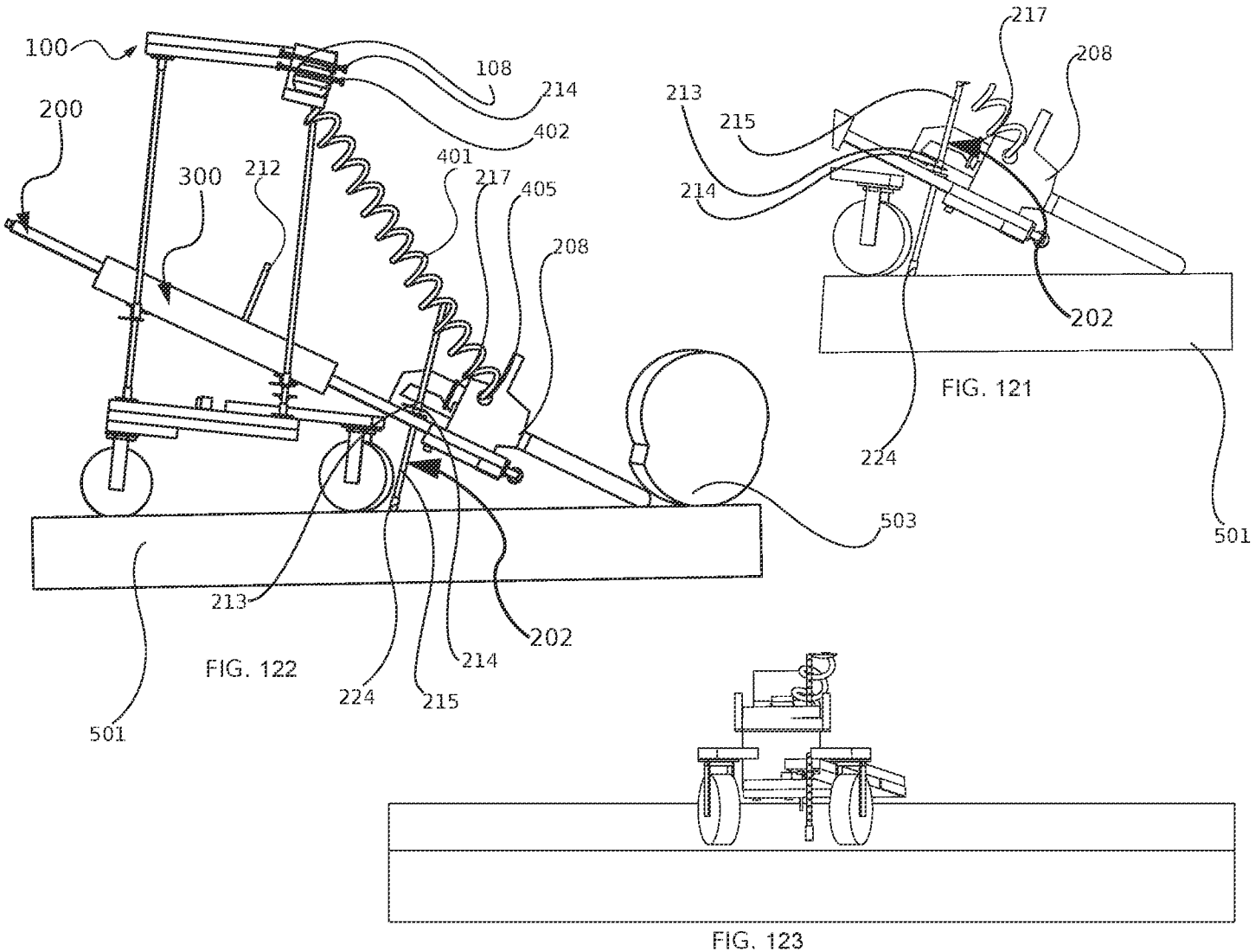
FIG. 121 is a zoomed inside view the stopping leg 202, according to one or more embodiments of the disclosed subject matter.
FIG. 122 is a full side view of the chainsaw with the stopping leg 202 adjusted to stop or turn off the chainsaw before the blade of chainsaw 208 touches the ground 501 or a solid surface, according to one or more embodiments of the disclosed subject matter.
FIG. 123 is a zoomed in rear view of FIG. 121, according to one or more embodiments of the disclosed subject matter.
Figure 126:
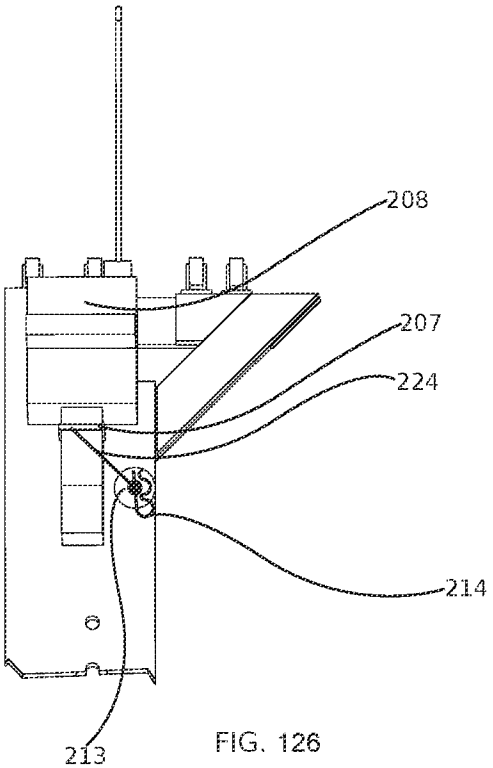
FIG. 126 is a top view of FIG. 124.
Figure 124:
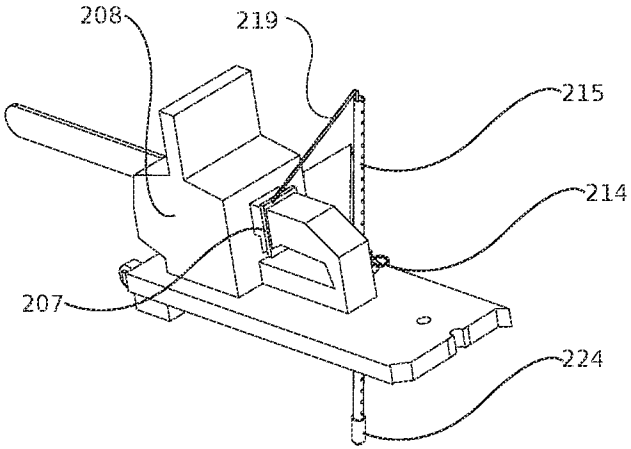
FIG. 124 is a top perspective view of the stopping leg 202 for a gas-powered version of a chainsaw 208 with cable 219 coming out the top of the stopping leg 202 and connected to a band 207 wrapped snugly around the un-pressed trigger of chainsaw 208, according to one or more embodiments of the disclosed subject matter.
Figure 125:
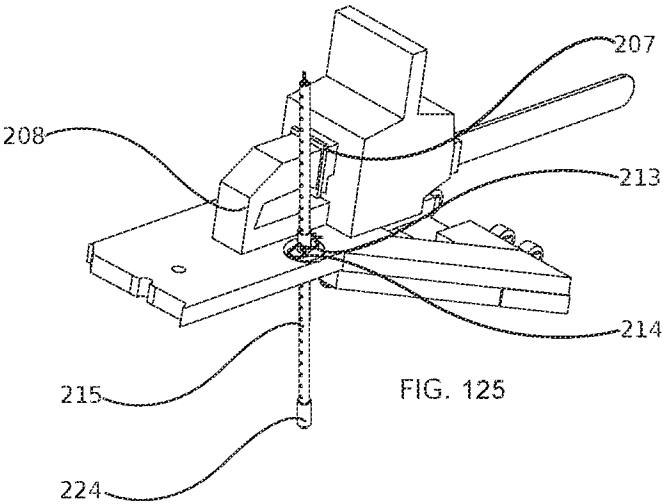
FIG. 125 is a top perspective view of FIG. 124.
Figure 127:
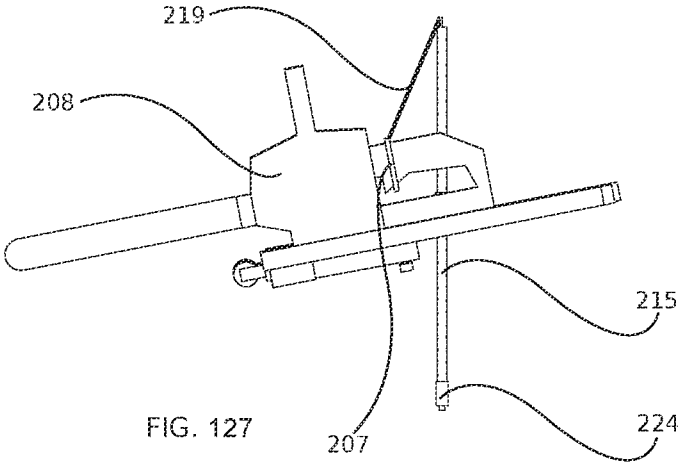
FIG. 127 is a side view of FIG. 124.
Figure 128:
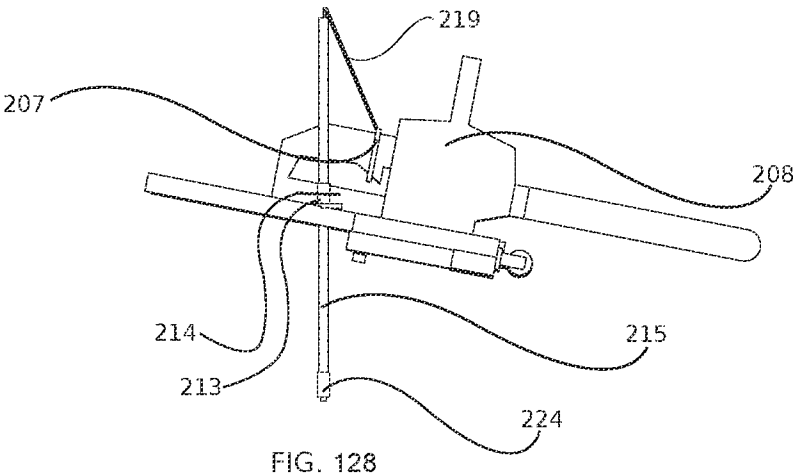
FIG. 128 is a side view of FIG. 124.
Figure 129:
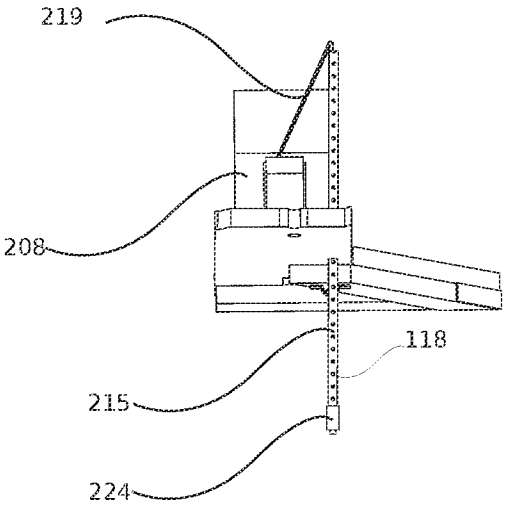
FIG. 129 is a rear view of FIG. 124, according to one or more embodiments of the disclosed subject matter.

The assembly can also include a stopping leg 202. It can be advantageous to turn off the chainsaw 208 in an automated fashion when the cutting of a log or tree limb is complete, and further to create a way to ensure the blade of chainsaw 208 does not touch the ground 501. One way to accomplish this is by providing a stopping leg 202 next to the chainsaw 208 to prevent the chainsaw 208 from descending past a set height shown in FIG. 121 to FIG. 137. The lowest height above the ground surface to be reached by the blade of the chainsaw can be adjustable by sliding the stopping leg higher or lower about a leg mount coupled to the arm 200 and/or to the frame 300 prior to securing the stopping leg to the leg mount. In some embodiments, a bottom end of the stopping leg can include a power cut-off trigger switch to stop the chainsaw when the power cut-off switch contacts a ground or other surface. FIG. 121 shows how the stopping leg 202 is adjusted to the proper height by sliding the leg post 215 higher or lower inside the leg mount 213. The leg post 215 forms part of the stopping leg 202. The leg post 215 is then locked in with the leg hitch pin 214. Now the leg post 215 will stop the arm 200 from descending by hitting the ground before the blade of chainsaw 208 touches the ground. It is possible to set the arm 200 to cut below ground level to help cut up stumps.

In a further example, a chain going from the front of the top base 104 to the handle of the chainsaw 208 is provided. The height of how far the arm 200 can fall can be adjusted by shortening or lengthening the chain between the chainsaw handle and the front of the top base 104. Additionally, a sensor can be placed on the chain anchor holding the chain on the top base 104. The sensor can deduct when the chain to identify when the cut is complete, and the sensor can proceed to initiate turning off of the chainsaw.

A gas-powered chainsaw 208 setup is shown in FIGS. 124 to 132. For the gas-powered chainsaw 208, the leg post 215 (which forms part of the stopping leg 202) can be in the form of a hollow pipe with long cylinder shaped weight 221 inside of the hollow pipe. The weight 221 can freely move up and down inside the leg post 215 and can only partially come out the bottom due to the stopper 224. Attached to the top of the weight 221 is a cable 219. This cable 219 can go through the center of the leg post 215 and comes out the top. The other end of the cable 219 is then attached to the band 207 around the trigger of chainsaw 208. This length of cable 219 can be adjusted to keep the correct tension based on the position of stopping leg 202. The top of the leg post 215 is always elevated above the trigger in one embodiment. The top of the leg post 215 acts as a pulley; alternately, an optional pulley can be attached to the top of the leg post 215. This creates the functionality of the chainsaw running only during such time when the stopping leg 202 is above the ground since the weight 221 will be partially sticking out the bottom of the leg post 215 and adding tension to the cable 219; this tension is transferred to the band 207 around the trigger, holding it down. When the stopping leg 202 meets the ground, the weight 221 is pushed up inside the leg post 215, releasing the tension on the cable 219. This results in the tension being released from the band 207 around the trigger, thereby turning the chainsaw off. This is just one example on how the gas-powered chainsaw 208 can be turned off at the end of a cut, and many other variations can be provided to this create the same or similar functionality, as a person of skill in the art will readily understand.

Accordingly, in some embodiments where the chainsaw is gas-powered, the stopping leg can include an opening therethrough for receiving a sliding weight therein. One end of a cable can be removably attached to a chainsaw trigger and the other end of the cable can be coupled to the sliding weight. This can advantageously allow for the chainsaw to be stopped when a bottom end of the sliding weight comes in contact with a solid material such as the ground surface For a chainsaw 208 that is electricity powered, a switch 223 button (which can be an electric switch) can be provided on the bottom of the leg post 215 with the switch 223 button facing the ground 501. The switch 223 can be a spring loaded raised button. When the switch 223 button is not touching the ground, the power to the chainsaw and/or chainsaw blade is turned on. When the switch 223 button is pushed in (for e.g., when it touches the ground), the power to the chainsaw is turned off. In one embodiment, the switch 223 is wired such that a live power cord 218 can come in on one side of the switch 223, with the other end of power cord 218 coming out of the switch 223 being attached to the chainsaw 208 so it can be powered with the switch 223 as illustrated, for example, in FIG. 133 through FIG. 137. When the stopping leg 202 is resting on the dirt or ground, the switch button on the bottom on the leg post 215 will be pressed down into the ground 501 with the weight of arm 200 resting on the switch 223 to thereby turn off the chainsaw 208. This can allow the mobile assembly to continue cutting till such time when the stopping leg 202 is raised off the ground 501, and when the switch 223 meets the dirt or the ground 501, the arm will stop descending and the chainsaw will be turned off.

Figures 130, 131, 132:
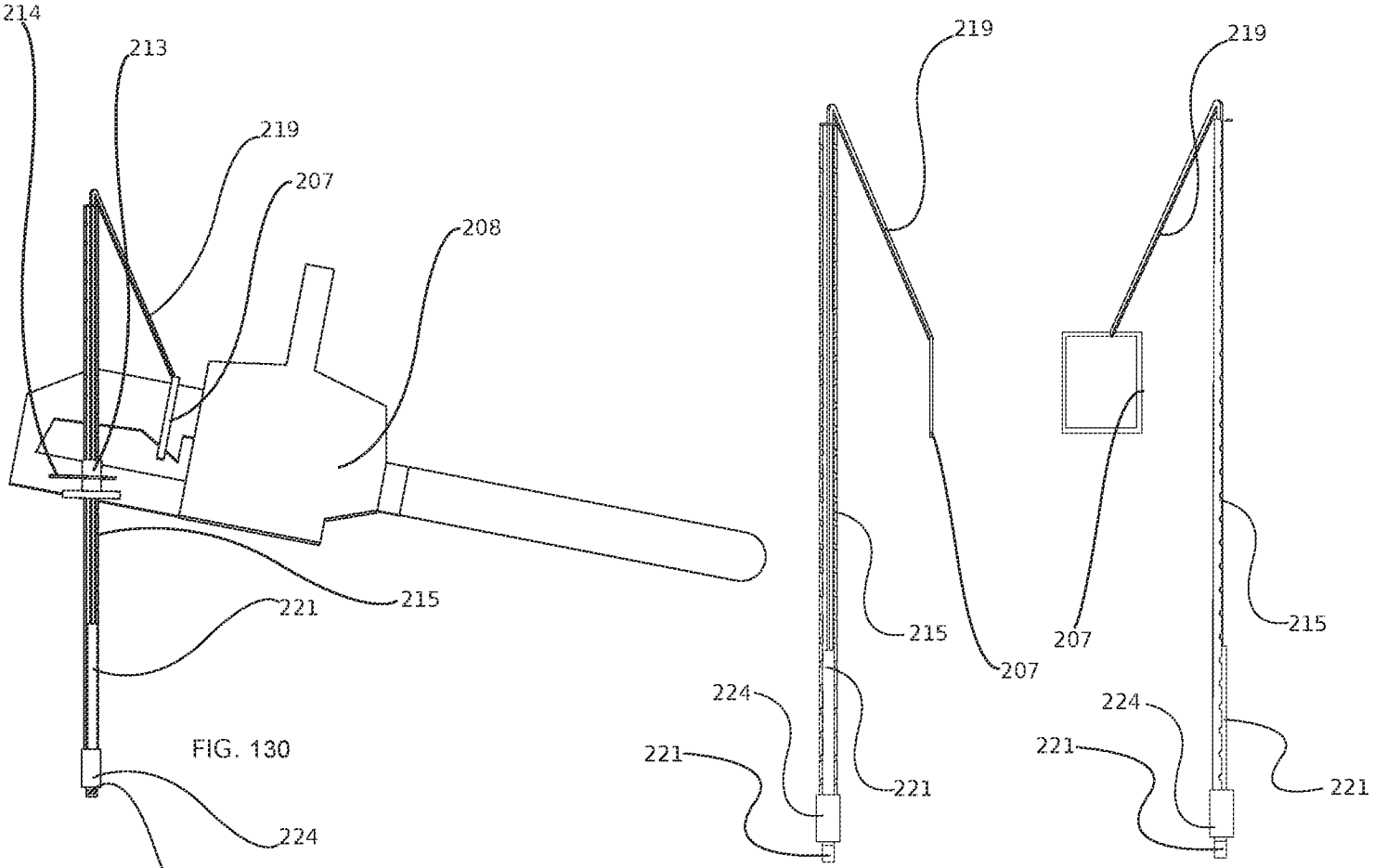
FIG. 130 is a cross section of the leg post 215.
FIG. 131 is a side view of FIG. 130.
FIG. 132 is a front view FIG. 130, according to one or more embodiments of the disclosed subject matter.
Figure 134:
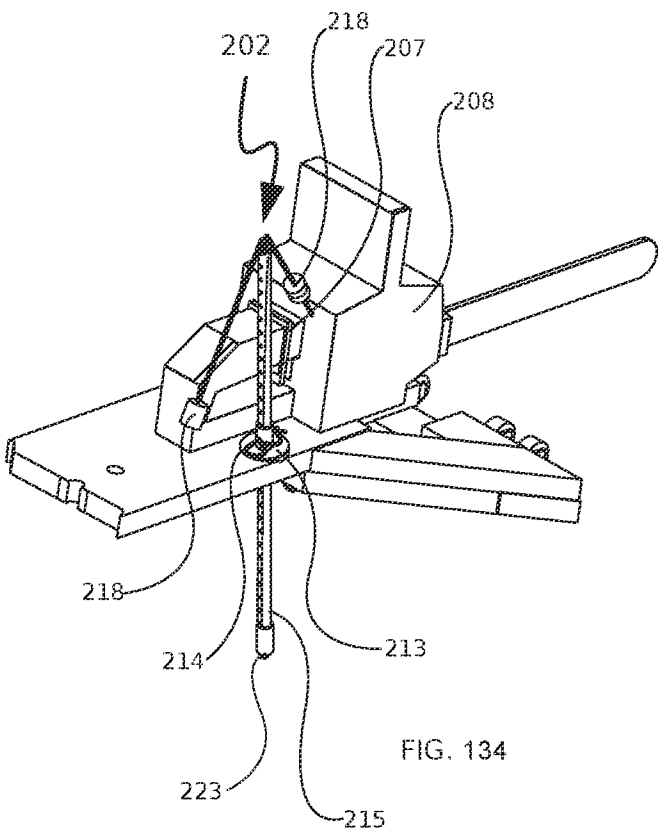
FIG. 134 is a rear bottom view of FIG. 133.
Figure 133:
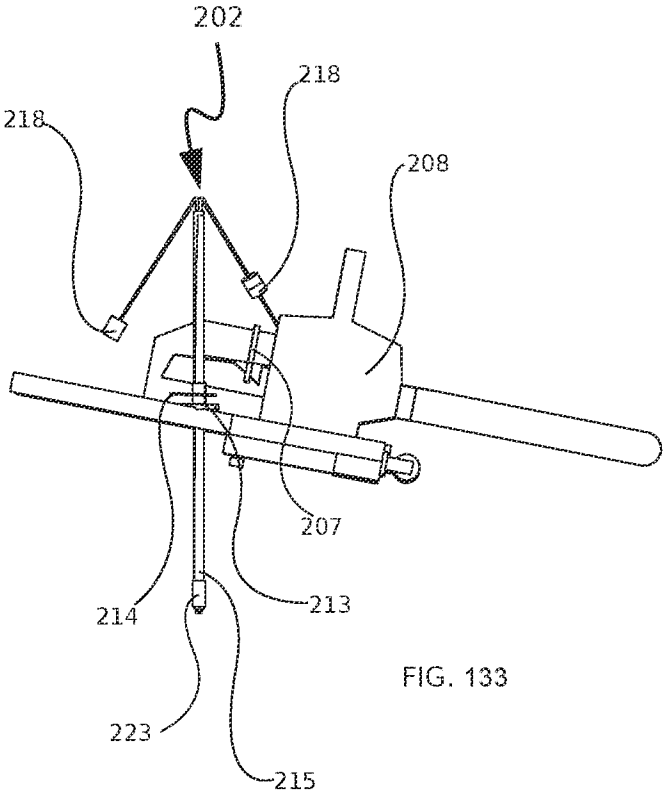
FIG. 133 is a side view of the stopping leg 202 with a switch 223 for an electricity powered chainsaw 208.
Figure 137:
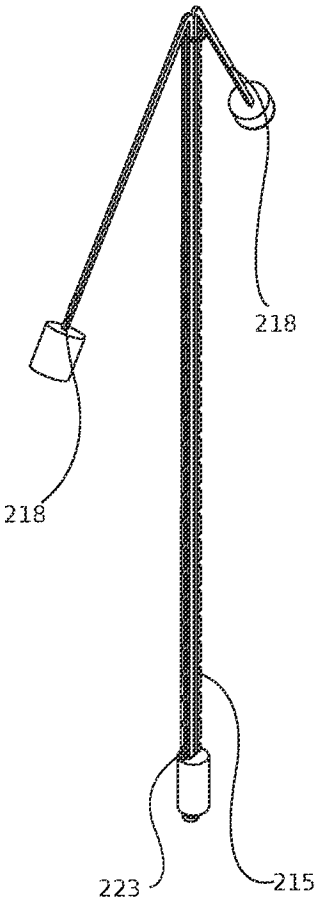
Figure 136:
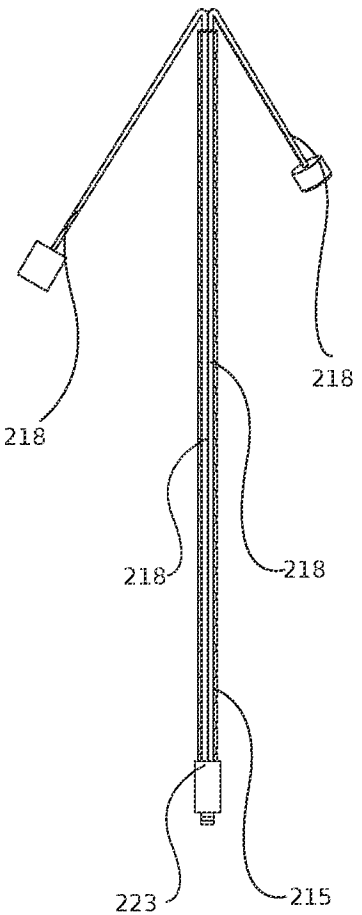
FIG. 136 is a side crosscut of the leg post 215 with power cords 218 running through the inside of the leg post 215; and, FIG. 137 is a perspective view of FIG. 136, according to one or more embodiments of the disclosed subject matter.
Figure 135:
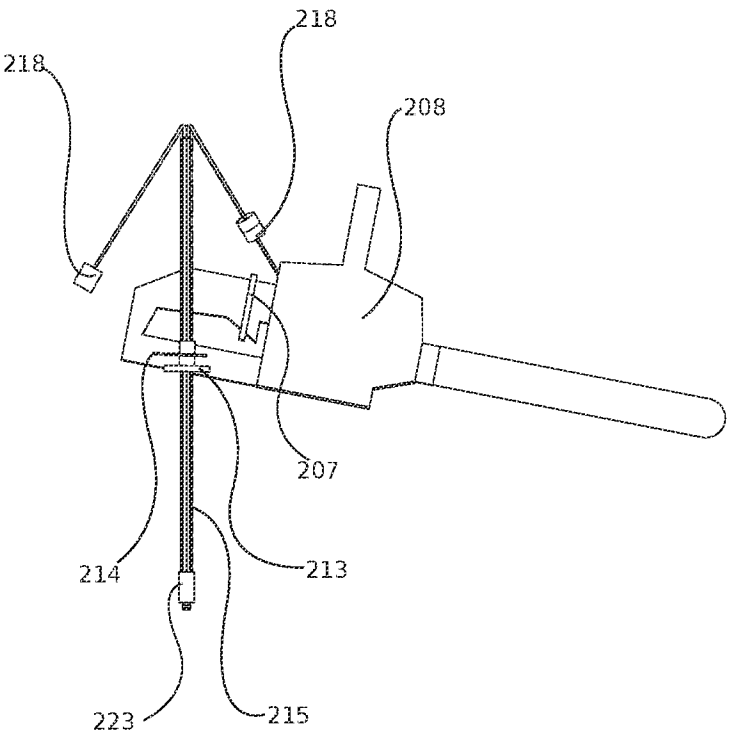
FIG. 135 is a side view of FIG. 133, according to one or more embodiments of the disclosed subject matter.

FIG. 133 is a side view of the stopping leg 202 with a switch 223 for an electricity powered chainsaw 208. The power cord of chainsaw 208 is connected to the switch 223 with the other side of the switch gets plugged into electric power, in one embodiment. The switch 223 can be a popped-out button switch, which is aimed downwards towards the ground, in one embodiment. The switch 223 will turn the chainsaw 208 off when the switch 223 is pressed, and the switch 223 can be configured to allow the chainsaw 208 to run when it is not pressed. The switch 223 button is pushed when the arm 200 is resting on the stopping leg 202. The stopping leg 202 is then resting on the switch 223, which is being pressed into the ground. FIG. 130 is a cross section of the leg post 215 that forms part of the stopping leg 202. Inside the leg post 215, a weight 221 is attached to the cable 219 that comes out the top of the leg post 215 and attaches to a band 207 around the trigger of chainsaw 208. This setup can put tension on the cable 219 if the weight coming out of the bottom of the leg post 215 is not resting on the ground. The tension can then pull the band 207 to pull the trigger and run the blade of chainsaw 208. When the leg post 215 drops down and touches the ground 510, the weight 221 is pushed inside the leg post 215 and releases the tension on the cable 219 and the trigger of chainsaw 208, making it turn off when the leg post 215 is raised above the ground, a stopper 224 can prevent the weight from falling out the bottom.

Additionally, the switch 223 can also be plugged into an indicator light coupled to the chainsaw 208 whereby an operator can be visually informed from far away whether the cut is still in progress or not. The indicator light can be configured to turn off or to change to a different color when the cut is complete. This is only one example of how these options can be implemented, and there are many ways to achieve the same functionality, as a person of skill in the art would readily understand.

It can be advantageous for the electricity powered chainsaw 208 to be provided with a surge protector/breaker with a row of outlets, similar to what is used for protecting computers. The surge protector can include a switch to turn the chainsaw on or off just like a standard surge protector available in the marked, with the surge protector electrically connected to electric power. The chainsaw can be able to kick the breaker on the surge protector if there are issues while the chainsaw is turned on. The surge protector can have an indication light configured to signal the operator whether the chainsaw is on and/or to indicate the breaker has not been kicked. The chainsaw 208 can be directly plugged into the surge protector, or to an optional recycle timer that is plugged into the surge protector.

The recycle timer can allow the saw to run for a set time, stop for a set time, then run again to start they cycle over to provide cool down time if needed. Accordingly, in some embodiments where the chainsaw is electrically operated, the stopping leg can include a chainsaw turn-off switch at a bottom end of the stopping leg for turning off the chainsaw when the turn-off switch comes in contact with a solid material. In some embodiments where the chainsaw is electrically operated, the chainsaw can include a surge protector configured to trip when the draw of power at the chainsaw is greater than a predetermined value. Also, in some embodiments where the chainsaw is electrically operated, the chainsaw can be coupled to a recycle timer configured to cycle the chainsaw between a predetermined turn on and turn-off periods.

Figure 139:
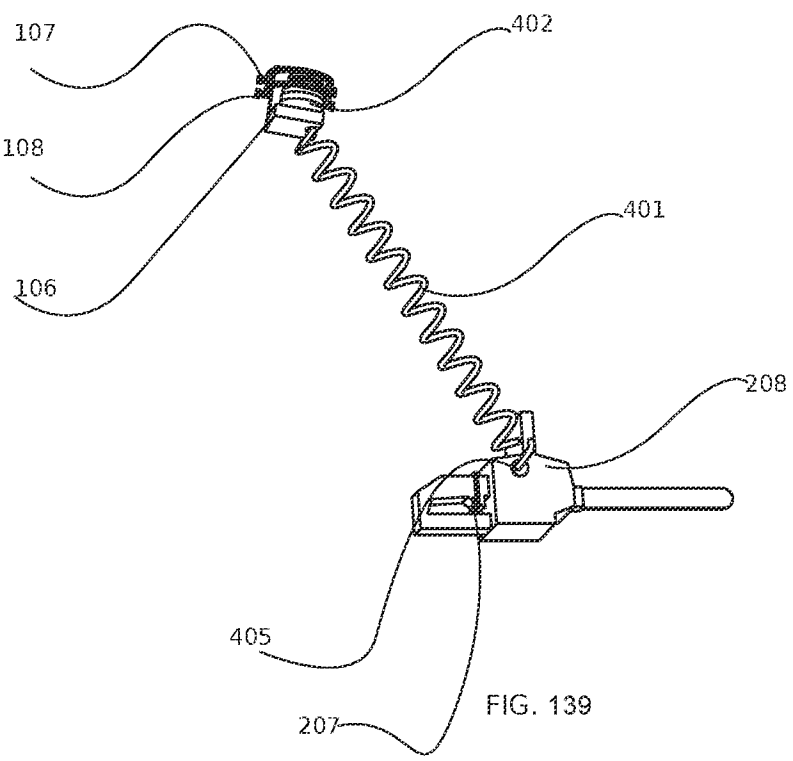
Figure 138:
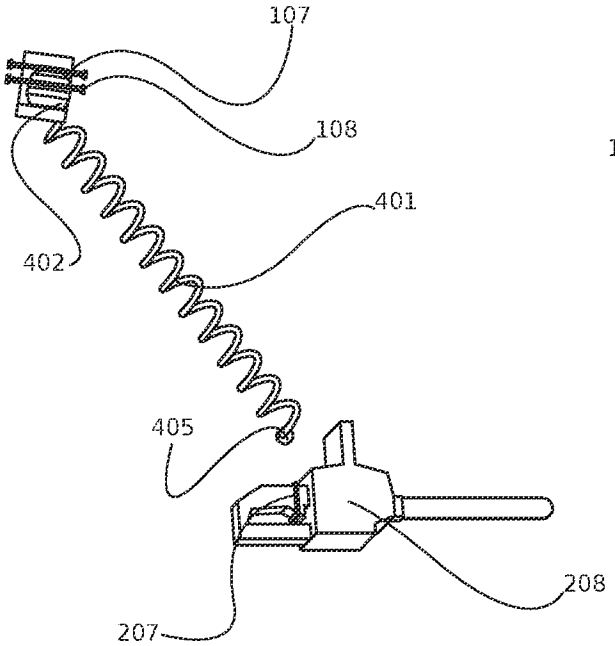
FIG. 138 is a side view of the oil replenishing system 400 associated with the mobile assembly before attaching an oil cap 405 to chainsaw 208; and, FIG. 139 is a side view of the oil replenishing system 400 for the mobile assembly after attaching the oil cap 405 to the chainsaw 208, according to one or more embodiments of the disclosed subject matter.
Figure 141:
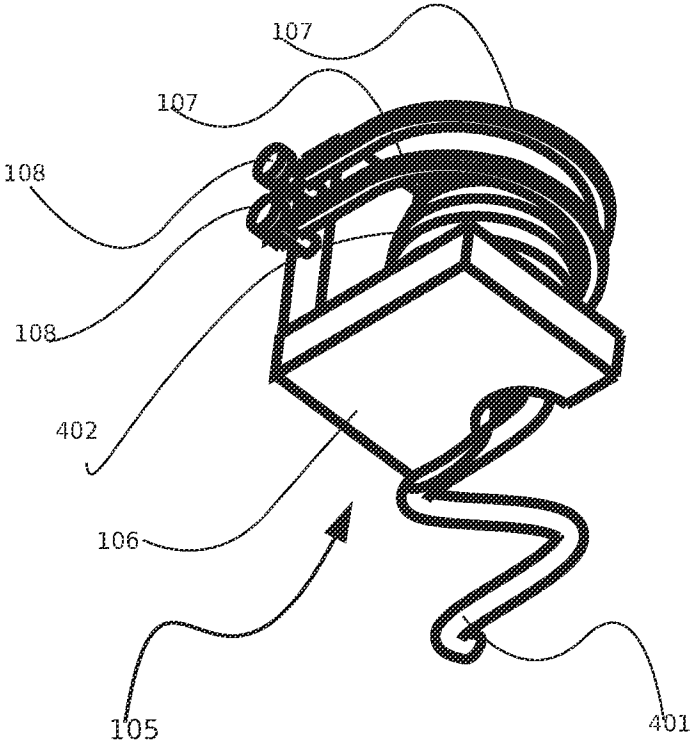
Figure 140:
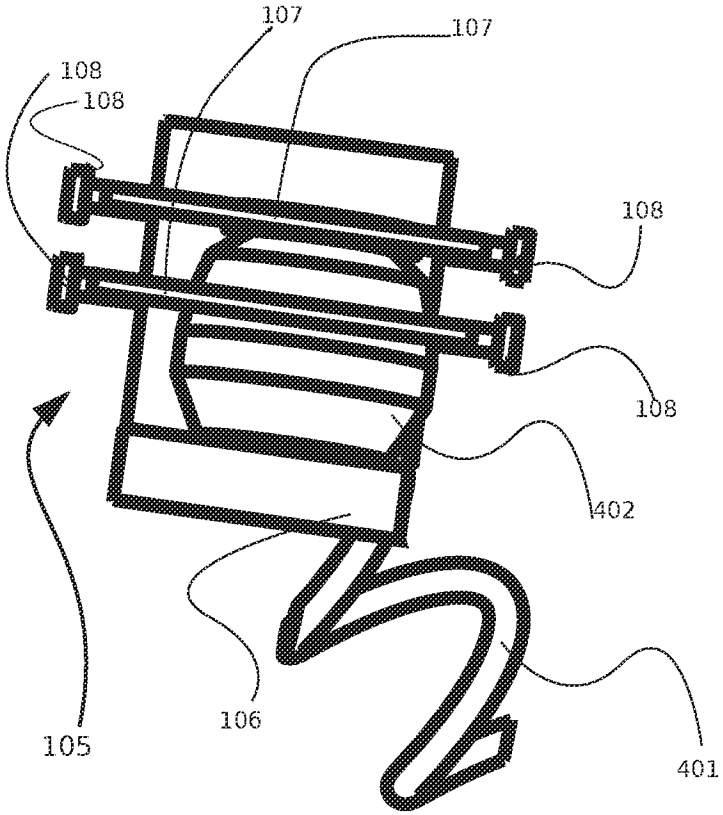
FIG. 140 is a front view of the lubricant reservoir holder 105 with the oil jar 402; and, FIG. 141 is a bottom left view of FIG. 522, according to one or more embodiments of the disclosed subject matter.
Figure 143:
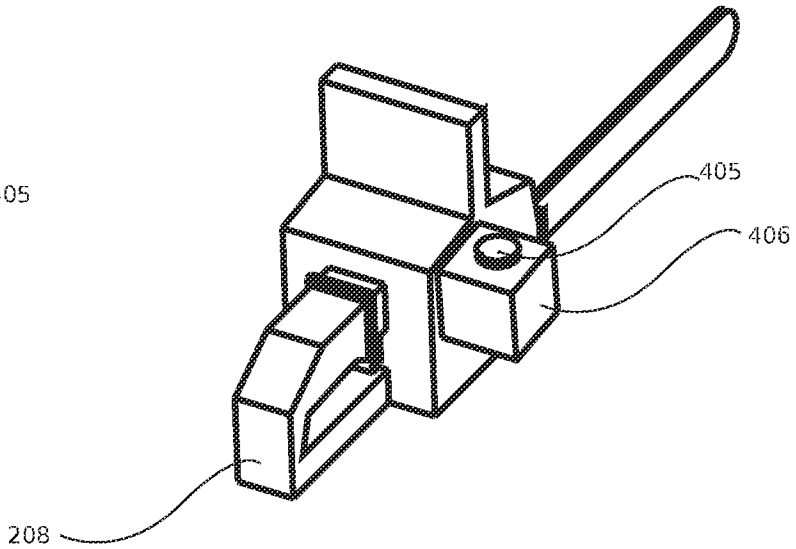

Oil is necessary to ensure that the chainsaw 208 runs properly. Accordingly, in various embodiments, the mobile assembly can provide for a standard oiling system built into the chainsaw 208. FIG. 138 is a side view of the oil replenishing system 400 for the mobile assembly before attaching the oil cap 405 to the chainsaw 208. It consists of an elevated oil jar 402 that is connected to one end of a hose 401. The other end of the hose 401 is connected into the oil cap 405 that screws into the oil reservoir of chainsaw 208. FIG. 139 is a side view of the oil replenishing system 400 for the mobile assembly after attaching the oil cap 405 to the chainsaw 208. It consists of an elevated oil jar 402 that is connected to one end of a hose 401. The other end of the hose 401 is connected into the oil cap 405 that screws into the oil reservoir of chainsaw 208. FIG. 140 is a front view of the lubricant reservoir holder 105 with the oil jar 402. It shows how the oil jar 402 is held on with two bands 107 connected on four pegs 108 attached to the oil jar stand 106. The oil jar stand 106 can include a cutout in the bottom so the oil jar will not fall and the hose can come out of the bottom of the oil jar stand 106 to the chainsaw 208. FIG. 143 shows a chainsaw 208 with an extended oil tank 406 after screwing it into the oil tank of the chainsaw. Oil will fill both the saw and the extended tank by opening the oil cap 405.

Oil systems as described herein can advantageously extend the capacity of the amount of oil the chainsaw 208 holds so the user may not have to keep refilling the oil reservoir on the chainsaw 208. A first oiling system as illustrated in FIG. 139 is a gravity fed system where an oil jar 402 sits elevated above the chainsaw 208 and has one side of a hose 401 attached into the bottom of the oil jar 402. The hose 401 protrudes upwards about one inch into the oil jar 402 so that settled contaminants in the oil will not feed into the chainsaw 208. The other end of the hose 401 is attached into the oil cap 405 screwed onto the chainsaw 208.

Figure 142:
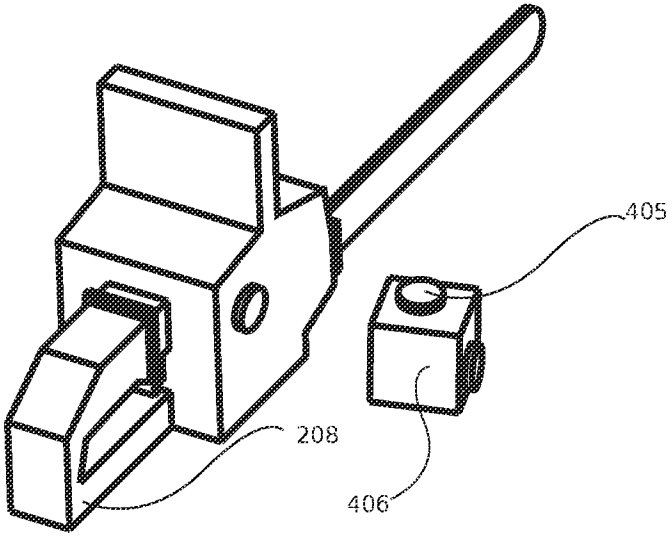
FIG. 142 is a top perspective view of a chainsaw 208 with an extended oil tank 406 before the extended oil tank is screwed into or onto the oil tank of chainsaw 208; and, FIG. 143 shows a chainsaw 208 with the extended oil tank 406 screwed into the oil tank of the chainsaw, according to one or more embodiments of the disclosed subject matter.
Figure 145:
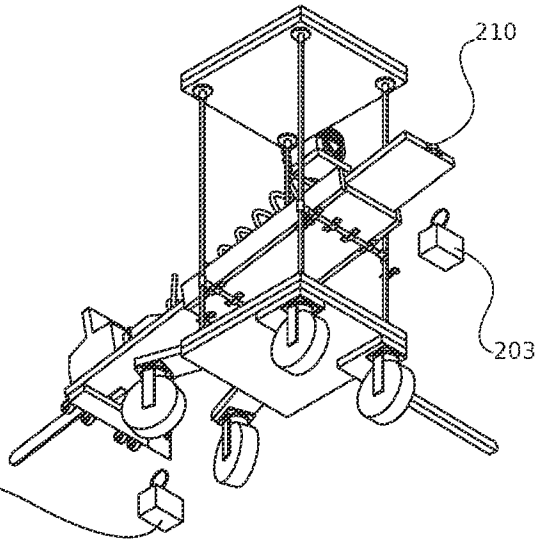
FIG. 145 is a perspective view of FIG. 144.

This can allow the oil tank of chainsaw 208 to automatically be refilled from the oil jar 402 by mimicking how an IV bag is used at a hospital. Another option is to include an extended oil tank 406 screwing directly onto the oil tank of the chainsaw, as shown in FIG. 142 and FIG. 143. Accordingly, in various embodiments, the assembly can further include an oil jar for lubricating an endless chain of the chainsaw. The assembly of claim 1, further comprising a reservoir to hold a lubricant for lubricating the chainsaw, wherein the reservoir is in fluid communication with a lubricant receiving opening of the chainsaw. The assembly of claim 1, further comprising a lubricant tank that attached to a lubricant receiving opening of the chainsaw.

Figure 144:
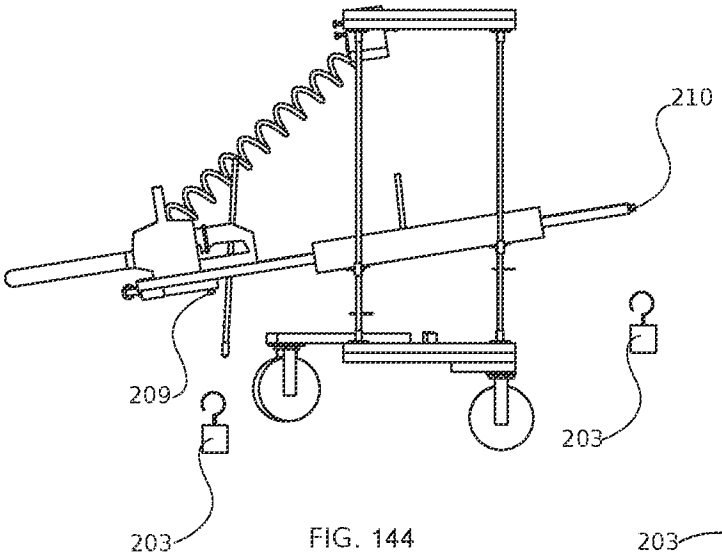
FIG. 144 is a side view of the device with counterweights 203 shown below the front counterweight brace 209 and the rear counterweight brace 210.
Figure 147:
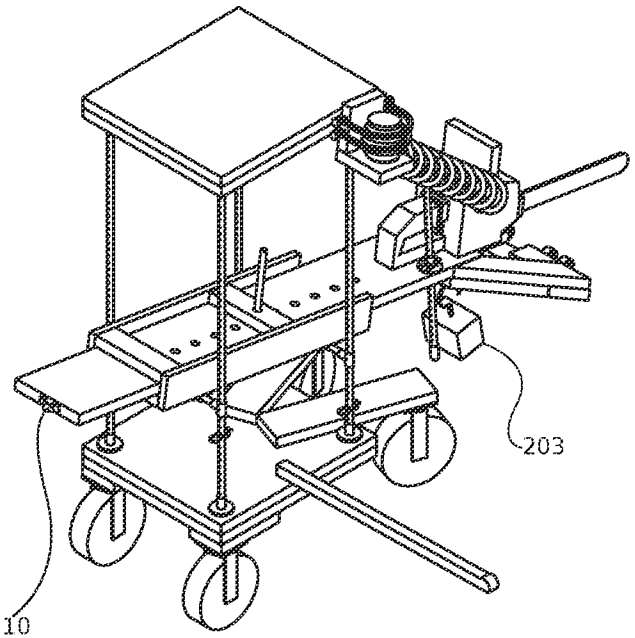
FIG. 147 is a perspective view of FIG. 148.
Figure 146:
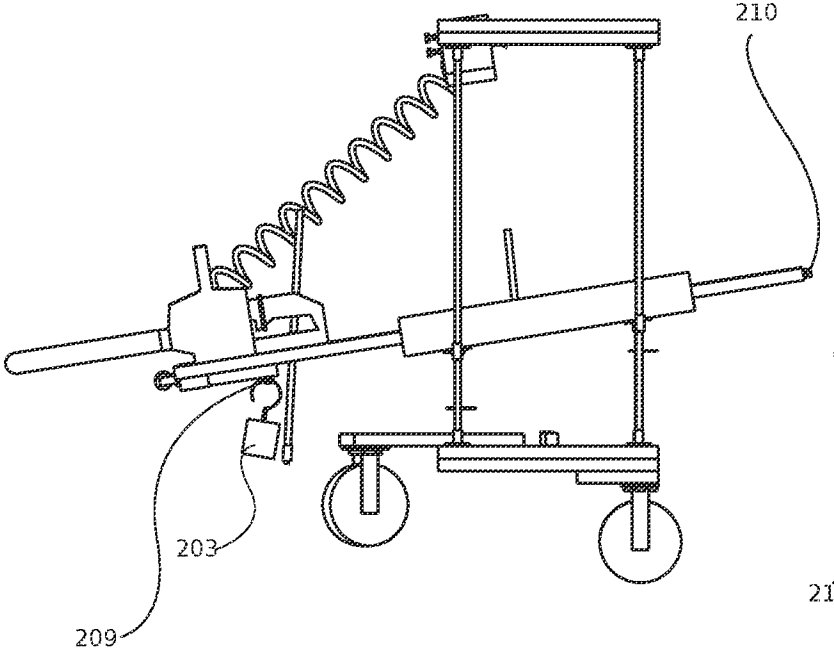
FIG. 146 is a side view of the device with a counterweight 203 on the front counterweight brace 209.
Figure 149:
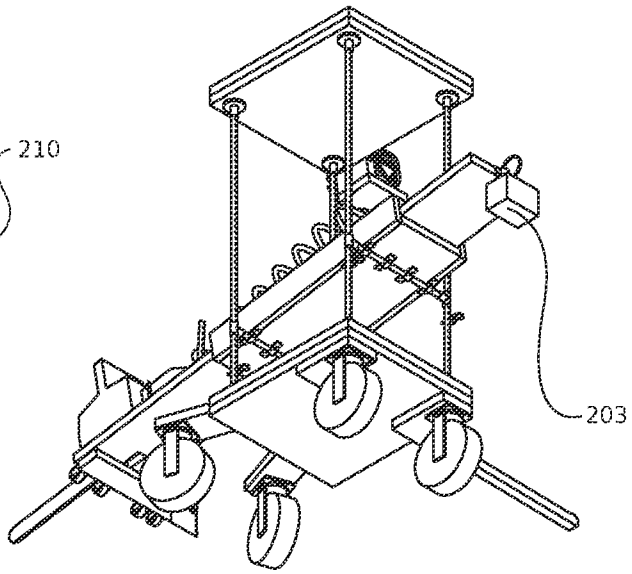
FIG. 149 is a bottom perspective view of FIG. 148, according to one or more embodiments of the disclosed subject matter.
Figure 148:
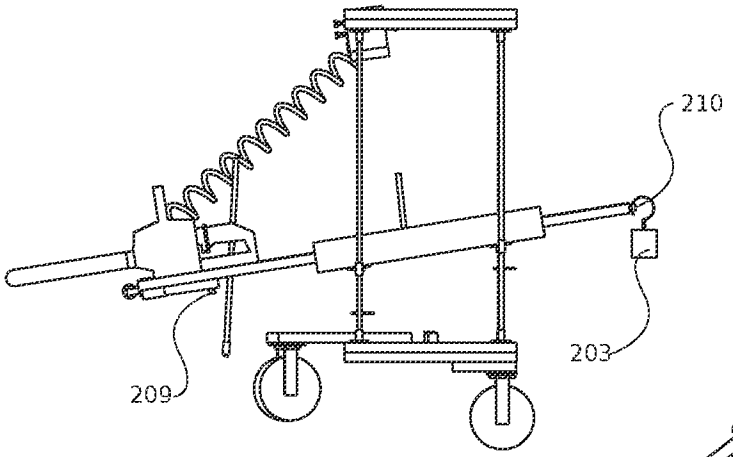
FIG. 148 is a side view of the device with a counterweight 203 on the rear counterweight brace 210.

It can be advantageous to adjust the pressure applied by the blade of chainsaw 208 on the article or material being cut when cutting through different types of wood, thicknesses, and to compensate for the sharpness of the blade of chainsaw 208. One way this can be achieved is by using one or more counterweights 203 as illustrated in FIG. 144 through FIG. 149. A rear counterweight brace 210 can be attached at the rear bottom end of the arm 200. A front counterweight brace 209 can be attached in the front of the arm 200. FIG. 144 is a bottom perspective view of the device with counterweights 203 below the front counterweight brace 209 and the rear counterweight brace 210 where the counterweights 203 can attach. Counterweights 203 shown in FIGS. 146 and 147 can be added to the front counterweight brace 209 at the front and to add additional pressure to the blade. Additional pressure can help in circumstances such as the blade of chainsaw 208 is bouncing up and down, or when the blade is not digging in enough. Counterweights 203 added to the rear counterweight brace 210 at the back as shown in FIGS. 148 and 149 can be used to reduce pressure from the blade when it is digging in too much. Accordingly, in various embodiments, the assembly can include counterweights positioned near a distal end of the arm for increasing a force applied by a chainsaw blade against the article being cut. Similarly, in various embodiments, the assembly can also include counterweights positioned near a proximal end of the arm for reducing a force applied by a chainsaw blade against the article being cut.

The assembly can further include strategically positioned cameras to capture progress of the wood-cutting operation. The cameras can be configured to record the progress of a log cutting operation and assist in moving the device (i.e., the mobile assembly 100) around through the use of a controller or computing device remotely controlling the device. Provisions can be provided to store or record the camera footage. Further, in various embodiments, the assembly can be self-powered, with the assembly including a wireless transceiver. The assembly can accordingly be configured to be moved from a first location to a second location via a remote control mechanism.

Figure 150:
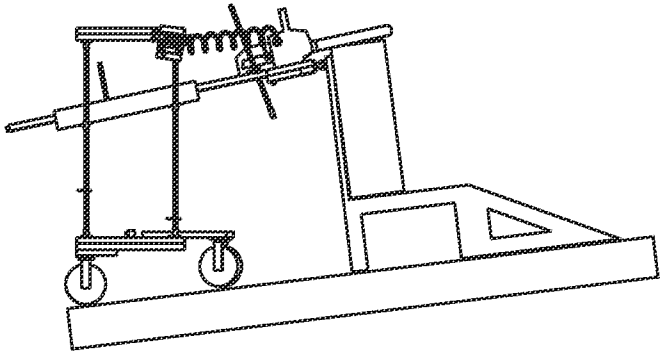
FIG. 150 is a side view of a material 503 being split using the log stand 506.

The assembly can further include a log stand for mounting a log to facilitate splitting of the log. The log stand 506 can have many uses to assist in cutting a tree. When using the log stand 506, the chainsaw 208 is able to make more precise cuts since the material 503 is on a stable surface and the arm 200. Casters 211 are able to move smoothly down the flat surface of log stand 506. FIG. 150 is a side view of a material 503 being split using the log stand 506. The blade of chainsaw 208 is at the top of the material 503 before the cut starts. The mobile assembly is turned on in this position. The picture of the material 503 is a cross cut view to show the blade of chainsaw 208 as it cuts through center of the material 503.

In at least one embodiment, the assembly as provided herein can be operated as follows. The assembly can be used to cut trees or materials that a chainsaw can cut through while reducing the amount of work required by a user with the automation of the cut. Embodiments of the presently disclosed subject matter can allow the user to cut trees in place on the ground by using an arm that can reach or slide out to the tree and has a chainsaw 208 attached on the end. The assembly can be setup by sliding the arm 200 out till only the blade of chainsaw 208 is directly above the tree, and the blade allowed to contact the top the tree. The arm can then drop down while the blade is running and create a cut in the projected path that was set by the user. The user can choose for the cut to be made in a straight downwards line, an arch shaped cut, or a combination of the two to create the desired cut. In various embodiments, the saw cut path can match the profile of the tree being cut. Some additional aspects of the assembly 100 will now be described in further detail.

Figure 21:
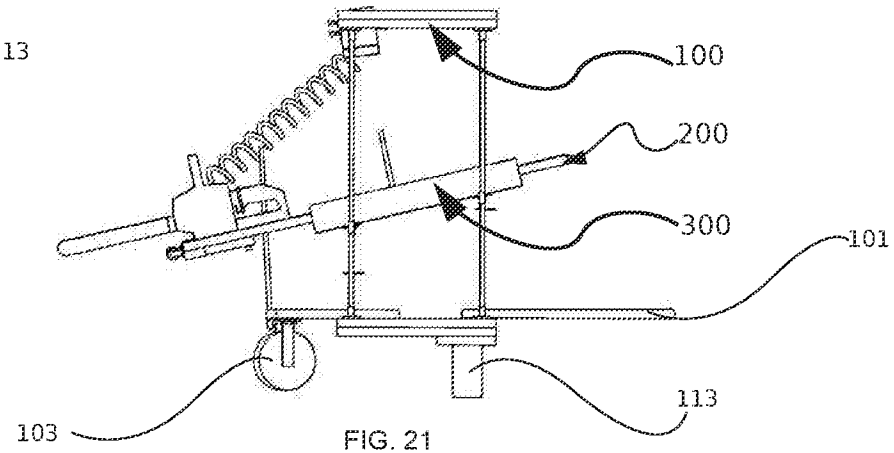
FIG. 21 is a right view.
Figure 20:
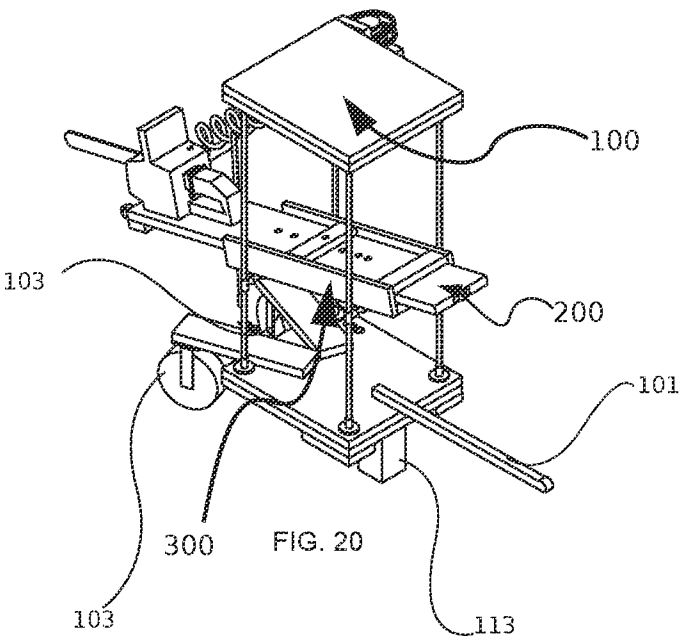
FIG. 20 is a top perspective view.
Figure 23:
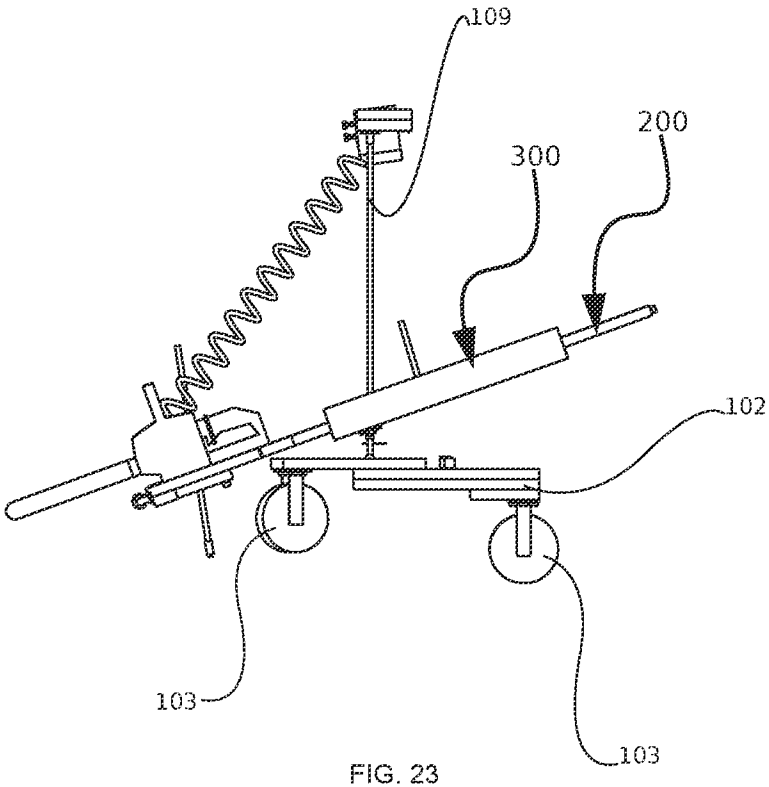
FIG. 23 is a right side view of the stand associated with mobile assembly with only one post 109, according to one or more embodiments of the disclosed subject matter.
Figures 25, 26, 27, 28:
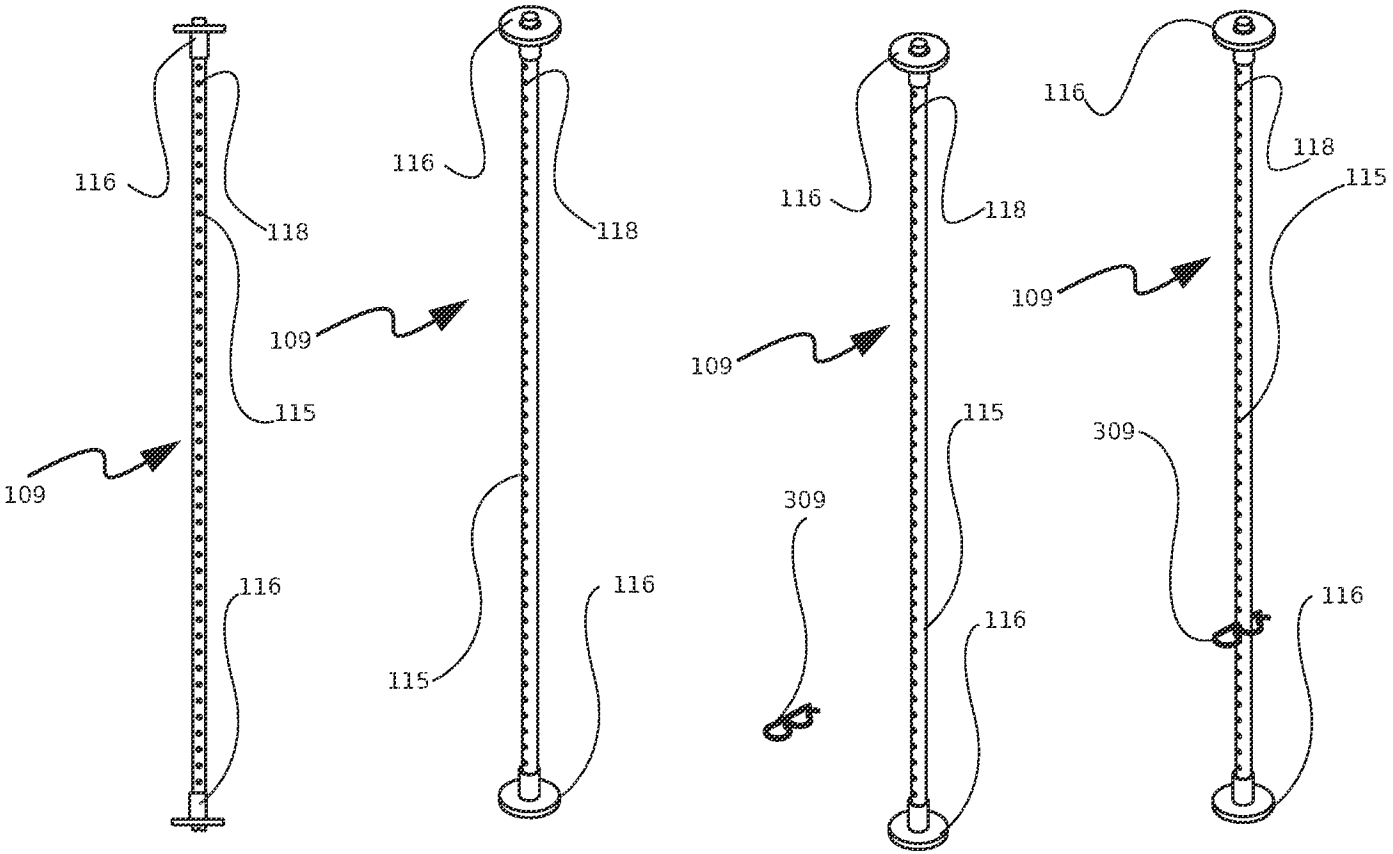
FIG. 25 is a front view of post 109.
FIG. 26, FIG. 27 and FIG. 28 are perspective views of post 109, according to one or more embodiments of the disclosed subject matter.

The mobile assembly 100 shown in FIGS. 11 to 24 includes the frame 300. The mobile assembly 100 allows the frame 300 to slide up and down the posts 109 freely unless is purposefully set to stop at a specific point by using post hitch pins 307. To assist with mobility, the mobile assembly can include four casters or wheels 103 and a hitch 101. The frame 300 can also have handles to assist in moving it around. There can be any number of wheels 103 on the assembly. Also, wheels 103 can be substituted for legs 113 as shown in the example FIGS. 20 through 22. FIG. 23 is a right view of the of the stand associated with mobile assembly with only one post 109, according to one or more embodiments of the disclosed subject matter.

Figure 14:
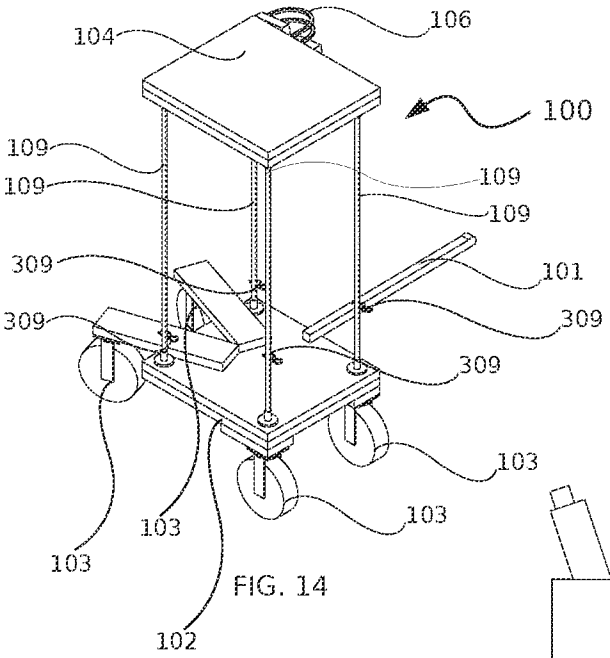
FIG. 14 is a top perspective view.
Figure 19:
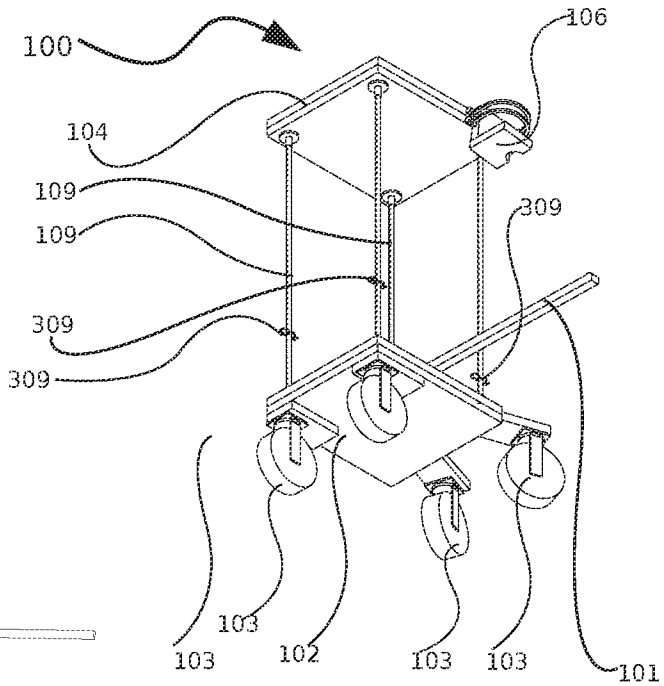
FIG. 19 is a bottom perspective view.
Figure 18:
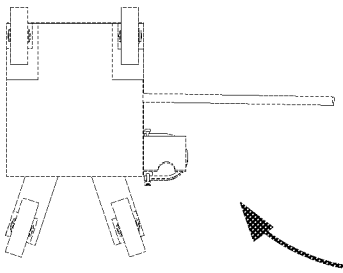
FIG. 18 is a bottom view corresponding to the stand of FIG. 11, according to one or more embodiments of the disclosed subject matter.
Figure 17:
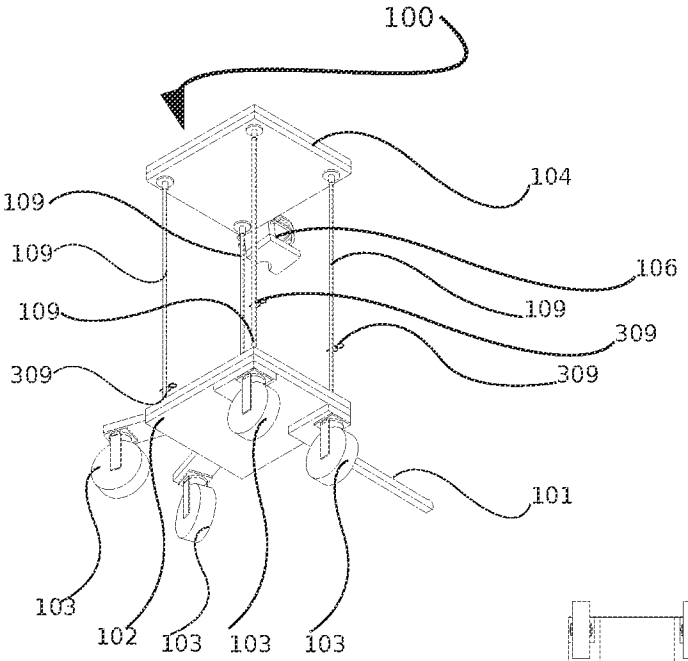
FIG. 17 is a bottom perspective view.
Figure 24:
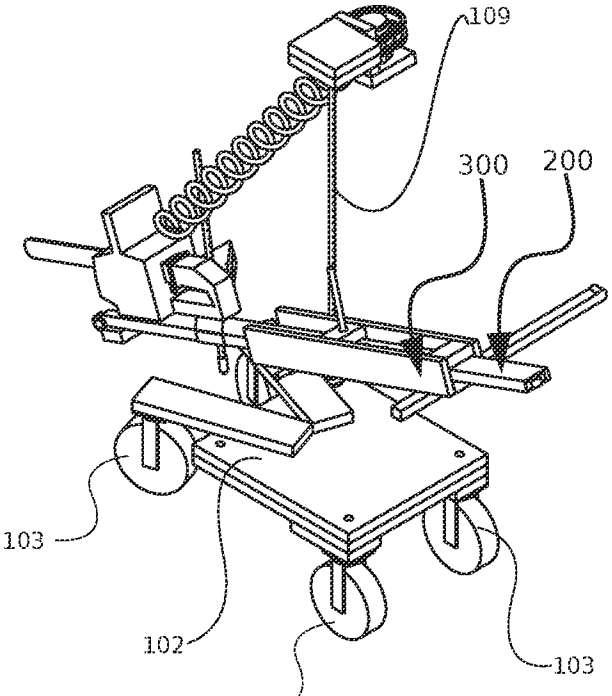
FIG. 24 is a top perspective view of the stand associated with mobile assembly with only one post 109, according to one or more embodiments of the disclosed subject matter.

In some embodiments, the wheels 103 can include brakes to lock the wheels. This feature is not the main functionality of the device and can be skipped by placing the base 102 on the ground. The posts 109 assist with adjusting the height of the frame 300, which holds the arm 200. In one embodiment, four posts 109 were used as shown in FIG. 14, but any number of posts 109 can be used to build the mobile assembly. A one post 109 variation is shown in FIGS. 23 through 24. In an alternate embodiment, lines of jacks can be used to adjust the height with or without posts 109. With no posts provided in such an embodiment, the chainsaw will pivot about a raised base that has been jacked up off the ground.

Figure 32:
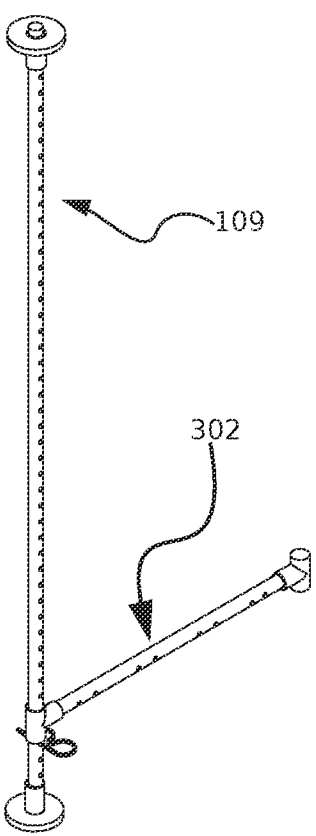
Figure 31:
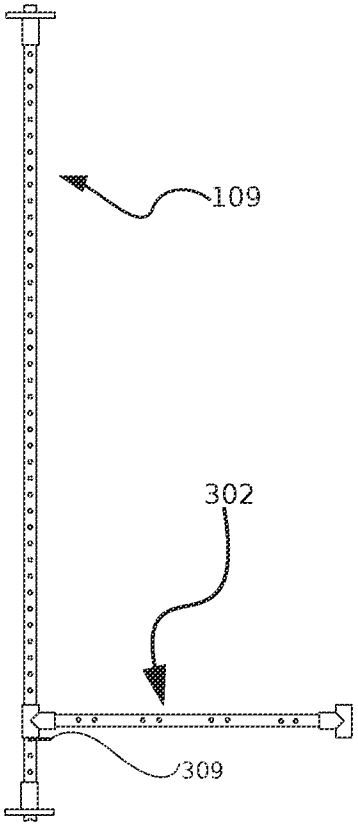
FIG. 31 is a front view of post 109 with a front first post hitch pin 309 inserted in one of the pin holes 118 at the bottom of the post 109; and, FIG. 32 is a perspective view corresponding to FIG. 31, according to one or more embodiments of the disclosed subject matter.
Figure 30:
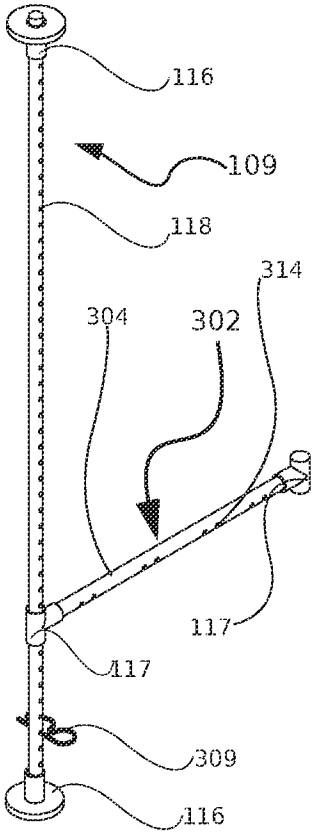
FIG. 30 is a perspective view corresponding to FIG. 29, according to one or more embodiments of the disclosed subject matter.

The sliding lateral bar 302 can consist of a pipe 304 having a tee 303 mounted in place on each end, in one embodiment. The tees in pipe form go around the posts 109 and can slide up and down the post 109 freely. In FIGS. 29 and 30, the sliding lateral bar 302 is shown elevated about a half foot above the front first post hitch pin 309. In FIGS. 31 and 32, the sliding lateral bar 302 is shown resting on the front first post hitch pin 309 after the sliding pipe slide down from the previous two figures. FIG. 31 is a front view of post 109 with a front first post hitch pin 309 inserted in one of the pin holes 118 at the bottom of the post 109. Additionally, there is a sliding lateral bar 302 around the post 109 stopped and resting on the post hitch pin 307. This is the result of the pipe freely sliding down the post 109 from the previous two figures.

Figure 34:
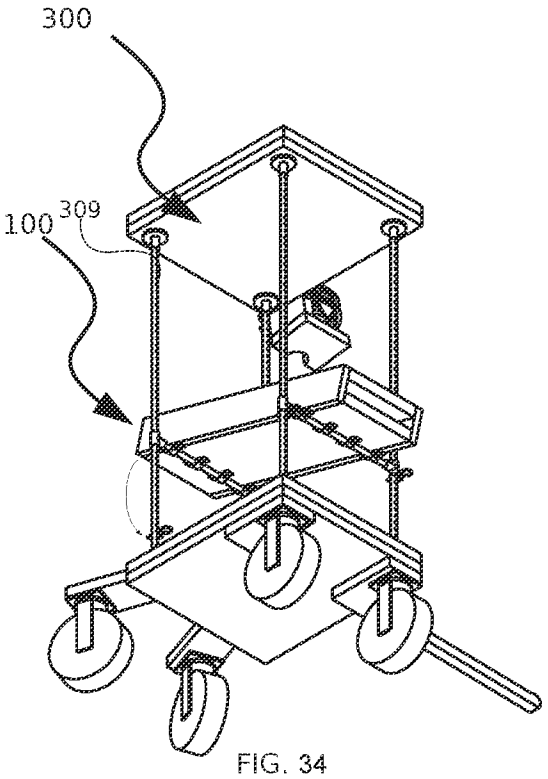
Figure 33:
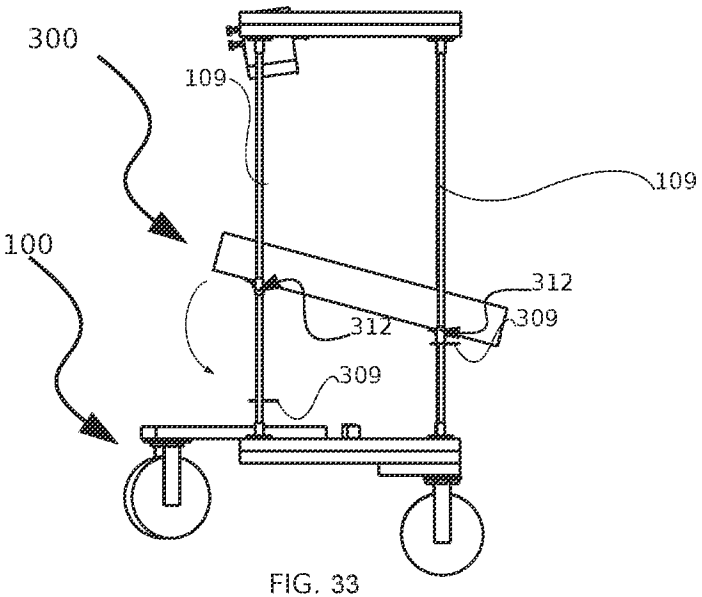
FIG. 33 is a side view of the front of the frame 300 before it swings down and comes to a stop on the front first post hitch pin 309; and, FIG. 34 is a perspective view corresponding to FIG. 33, according to one or more embodiments of the disclosed subject matter.
Figure 36:
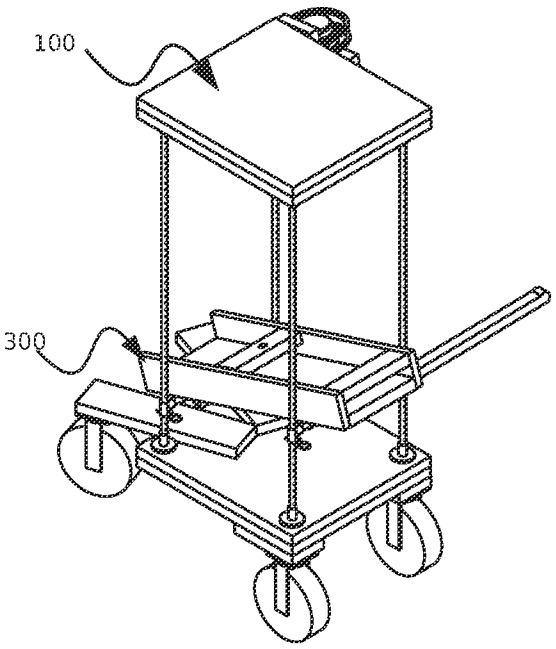
Figure 35:
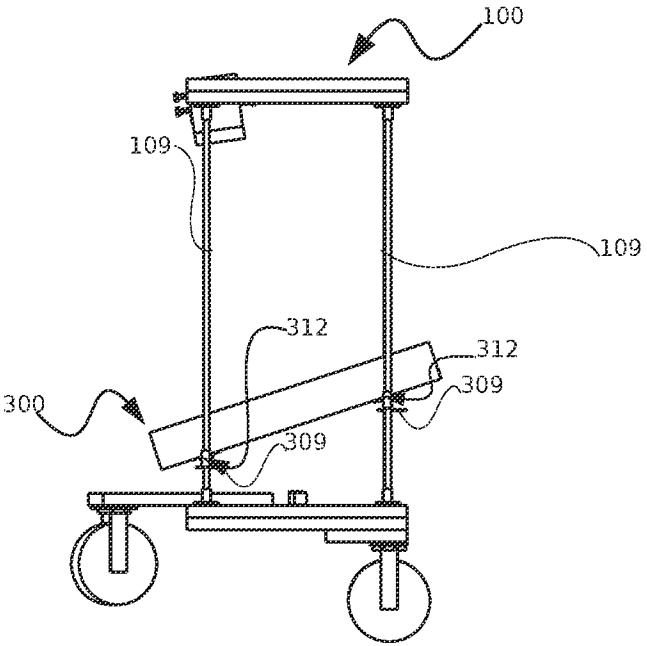
FIG. 35 is a side view of the front of the frame 300 after it swings down and comes to a stop on the front first post hitch pin 309; and, FIG. 36 is a perspective view corresponding to FIG. 35, according to one or more embodiments of the disclosed subject matter.
Figure 38:
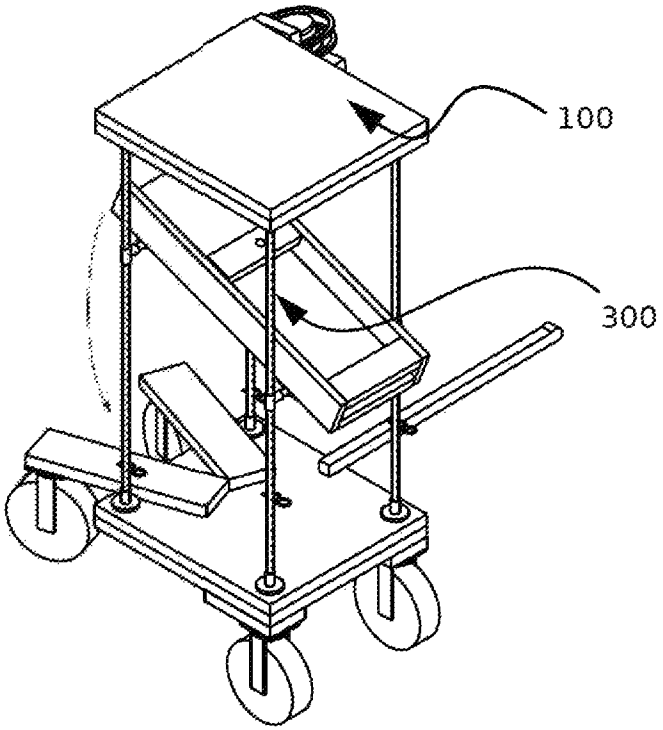
Figure 37:
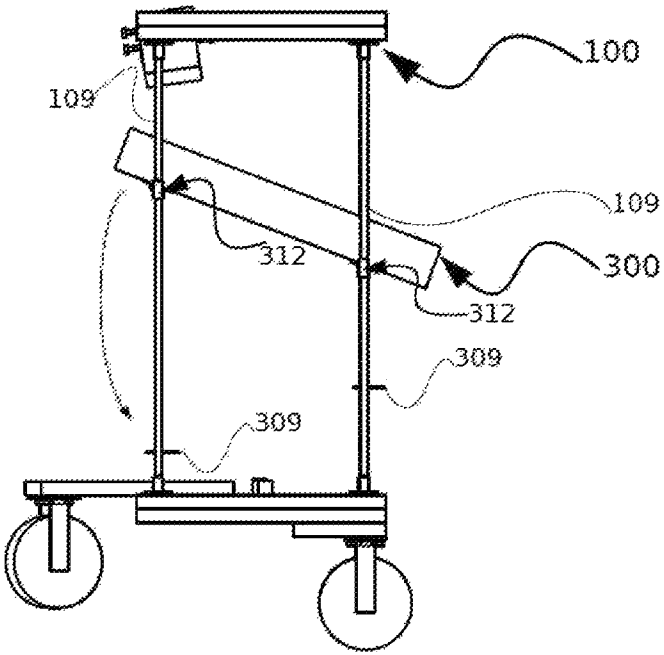
FIG. 37 is a side view of the frame raised above the post hitch pins 309 in both the front and the rear, with the front of the frame aiming upwards about 45 degrees; and, FIG. 38 is a perspective view corresponding to FIG. 37, according to one or more embodiments of the disclosed subject matter.
Figure 40:
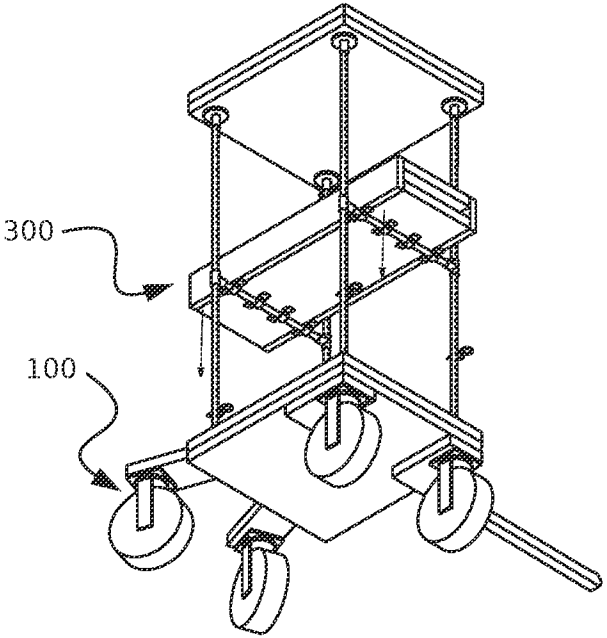
Figure 39:
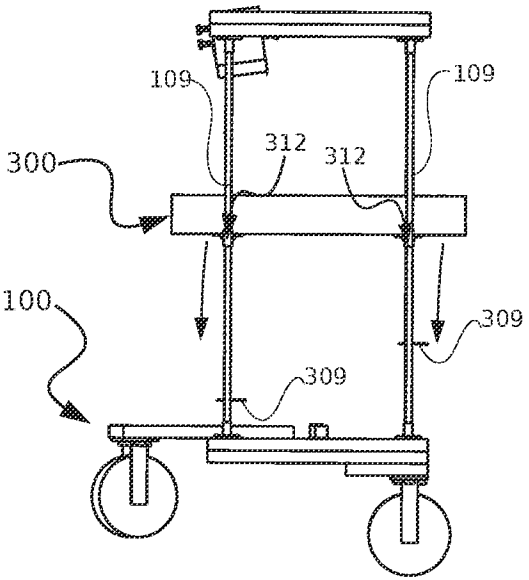
FIG. 39 is a side view of the frame 300 after the front partially drops down from its position in FIG. 37 with both the front and the rear now approximately about level and elevated above the post hitch pins 309; and, FIG. 40 is a perspective view corresponding to FIG. 39, according to one or more embodiments of the disclosed subject matter.
Figure 42:
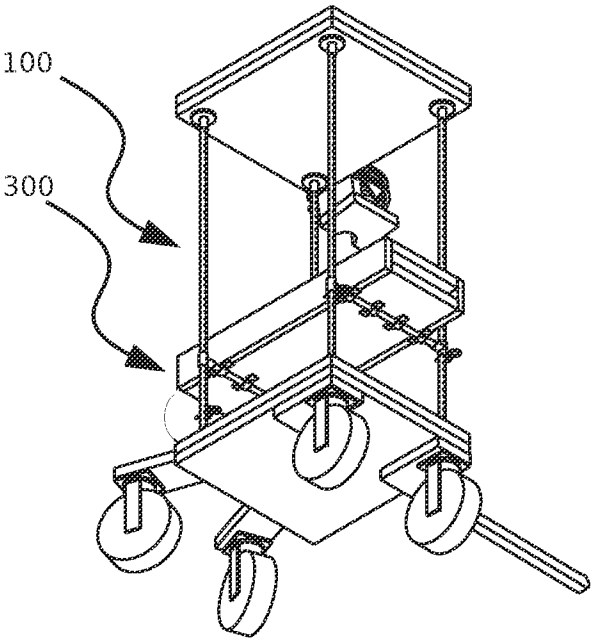

FIGS. 33 to 36 show the functionality behind the arch cut created by a hinge motion made with the frame 300, sliding lateral bar 302, and mobile assembly 100. The rear sliding lateral bar 302 can mimic the pin of a hinge and is located between the rear bottom of the base of frame 300 and the front braces 312, which loosely cup the rear sliding lateral bar 302. The rear post hitch pins 307 can determine the height of the pivoting point as the rear sliding lateral bar 302 will rest on it and stay stationary. The front sliding lateral bar 302 is located between the front bottom of the base of frame 300 and the front braces 312, which loosely cup the front sliding lateral bar 302 similarly to the rear. The only difference is that the front of the frame 300 can be raised far above the front post hitch pins 307 as seen in FIG. 33 and FIG. 34, and the frame 300 can drop down in the direction shown with the arrow. The front of the frame 300 will then drop down in a hinge like motion until it rest on the front first post hitch pins 309 where the hinge motion is complete and is shown in FIG. 34.

Figure 41:
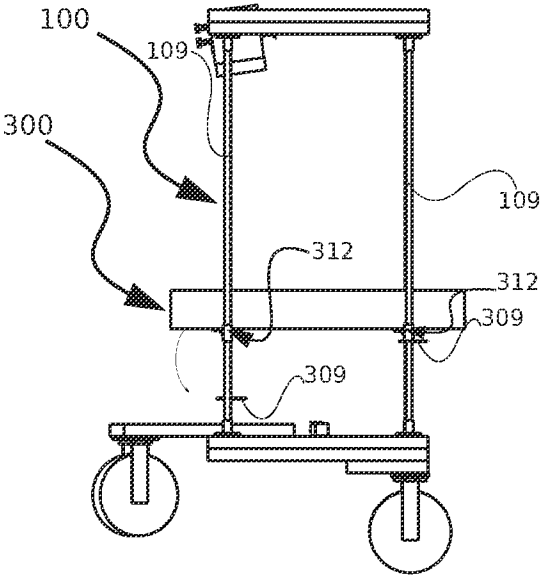
FIG. 41 is a right-side view of the frame 300 after the front and rear partially drop down from the position in FIG. 39 with both the front and rear of the frame 300 about level, with the rear of the frame 300 resting on the post hitch pins 307; and, FIG. 42 is a perspective view corresponding to FIG. 41, according to one or more embodiments of the disclosed subject matter.
Figure 44:
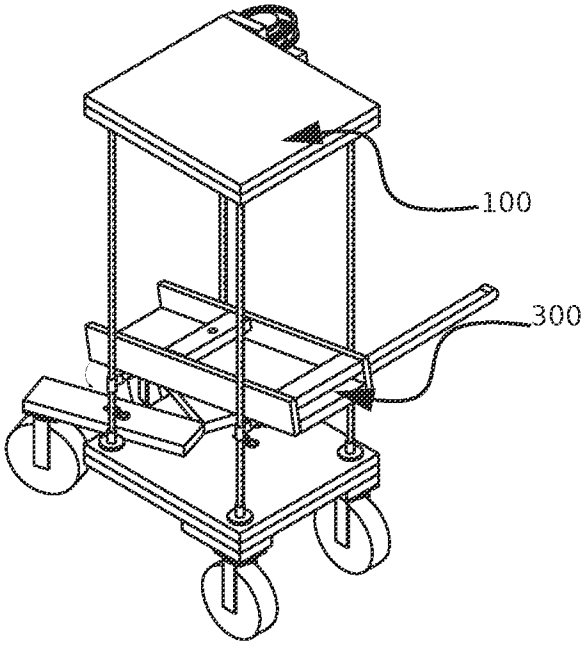

FIGS. 37 to 46 demonstrate a combination of a hinge motion and a drop motion as times passes during the drop. Initially the frame 300 is raised above the post hitch pins 309 in both the front and the rear, with the front aiming upwards about 45 degrees FIGS. 37-38. Next, the front of the frame 300 will partially drop down. Both the front and the rear of the frame 300 are about level. The front and rear are both elevated above the post hitch pins 309 FIGS. 39-40. Next, the frame 300 will partially drop down in the front and rear until both the front and the rear are about level. There can be some upwards or downwards swing in the frame 300 as it drops down to help cut through different parts of different materials when the mobile assembly is being used. The rear sliding lateral bars 302 will come to a stop and rest on the rear post hitch pins 309, while the front of the frame 300 is still elevated above the post hitch pins 309 shown in FIG. 41 and FIG. 42. FIG. 41 is a right-side view of the frame 300 after the front and rear partially drop down from the previous position in FIG. 39. When the arm 200 is inserted, the arm can swing up or down some to help cut through different parts of different materials. So, the frame 300 can stay level, tilt to the rear, or tilt to the front as it drops down. In FIG. 41, both the front and the rear of the frame 300 are about level. The rear of the frame 300 is resting on the post hitch pins 309, and the front is elevated above the post hitch pins 309.

Figure 43:
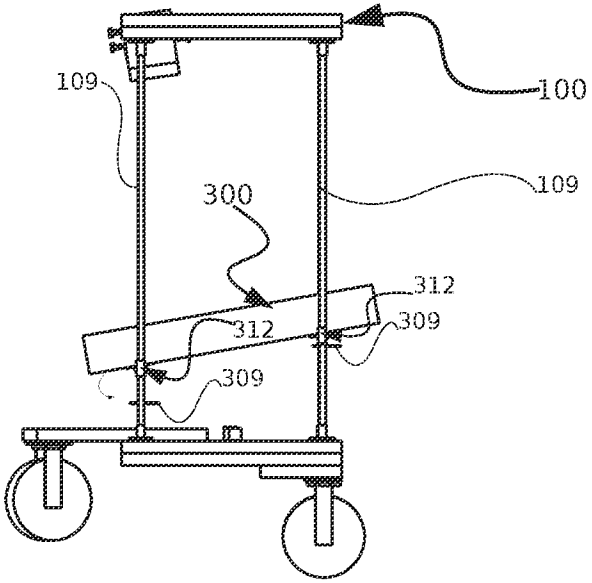
FIG. 43 is a right-side view of the frame 300 after the front of the frame drops partially down from the previous position FIG. 41; and, FIG. 44 is a perspective view corresponding to FIG. 43, according to one or more embodiments of the disclosed subject matter.
Figure 46:
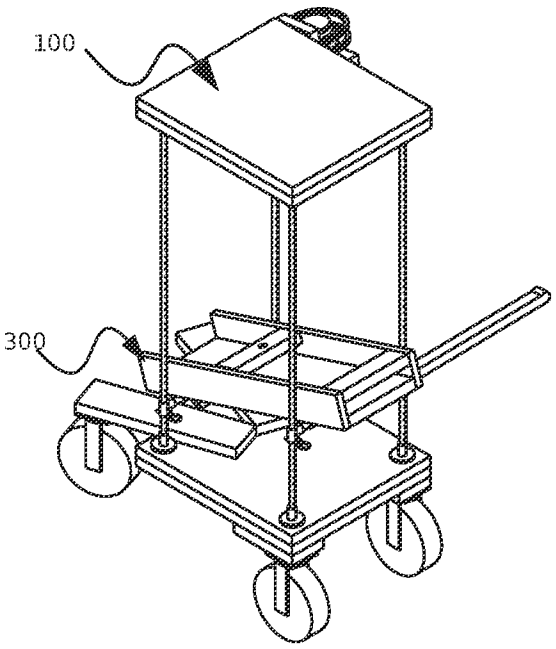
Figure 45:
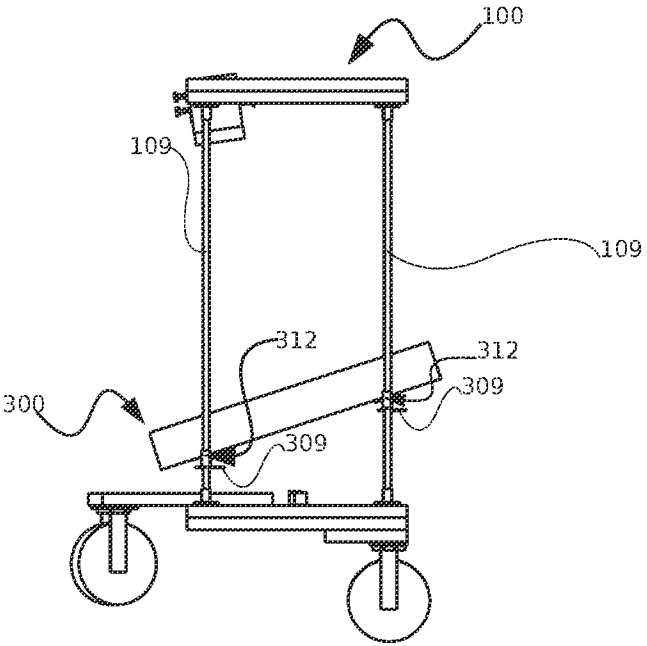
FIG. 45 is a side view of the frame 300 after the front of the frame drops partially down from the previous position FIG. 43; and, FIG. 46 is a perspective view corresponding to FIG. 45, according to one or more embodiments of the disclosed subject matter.

Next, the front partially drops down again from this position. The front of the frame 300 is lower than the rear. The rear of the frame 300 is resting on the post hitch pins 309, and the front is elevated slightly above the front post hitch pins 309 as show in FIG. 43 and FIG. 44. FIG. 43 is a right-side view of the frame 300 after the front partially drops down from the previous position FIG. 41. The front of the frame 300 is lower than the rear is now. The rear of the frame 300 is resting on the post hitch pins 309, and the front is elevated slightly above the post hitch pins 309. Next, the front of the frame 300 partially drops down until both the front and the rear of the frame 300 are resting on the post hitch pins 309 where it will stay as shown in FIG. 45 and FIG. 46.

Figure 48:
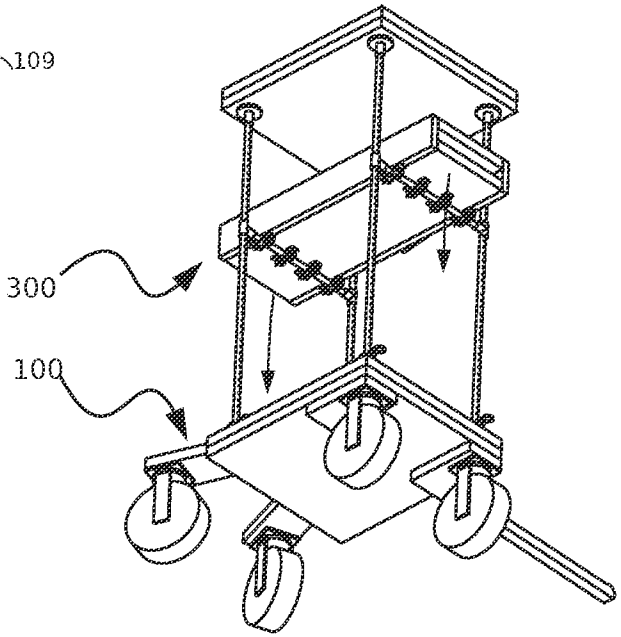
Figure 47:
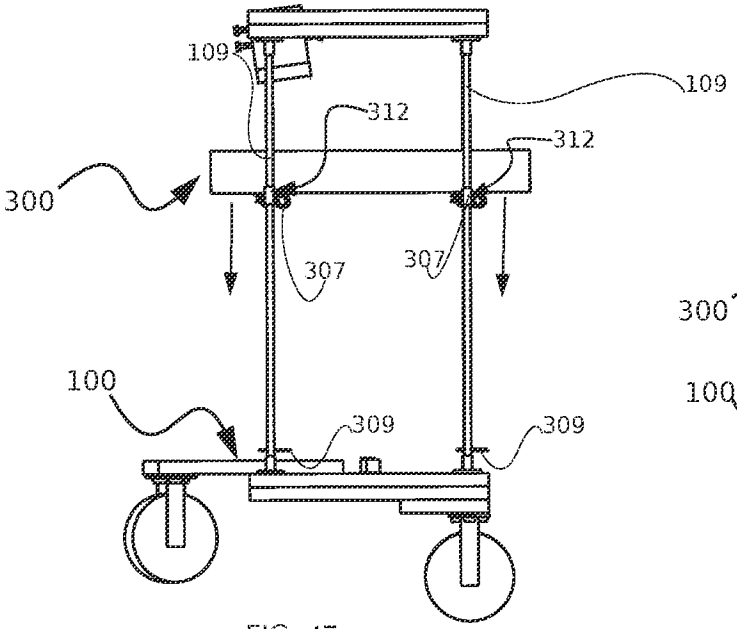
FIG. 47 is a side view of the mobile assembly 100 and frame 300 raised above the post hitch pins 307 before it drops straight down; and, FIG. 48 is a perspective view corresponding to FIG. 47, according to one or more embodiments of the disclosed subject matter.
Figure 50:
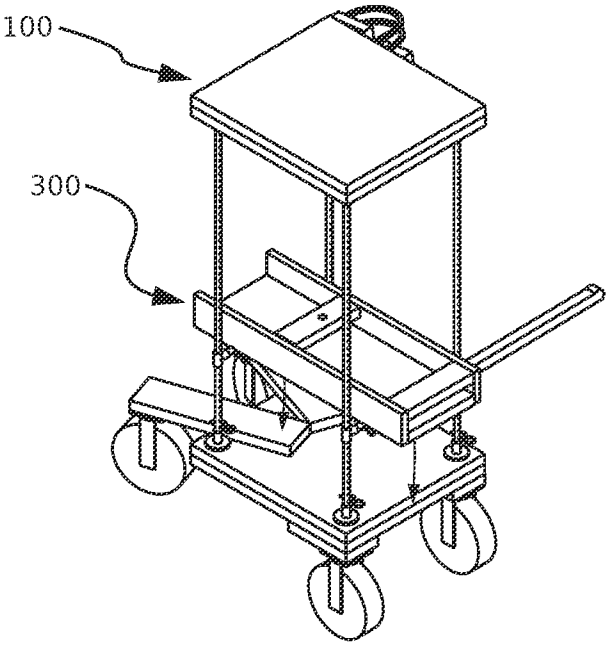
Figure 49:
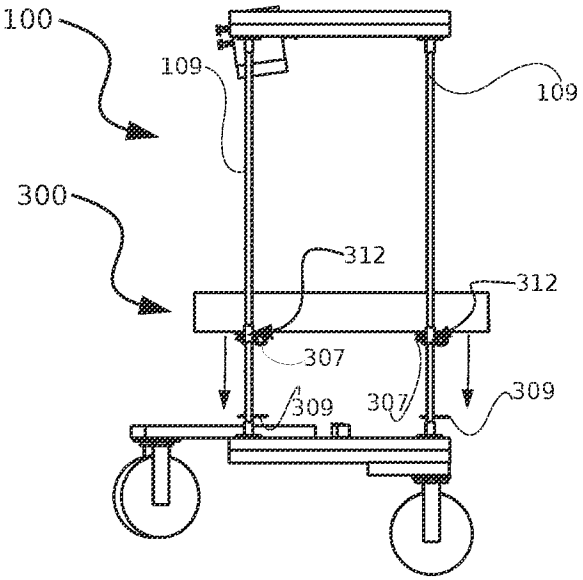
FIG. 49 is a side view of FIG. 47 with the exception that the frame 300 is dropped partially down; and, FIG. 50 is a perspective view corresponding to FIG. 49, according to one or more embodiments of the disclosed subject matter.
Figure 52:
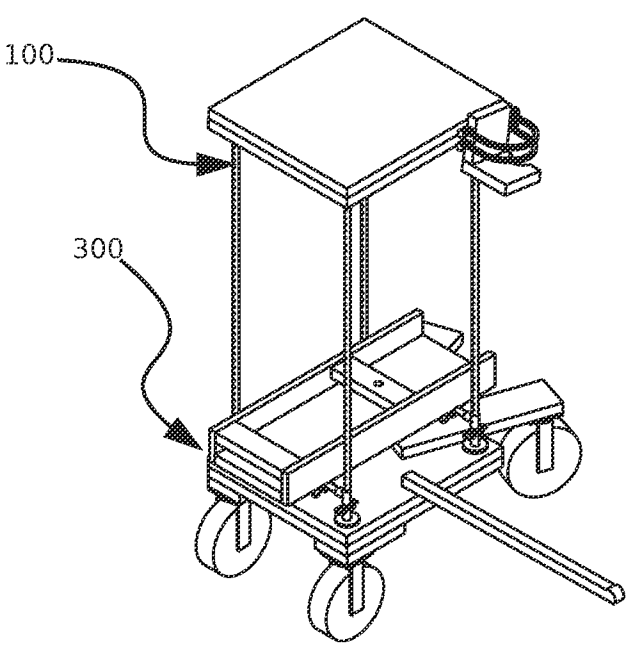
Figure 51:
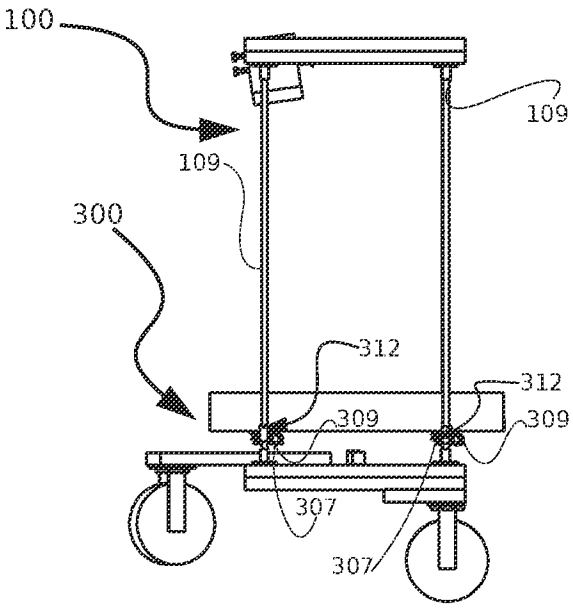
FIG. 51 is a side view of FIG. 49 with the frame 300 dropped down further to its final resting position on top of the post hitch pins 307; and, FIG. 52 is a perspective view corresponding to FIG. 51, according to one or more embodiments of the disclosed subject matter.
Figure 77:
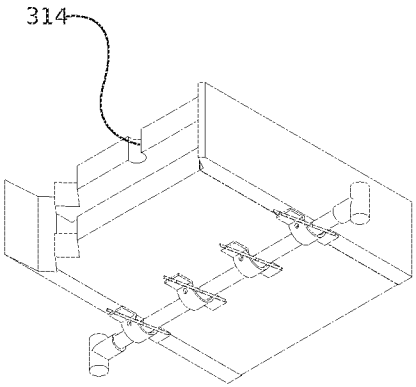
FIG. 77 is a bottom perspective view of FIG. 75, according to one or more embodiments of the disclosed subject matter.
Figure 80:
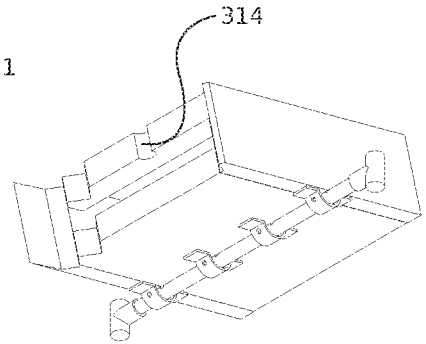
FIG. 80 is a bottom perspective view of FIG. 78, according to one or more embodiments of the disclosed subject matter.
Figure 76:
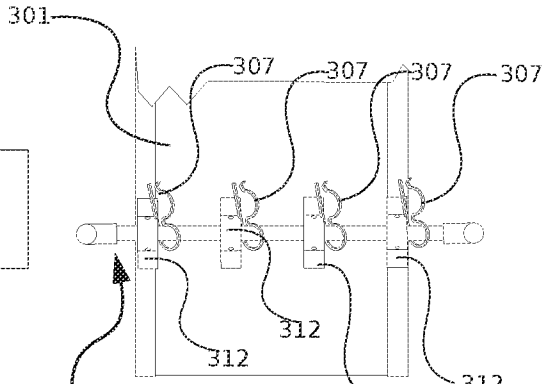
FIG. 76 is a bottom view of FIG. 75.
Figure 79:
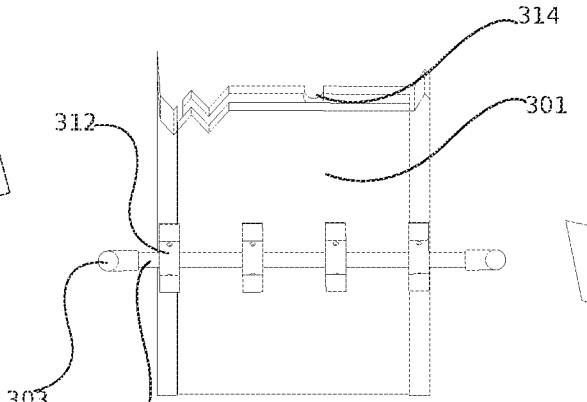
FIG. 79 is a bottom view of FIG. 78.
Figure 75:
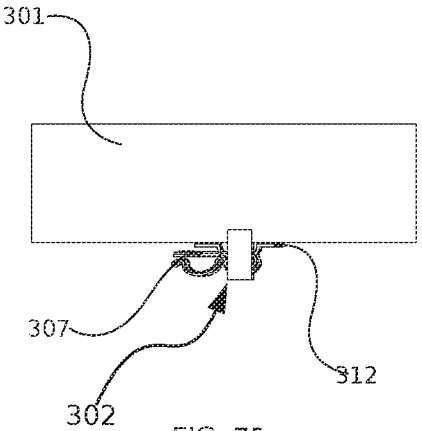
FIG. 75 is a side view of the sliding lateral bar 302 resting on the front braces 312 attached to the bottom of a half portion of the frame 300.

FIG. 47 through FIG. 52 demonstrate a drop motion as times passes during the drop. To create the drop down motion for the cut, the hinging movement will be disabled by placing post hitch pins 307 through the front braces 312 and sliding lateral bars 302 in the form of pipes as shown in FIG. 75 to FIG. 77. This locks the frame in place so when it descends, it will stay level relative to the stand the whole time. Additionally, the post hitch pins 307 all have to be set at the same height. FIG. 47 is a side view of the mobile assembly 100 and frame 300 raised above the post hitch pins 307 in both the front and the rear before it drops straight down. The adjustable frame is level and has the post hitch pins 307 inserted in all the front braces 312 and rear braces 311. This locks the frame 300 in place so when it descends, it will stay level relative to the mobile assembly 100 the whole time. FIG. 48 is a perspective view corresponding to FIG. 47, according to one or more embodiments of the disclosed subject matter. FIG. 47 is a side view of the mobile assembly 100 and frame 300 raised above the post hitch pins 307 in both the front and the rear before it drops straight down. The adjustable frame is level and has the post hitch pins 307 inserted in all the front braces 312 and rear braces 311. This locks the frame 300 in place so when it descends, it will stay level relative to the mobile assembly 100 the whole time. FIG. 47 shows the initial state of the mobile assembly 100 and frame 300 raised above the post hitch pins 307. Post hitch pins 307 have been inserted in all the front braces 312 and rear braces 311. Next, the frame 300 will drop down. FIG. 49 shows the frame 300 still level and in the midway position of the drop. Finally the frame 300 will drop down further to its final resting position on top the post hitch pins 307 as seen in FIG. 51 and FIG. 52.

Figure 69:
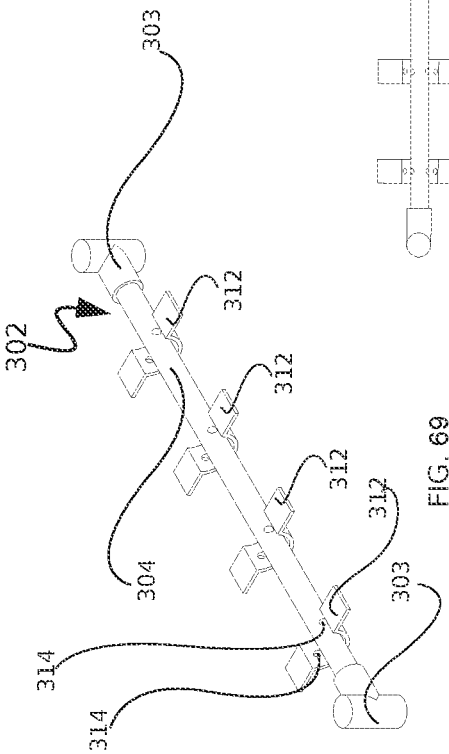
FIG. 69 is a perspective view of the sliding lateral bar 302 resting in the front braces 312.

The arm 200 is shown by itself in FIGS. 53 to 62. The frame 300 is shown by itself in FIGS. 63 to 81 and in FIGS. 82*a* and 82*b*. FIG. 69 is a perspective view of the sliding lateral bar 302 resting in the front braces 312. At a specific point of turning the brace around the pipe, a set of pin holes 118 will line up allowing a hitch pin to going straight through the front brace 312 and the center of the sliding lateral bar 302 to lock them in place. The frame 300 is held by front and rear braces 311 that loosely go around the front and the rear sliding lateral bar 302 and are mounted onto the bottom of the frame structure 301.

Figure 72:
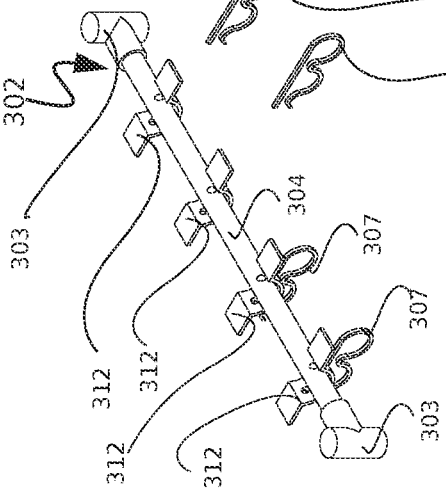
FIG. 72 is a perspective view of the sliding lateral bar 302 resting on the front braces 312.

FIG. 72 is a perspective view of the sliding lateral bar 302 resting in the front braces 312. The front braces 312 have turned around the sliding lateral bar 302 to a specific point where the set of pin holes 118 will line up through the two parts. Two of the hitch pins are inserted through the pin holes and two more are outside their pin holes.

Figure 78:
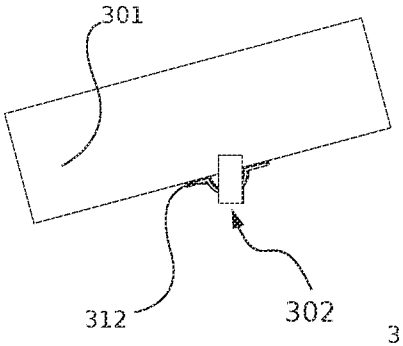
FIG. 78 is a side view of the sliding lateral bar 302 resting on the front braces 312 attached to the bottom of a half portion of the frame 300 with all four post hitch pins 307 removed so the frame 300 can pivot on the sliding lateral bar in the form of a sliding pipe as shown.

FIG. 75 is a side view of the sliding lateral bar 302 resting in the front braces 312, which are attached to the bottom of half of the frame 300 shown. All four post hitch pins 307 are inserted strait through the front brace 312 and the center of the pipe's pin holes to lock them in place so the frame 300 cannot pivot. FIG. 78 is a side view of the sliding lateral bar 302 resting in the rear braces 311 which is attached to the bottom of half of the frame 300. All four post hitch pins 307 are removed so the frame 300 can pivot on the sliding pipe as shown.

In one embodiment, each sliding lateral bar 302 has two tees 303 in the form of pipe mounted in a fixed position on each end of a pipe 304. There can be multiple pin holes all the way through the pipe 304 that will line up with the pin holes in the rear braces 311 when the adjustable frame is perpendicular to the posts 109. This allows a post hitch pin 307 to be inserted through the rear brace 311 and pipe 304. This pipe 304 is a few inches longer then the width of the frame 300, allowing the frame 300 to move left and right a few inches and assist in lining up the cut. The pipe 304 can be very long to allow the frame 300 to slide left and right a foot or more so the user can line up multiple cuts as the frame 300 slides down the pipe 304.

Figure 83:
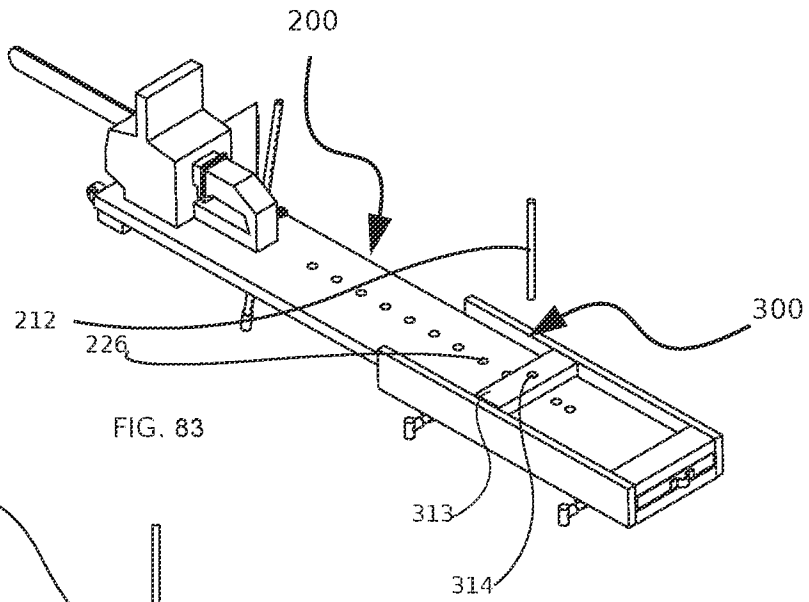
FIG. 83 is a perspective view of the arm 200 accommodated within, and sliding about, the frame 300.
Figure 84:
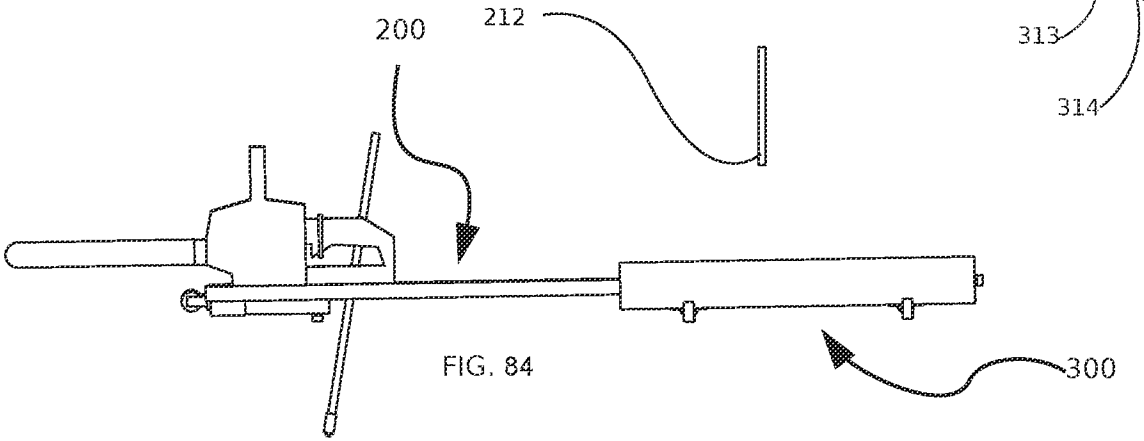
FIG. 84 is a side view of FIG. 83.
Figure 85:
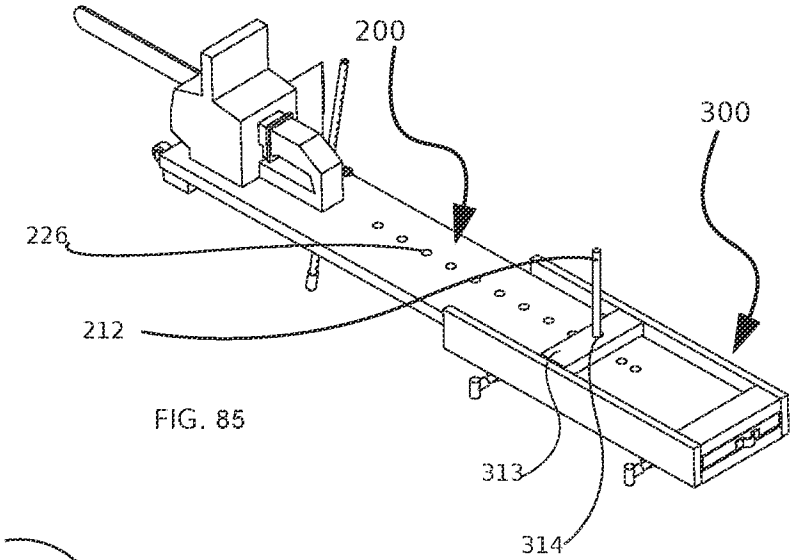
FIG. 85 is a perspective view of the arm 200 inside the frame 300 extended outward with the stopping leg 212 inserted through the holes of both parts, according to one or more embodiments of the disclosed subject matter.

The arm 200 is inserted into the slot in the frame 300 as shown in FIGS. 83 to 96. FIG. 83 is a perspective view of the arm 200 accommodated within the frame 300 extended outward with a hole in the arm 200 line up with the hole 314 in the middle support 313. The stopping leg 212 is above the location it will be inserted to lock in the arm length. The arm 200 can be locked into the frame 300 in either a fixed length or a floating length. The length is the distance the chainsaw 208 is relative to the frame 300 Changing the length of the arm allows the arm to reach out different distances so the blade of chainsaw 208 can rest on top the tree. The changing distances allows the mobile assembly to work when the mobile assembly 100 is closer or farther away from the tree. FIG. 85 is a perspective view of the arm 200 inside the frame 300 extended outward with the stopping leg 212 inserted through the holes of both parts. This locks the length of the arm 200 into a fixed distance.

Figure 86:
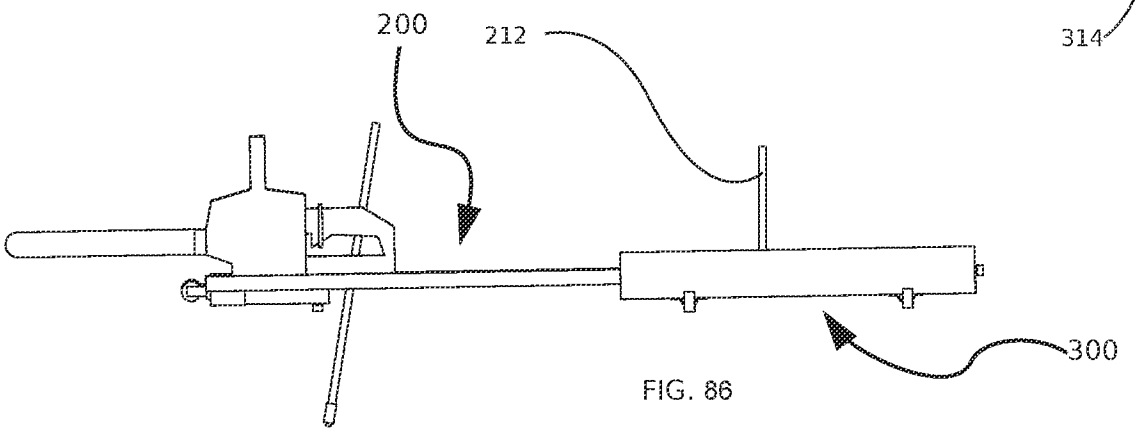
FIG. 86 is a side view of FIG. 85.
Figure 87:
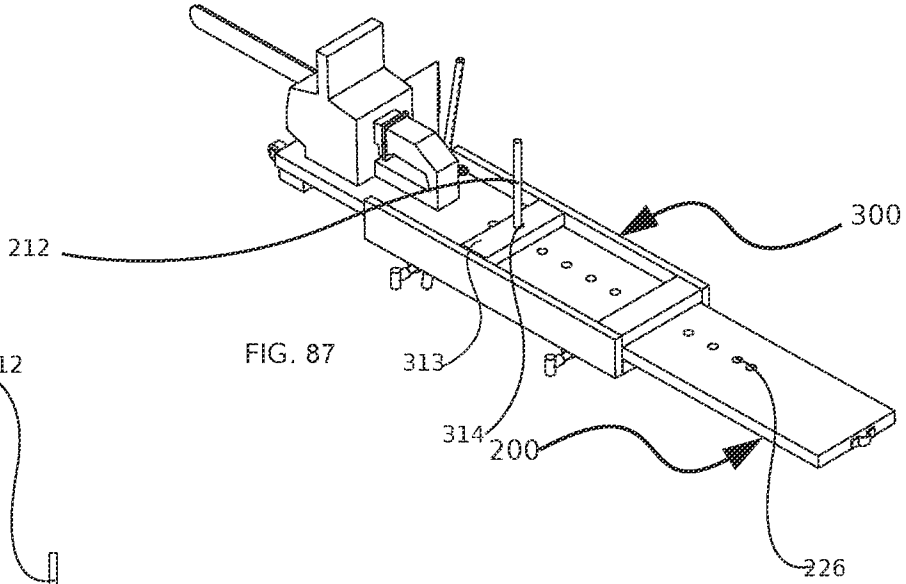
FIG. 87 is a perspective view of FIG. 86 with the length of the arm 200 locked into a shorter fixed distance as compared to the FIG. 85 embodiment, according to one or more embodiments of the disclosed subject matter.
Figure 88:
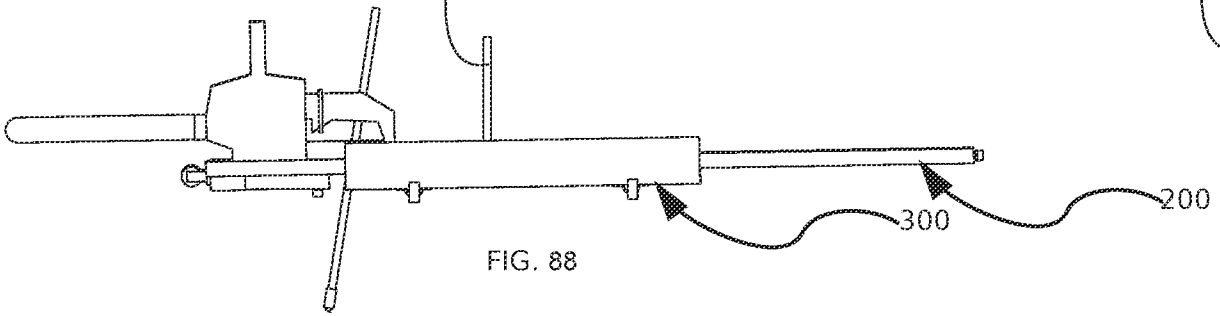
FIG. 88 is a side view of FIG. 87.
Figure 89:
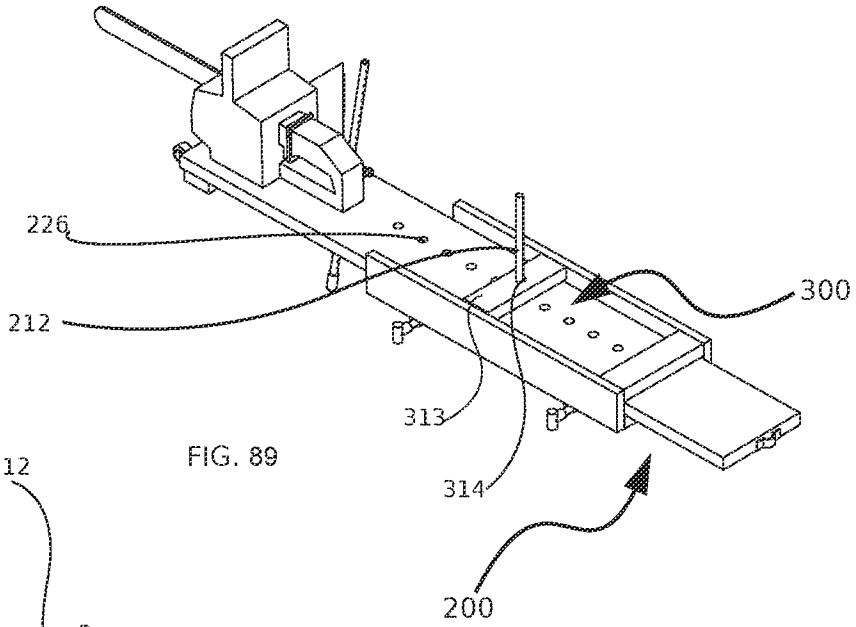
FIG. 89 is a perspective view corresponding to FIG. 87 with the length of the arm 200 locked into a longer fixed distance as compared to the FIG. 87 embodiment; and, FIG. 90 is a side view of FIG. 89, according to one or more embodiments of the disclosed subject matter.
Figure 90:
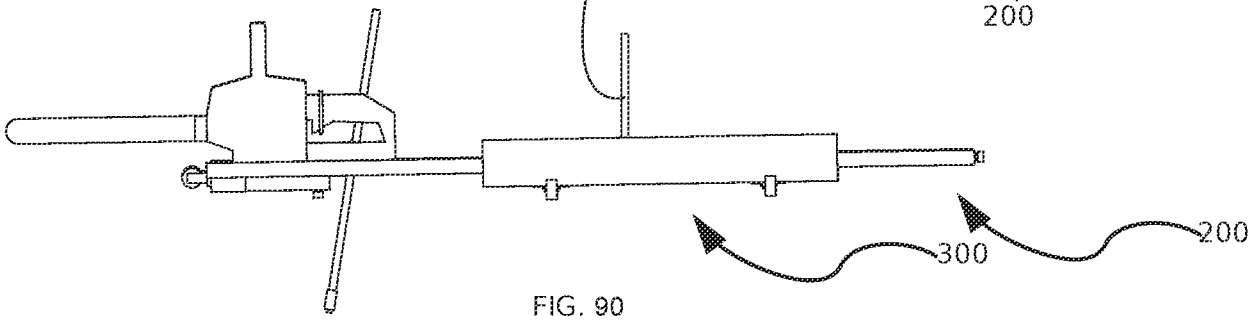

When the user does not want the arm 200 distance to change, the user can fix the length of the arm 200. To fix the length, the hole 314 in the middle support 313 of the frame 300 will line up with one of the many holes 226 in the arm 200. FIG. 83 and FIG. 84 shows the stopping leg 212 above the two holes it will be inserted through the hole 314 of frame 300 and arm 200 hole 226 the to lock in the length of the arm. FIG. 85 and FIG. 86 show the arm 200 after the stopping leg 212 has been inserted. FIG. 87 and FIG. 88 show the arm 200 locked into a shorter distance by choosing a hole 226 in the arm 200 close to the chainsaw. FIG. 89 and FIG. 90 show the arm locked into a mid-length position by inserting the stopping leg 212 through one of the middle holes in the arm 200.

The user can choose the arm 200 to be in a floating length position which allows the arm 200 to move forwards or backwards a short distance. This back and forth movement allow the arm 200 to "float" in or out as it moves down the surface of the material being cut so the arm 200 can automatically adjust its length it needs to be to reach the material being cut. This can be advantageous since the cutting surface can slightly change distances from the frame 300 as the cut progresses. This can allow the arm 200 be closer or farther away for the blade of chainsaw 208 to reach the material being cut.

Figure 91:
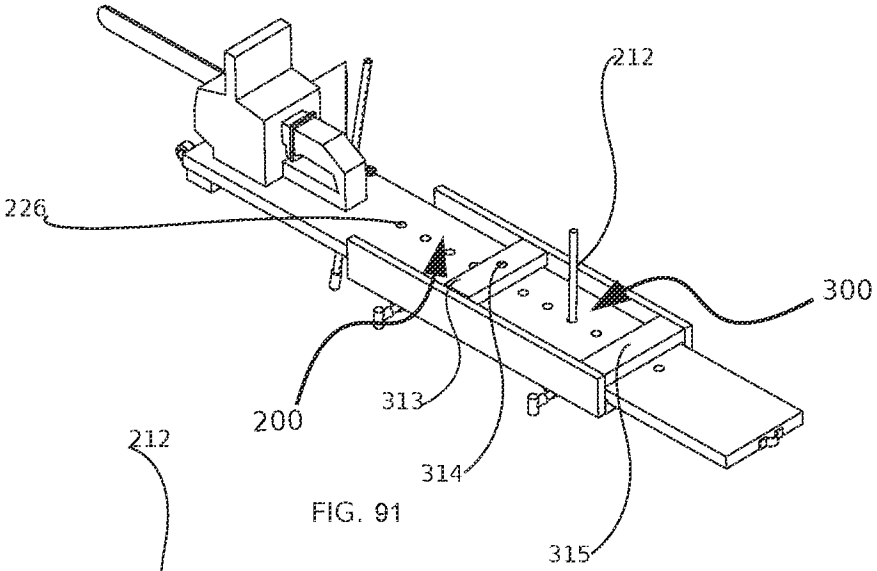
FIG. 91 is a perspective view of the arm 200 inside the frame 300 with stopping leg 212 inserted through a chosen hole located behind the middle support 313 and in front of the rear support 315.
Figure 92:
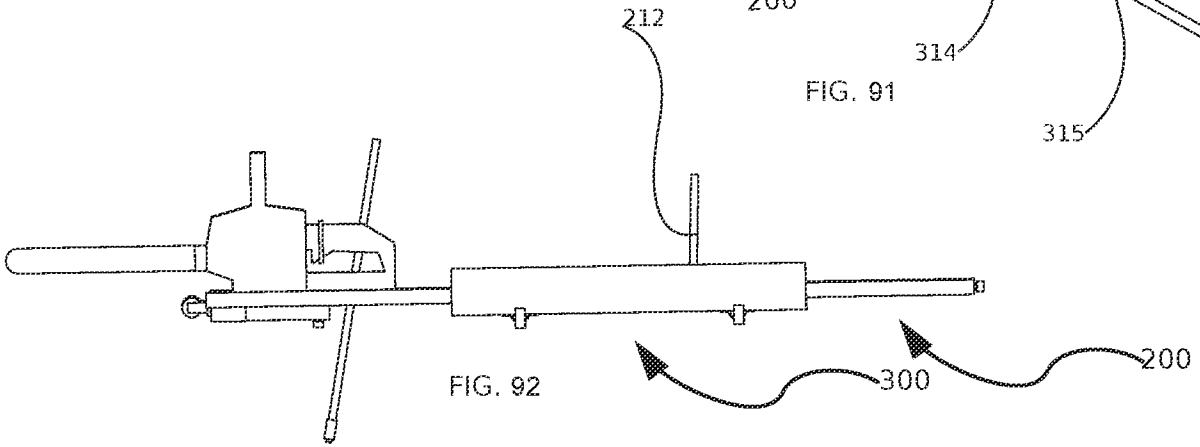
FIG. 92 is a side view of FIG. 91, according to one or more embodiments of the disclosed subject matter.
Figure 93:
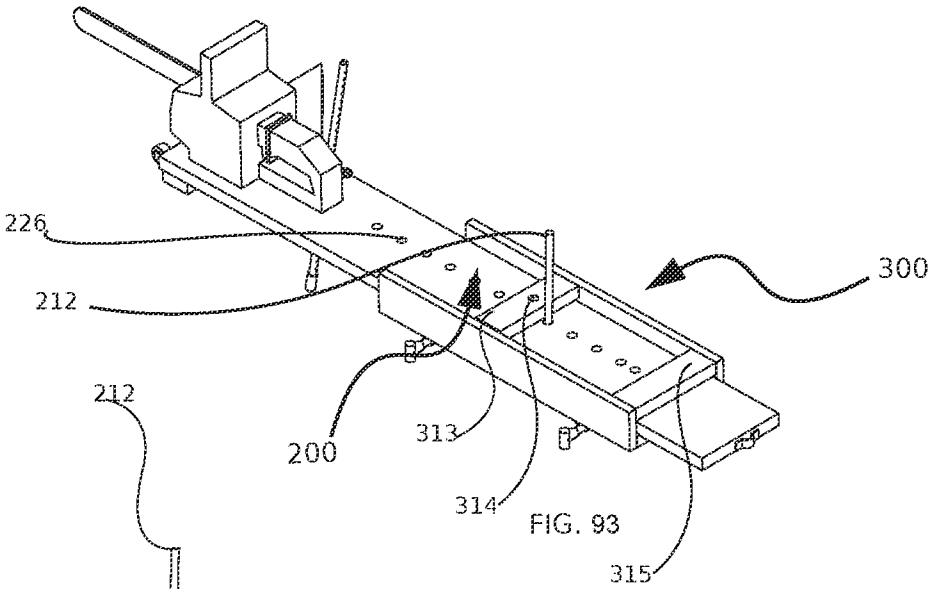
FIG. 93 is a perspective view of the arm 200 inside the frame 300 with the stopping leg 212 inserted through the same chosen hole as FIG. 91.
Figure 94:
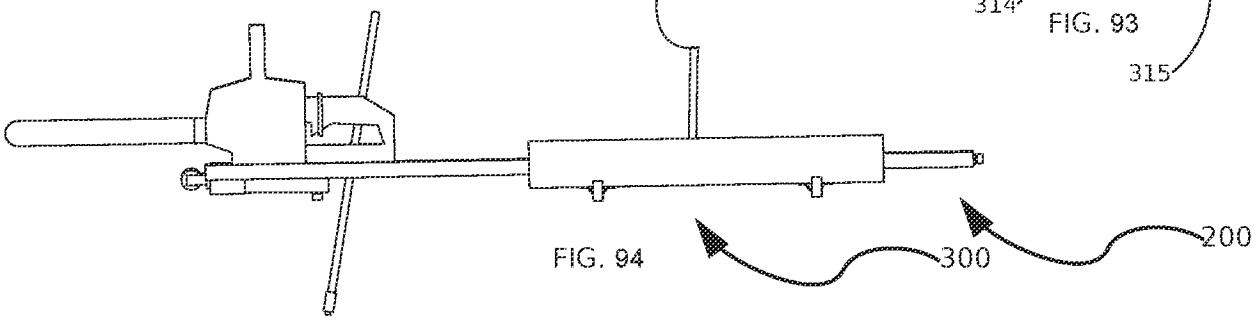
FIG. 94 is a side view of FIG. 93.
Figure 95:
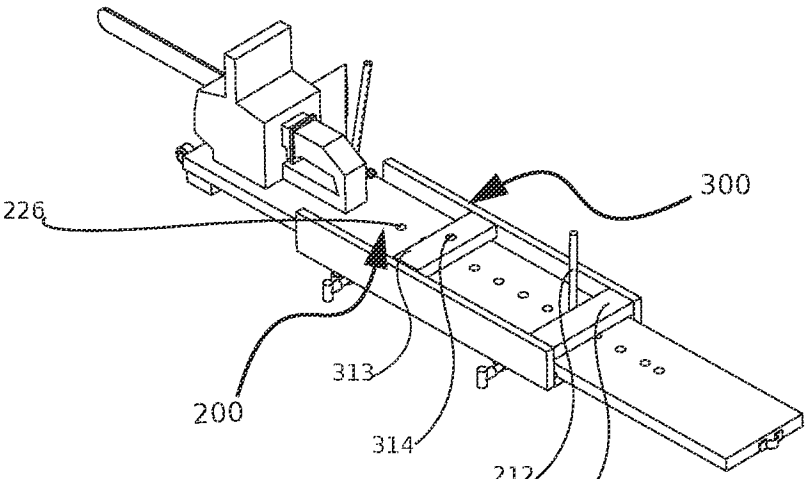
FIG. 95 is a perspective view of the arm 200 inside the frame 300 with the stopping leg 212 inserted through the same chosen hole as FIG. 91; and, FIG. 96 is a side view of FIG. 95, according to one or more embodiments of the disclosed subject matter.
Figure 96:
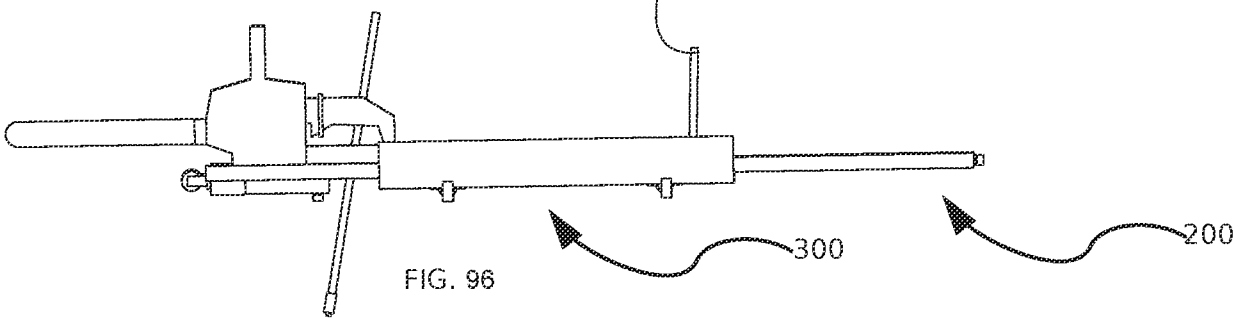
Figure 98:
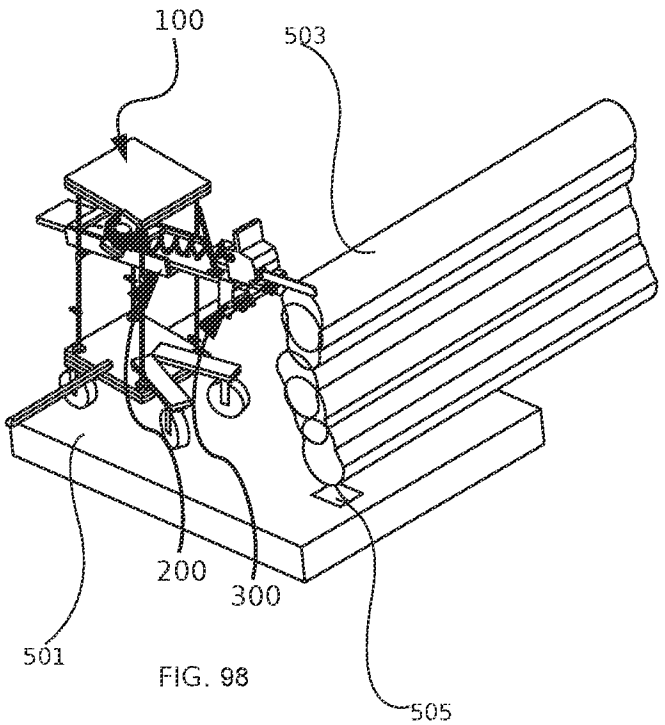
FIG. 98 is a perspective view of FIG. 97, according to one or more embodiments of the disclosed subject matter.

To set the floating length setting, insert the arm 200 inside the frame 300 if it has not already there. Then, the stopping leg 212 in inserted through a chosen hole 226 in the arm 200 behind the middle support 313 and in front of the rear support 315 as shown in FIG. 91. FIG. 91 is a perspective view of the arm 200 inside the frame 300. This allows the arm to move or "float" forwards and backwards a short distance. FIG. 91 shows the arm midway extended for the chosen hole where the stopping leg 212 was inserted into. In FIG. 91 the arm can move forwards or backwards a short distance. FIG. 93 shows the arm with the longest length relative to the frame 300 for the same chosen hole 226 the stopping leg 212 was inserted. FIG. 95 shows the arm the shortest length relative to the frame 300 for the same chosen hole the stopping leg 212 was inserted into. FIG. 93 is a perspective view of the arm 200 inside the frame 300 and the stopping leg 212 is inserted through the same chosen hole as FIG. 91. The arm moved forward from the position in FIG. 91. FIG. 93 shows the arm fully extended for the chosen hole. FIG. 95 is a perspective view of the arm 200 inside the frame 300 and the stopping leg 212 is inserted through the same chosen hole as FIG. 91. The arm moved back to the shortest length from FIG. 91 or FIG. 93.

Figure 97:
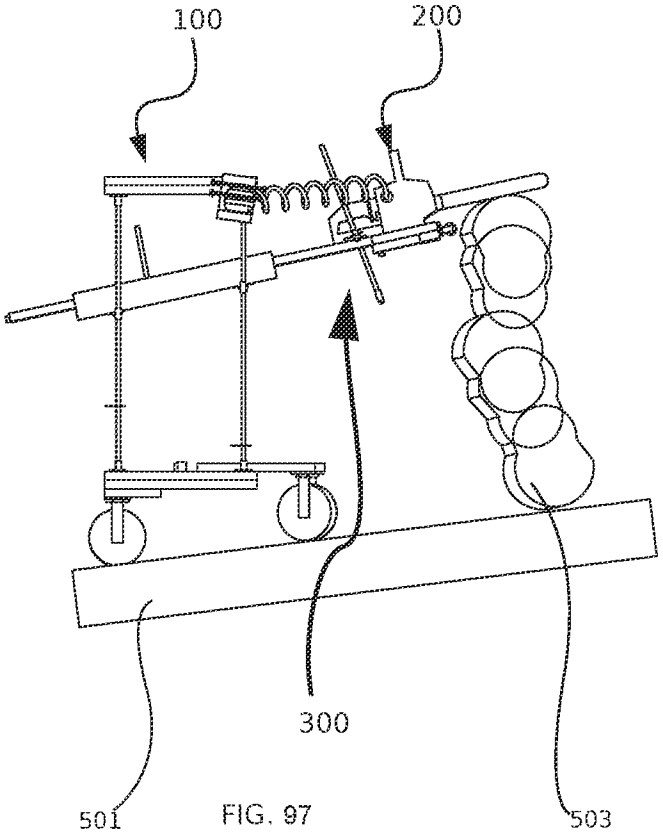
FIG. 97 is a side view of the initial setup of the mobile assembly for making a combination cut of both a drop down cut method and an arch cut method.
Figure 100:
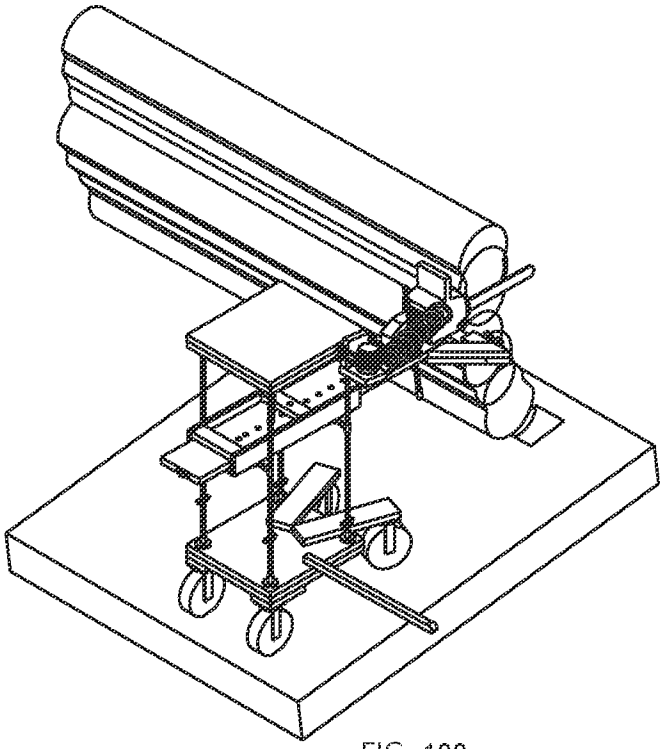

FIG. 97 to FIG. 108 demonstrate how the mobile assembly can make a cut using the combination cut method. The figures are snapshots in sequential order of the cut being made during different times of the cut. The material 503 being cut is shown as crosscut view so that the blade of chainsaw 208 can be seen as it cuts through the material 503. FIG. 97 shows the initial setup of the mobile assembly. The arm 200 is set to be able to float or slide back and forth slightly to follow the profile of material 503 being cut after setting the stopping leg 212. The material 503 can be a log, a tree, limb of a tree, a branch of a tree, and any other material than can be cut with a chainsaw.

FIG. 97 is a side view of the initial setup of the mobile assembly for making a combination cut of both the drop down cut method and the arch cut method. The arm 200 is set to be able to float, or slide back and forth slightly, to follow the profile of material 503 being cut. The material 503 being cut is shown as crosscut view so that t the blade of chainsaw 208 can be seen in the figures.

Figure 99:
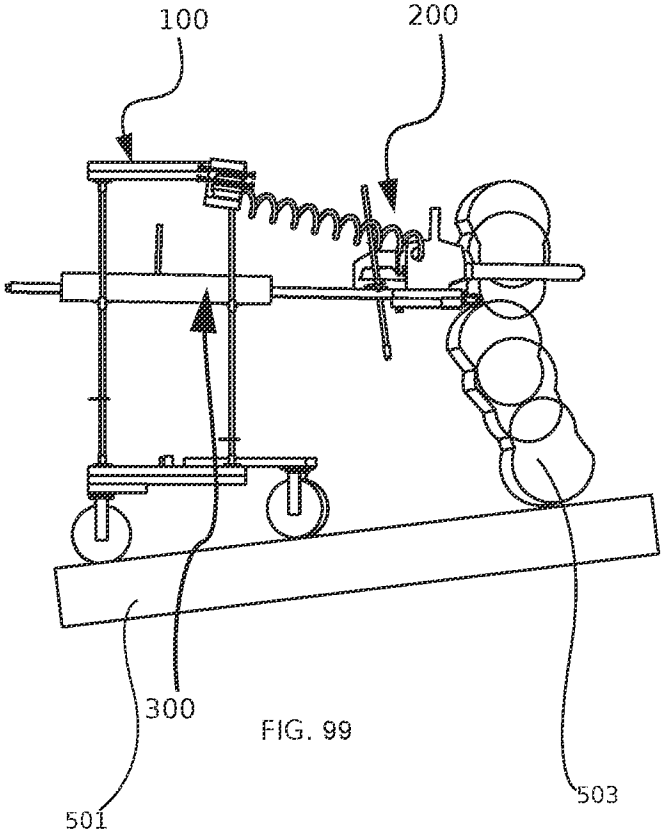
FIG. 99 is a side view of combination cut method and the position of the mobile assembly after the chainsaw is turned on and has commenced cutting; and, FIG. 100 is a perspective view of FIG. 99, according to one or more embodiments of the disclosed subject matter.
Figure 102:
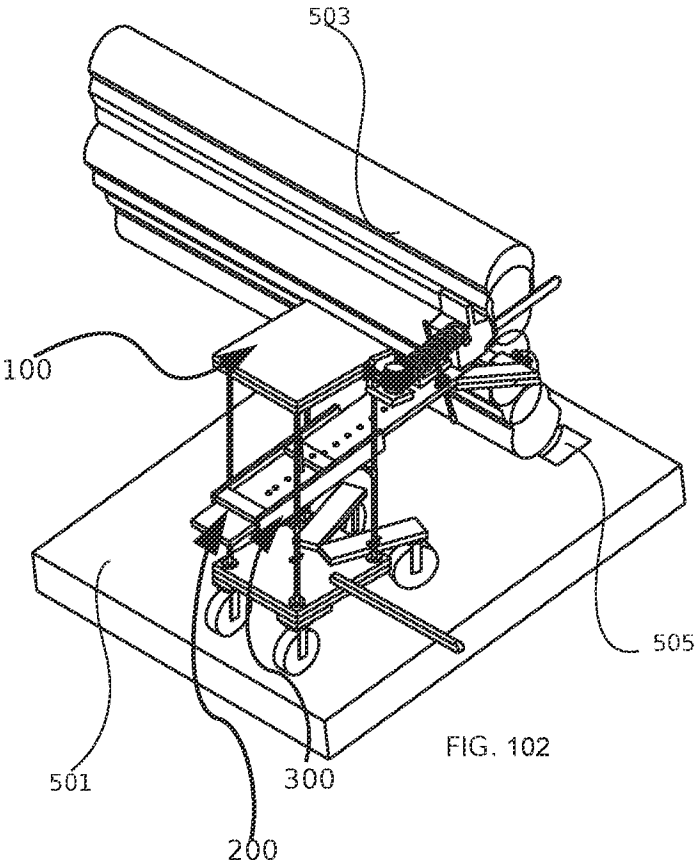
FIG. 102 is a side view of FIG. 101, according to one or more embodiments of the disclosed subject matter.
Figure 101:
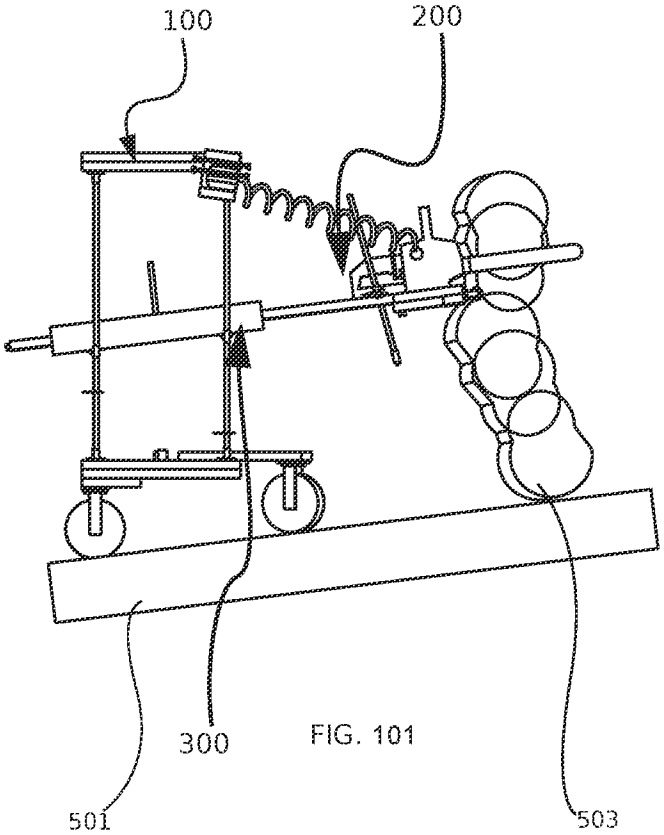
FIG. 101 is a side view of combination cut method and the position of the mobile assembly further along after reaching the position of the FIG. 99 embodiment.
Figure 104:
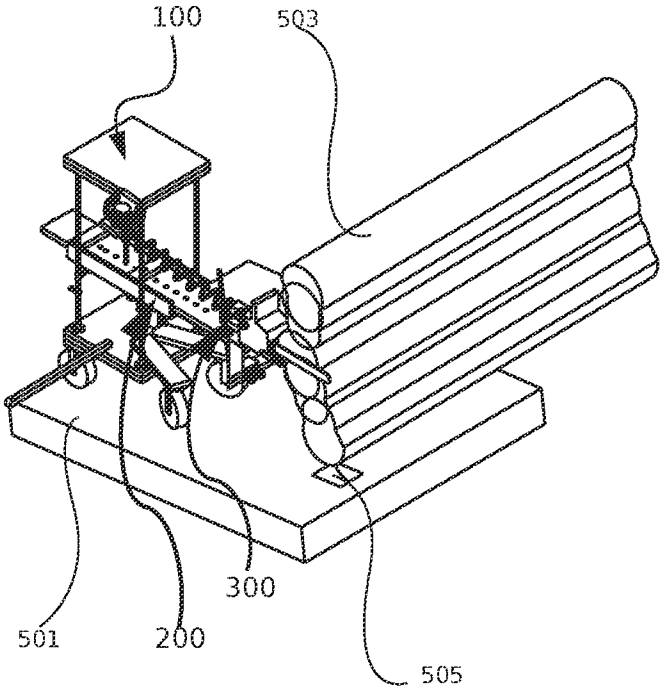

FIG. 99 is a side view of combination cut method and the position of the mobile assembly shortly after the chainsaw is turned on. The chainsaw 208 is running and cut through the material 503 along the blade path of chainsaw 208 from FIG. 97 to its current position. One can notice that the stopping leg 212 has moved forward along with the arm 200 so the blade of chainsaw 208 can go through the material 503. The casters 211 in the front prevent the arm 200 from extending too far and assist with the arm 200 rolling across the material being cut. FIG. 99 shows the next position of the mobile assembly shortly after the chainsaw is turned on after cut through some material 503. One can notice that the stopping leg 212 has moved forward along with the arm 200 so the blade of chainsaw 208 can go through the material. The casters 211 in the front are preventing the arm 200 from extending to far and assist with the arm 200 rolling across the material being cut. Continuing the cut, the saw will come to the position seen in FIG. 101. FIG. 101 is a side view of combination cut method and the position of the mobile assembly shortly after FIG. 99. The chainsaw 208 is running and cut through the material along the path of the blade of chainsaw 208 from FIG. 99 to its current position. One can notice that the stopping leg 212 moved forward more and the blade of chainsaw 208 can go around the corner by changing its angles. One can notice that the stopping leg 212 moved forward more and the blade of chainsaw 208 can go around the corner by changing its angles. The arm will then proceed to cut and drop to the position show in FIG. 103. One can notice that the stopping leg 212 moved back more and the blade of chainsaw 208 is going through the material at a different angle.

Figure 103:
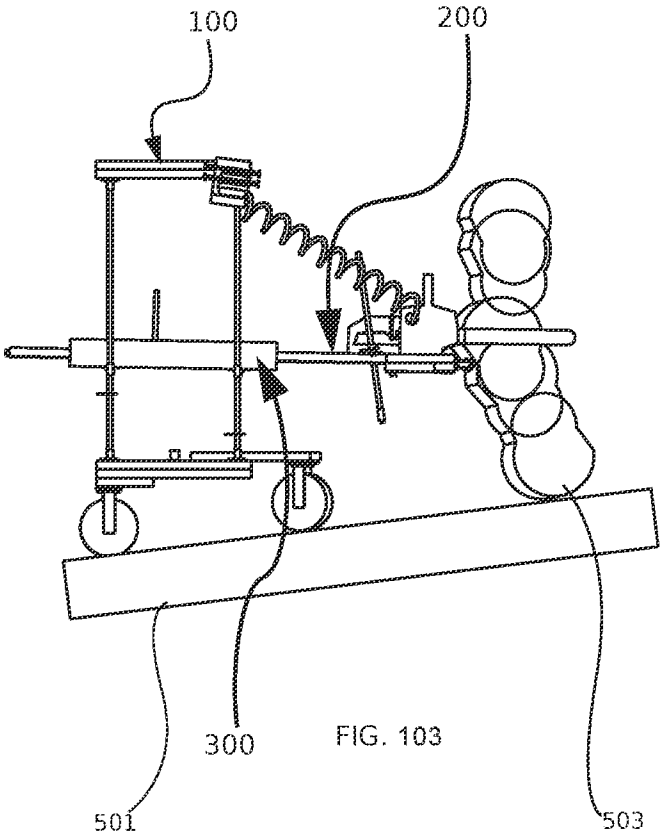
FIG. 103 is a side view of combination cut method and the position of the mobile assembly further along after reaching the position of the FIG. 101 embodiment; and, FIG. 104 is a perspective view of FIG. 103, according to one or more embodiments of the disclosed subject matter.
Figure 106:
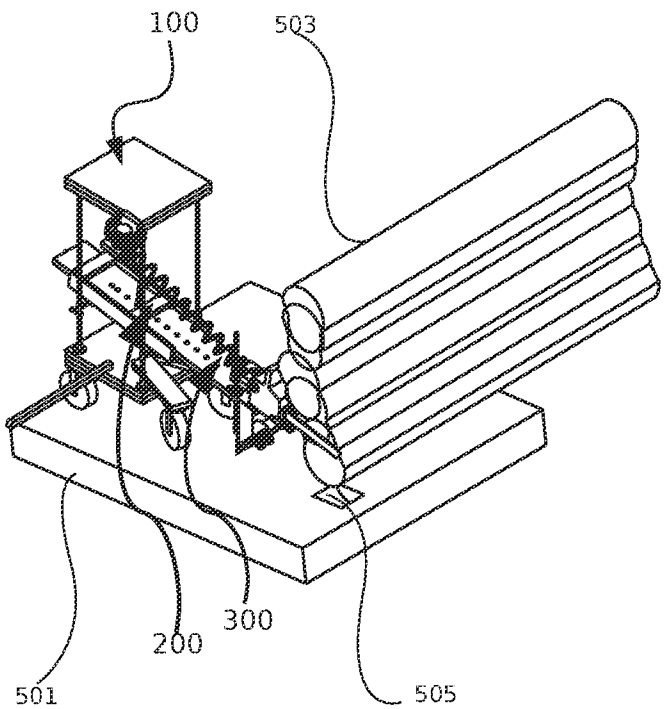
Figure 105:
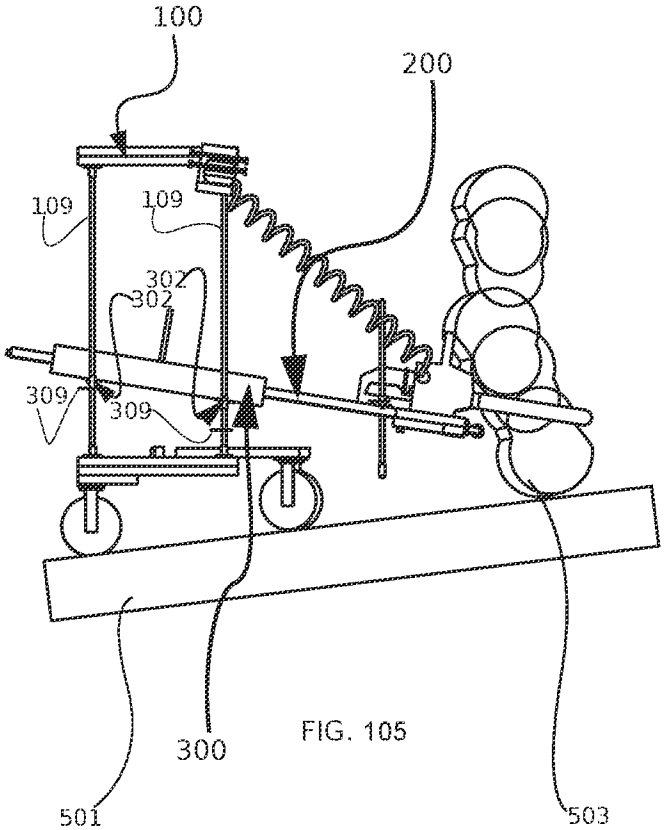
FIG. 105 is a side view of combination cut method and the position of the mobile assembly further along after reaching the position of the FIG. 103 embodiment; and, FIG. 106 is a perspective view of FIG. 105, according to one or more embodiments of the disclosed subject matter.
Figure 108:
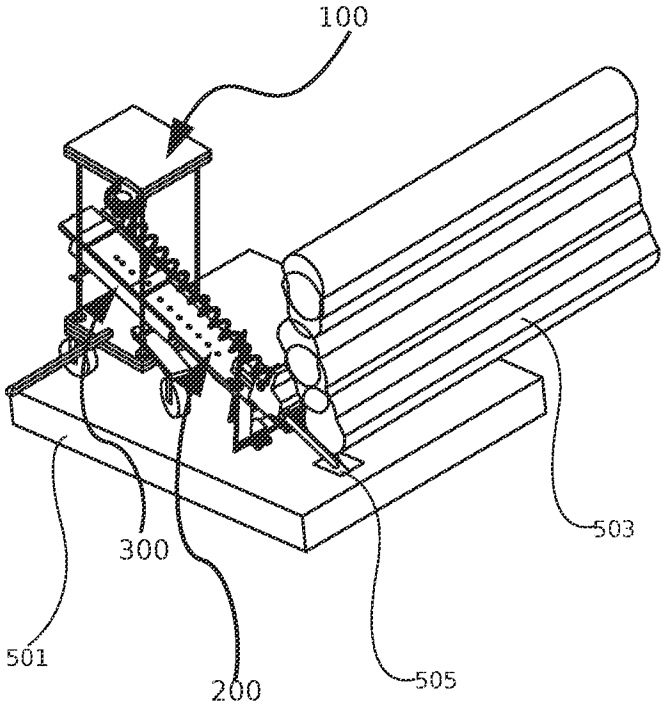

FIG. 103 is a side view of combination cut method and the position of the mobile assembly shortly after FIG. 101. The chainsaw 208 is running and cut through the material 503 along the path of the blade of chainsaw 208 from FIG. 101 to its current position. One can notice that the stopping leg 212 moved back more and the blade is going through the material at a different angle. Continuing the cut, FIG. 105 shows stopping leg 212 moved back some more and the blade of chainsaw 208 is going through the material 503 at a different angle. The rear of the frame 300 is sitting on the rear post hitch pins 307 and will not be able to descend father. FIG. 105 is a side view of combination cut method and the position of the mobile assembly shortly after FIG. 103. The saw is running and cut through the material along the path of the blade of chainsaw 208 from FIG. 103 to its current position. One can notice that the stopping leg 212 moved back some more and the blade is going through the material at a different angle. The rear of the frame 300 is sitting on the rear post hitch pins 307 and will not be able to descend further.

Figure 107:
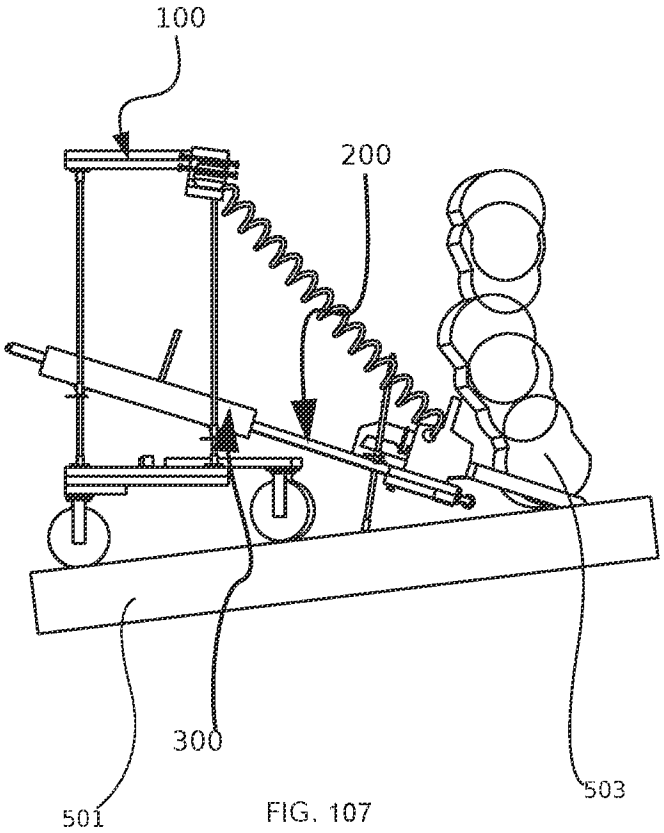
FIG. 107 is a side view of combination cut method and the position of the mobile assembly shortly after FIG. 105; and, FIG. 108 is a perspective view of FIG. 107, according to one or more embodiments of the disclosed subject matter.
Figure 110:
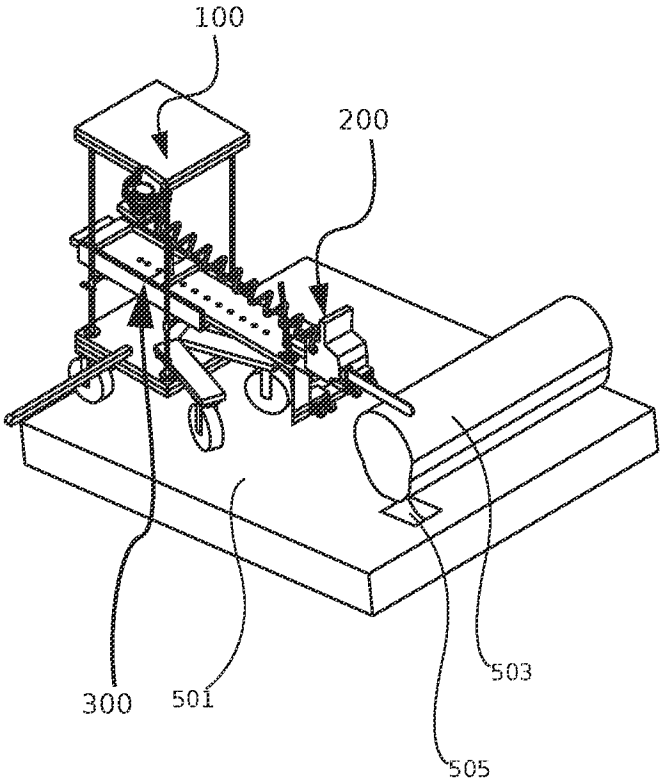
Figure 109:
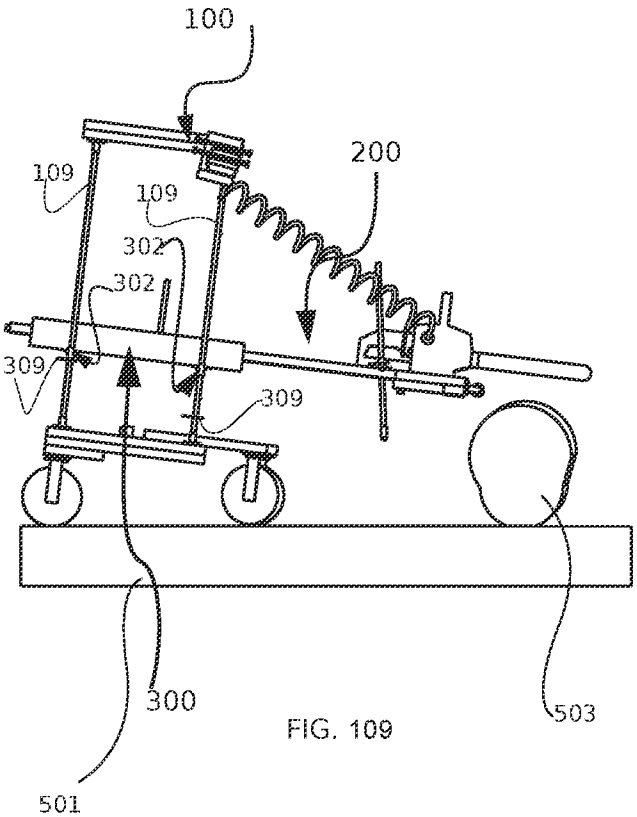
FIG. 109 is a side view of the hinge drop cut with the chainsaw blade resting on the tree before the chainsaw being turned on; and, FIG. 110 is a perspective view of FIG. 109, according to one or more embodiments of the disclosed subject matter.
Figure 112:
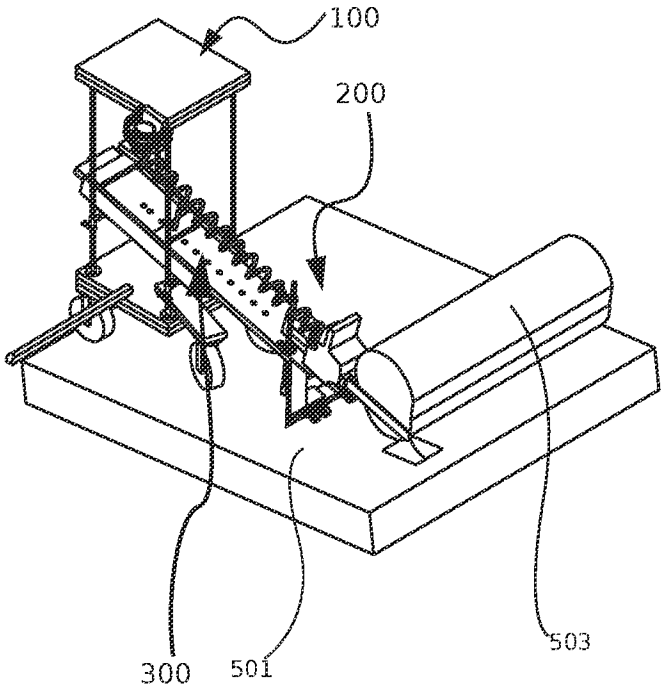
Figure 111:
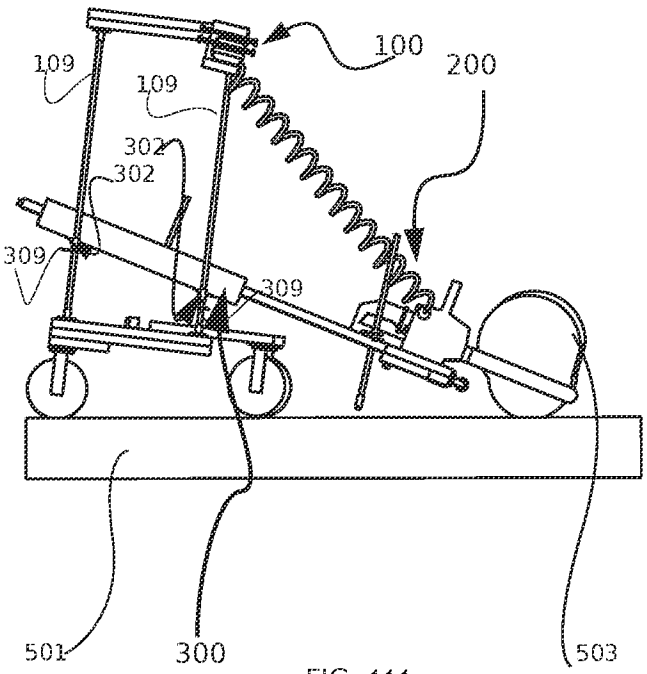
FIG. 111 is a side view snapshot of the hinge drop cut midway through the cut with the chainsaw blade is halfway through the tree with the chainsaw turned on; and, FIG. 112 is a perspective view of FIG. 111, according to one or more embodiments of the disclosed subject matter.
Figure 114:
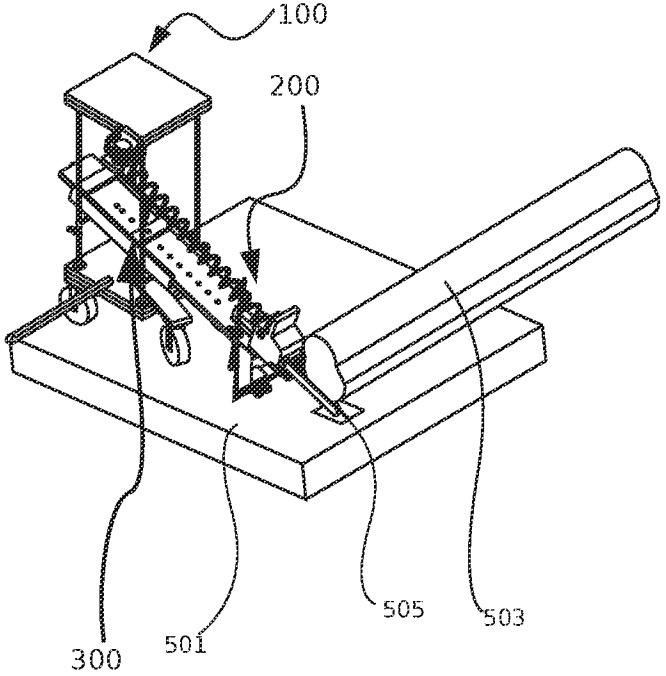
Figure 113:
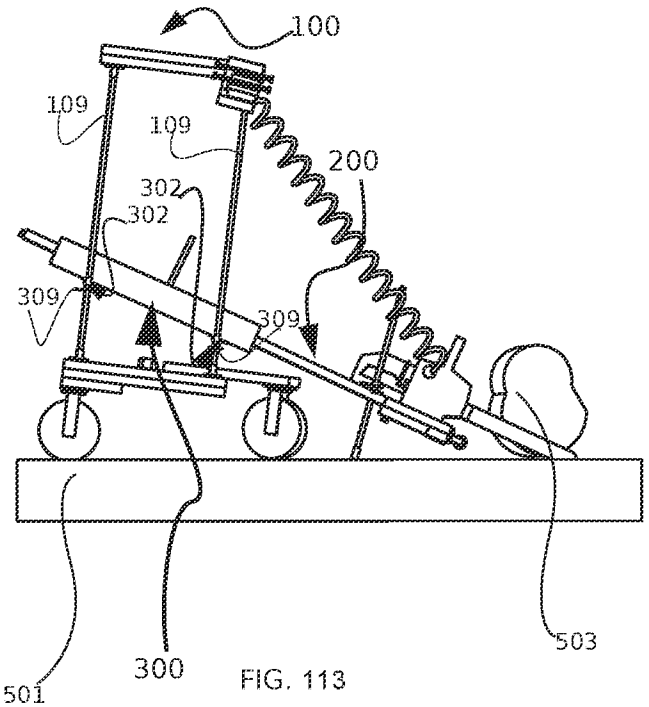
FIG. 113 is a side view of the hinge drop cut completed with the stopping leg 202 resting on the ground 501, and the frames 300 are resting on all four post hitch pins 307, with the chainsaw turned off; and, FIG. 114 is a perspective view of FIG. 113, according to one or more embodiments of the disclosed subject matter.
Figure 116:
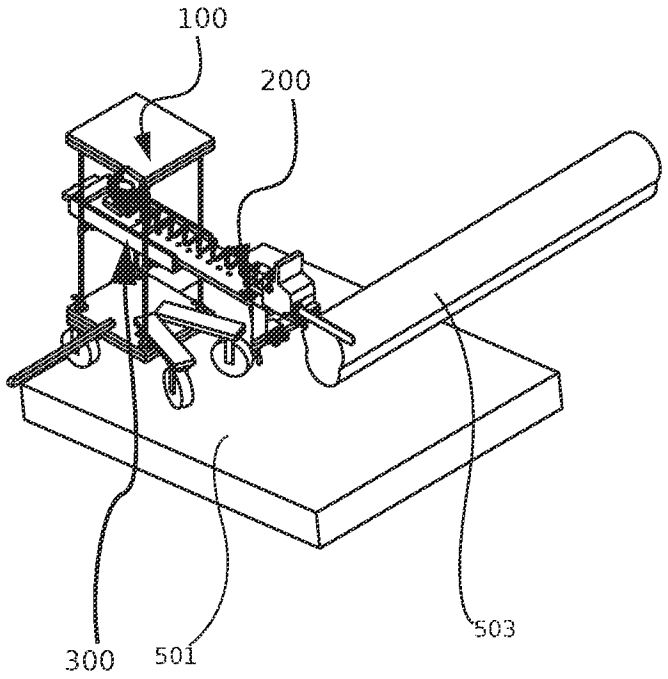
Figure 115:
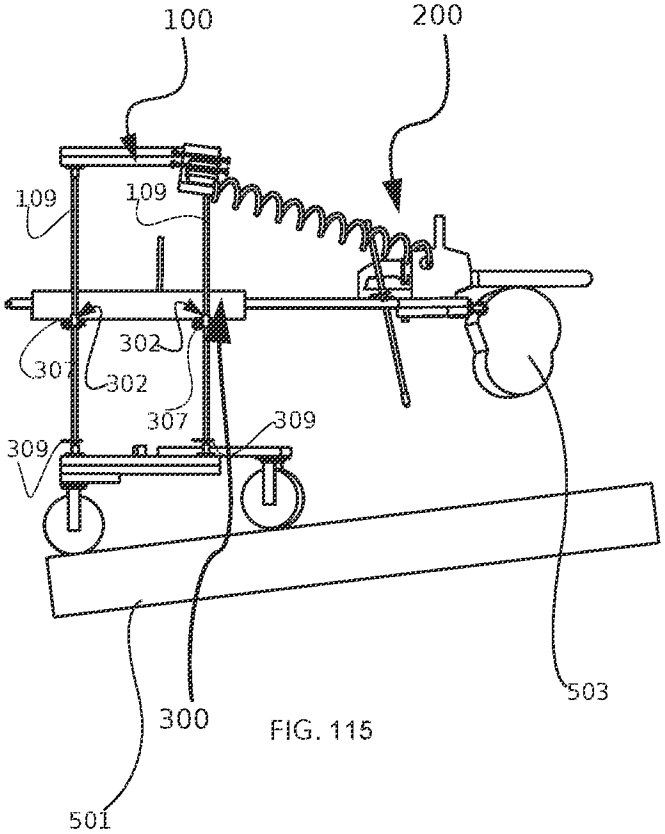
FIG. 115 is a side view of the strait down drop cut with the blade of chainsaw 208 resting on the material 503 before the chainsaw being turned on; and, FIG. 116 is a perspective view of FIG. 115, according to one or more embodiments of the disclosed subject matter.
Figure 118:
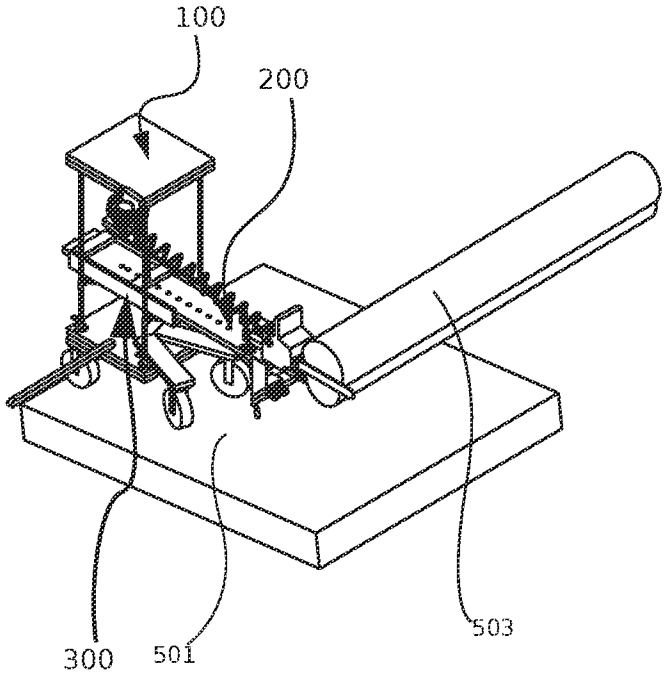
Figure 117:
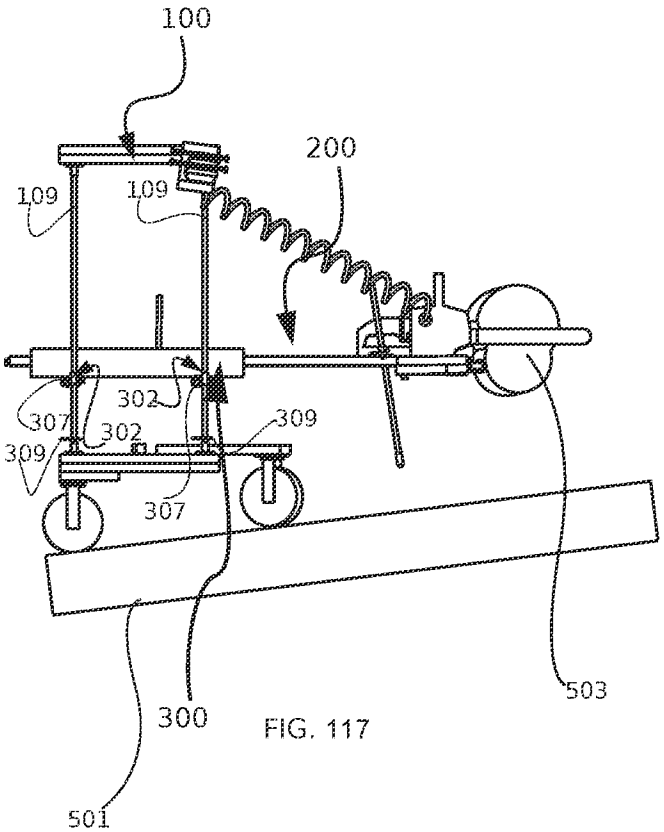
FIG. 117 is a side view of the strait down drop cut midway through the cut with the chainsaw blade halfway through the material 503, with the chainsaw 208 turned on; and, FIG. 118 is a perspective view of the device of FIG. 117, according to one or more embodiments of the disclosed subject matter.
Figure 120:
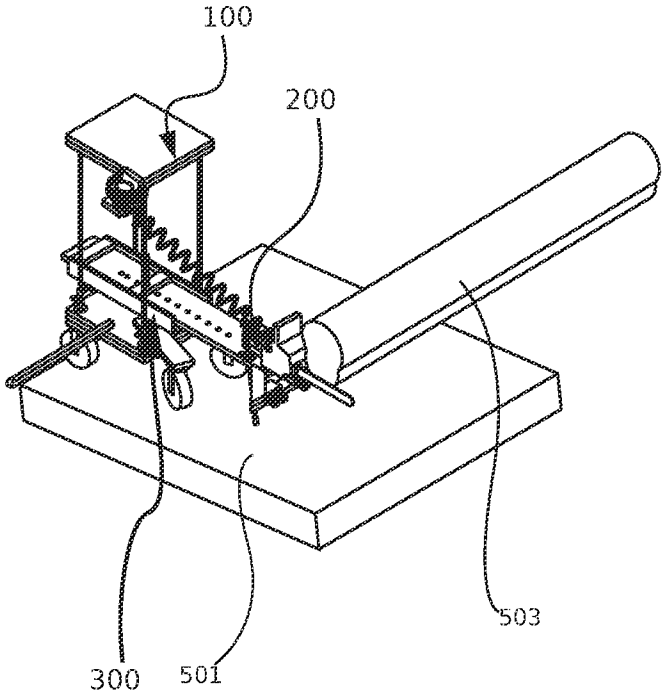
Figure 119:
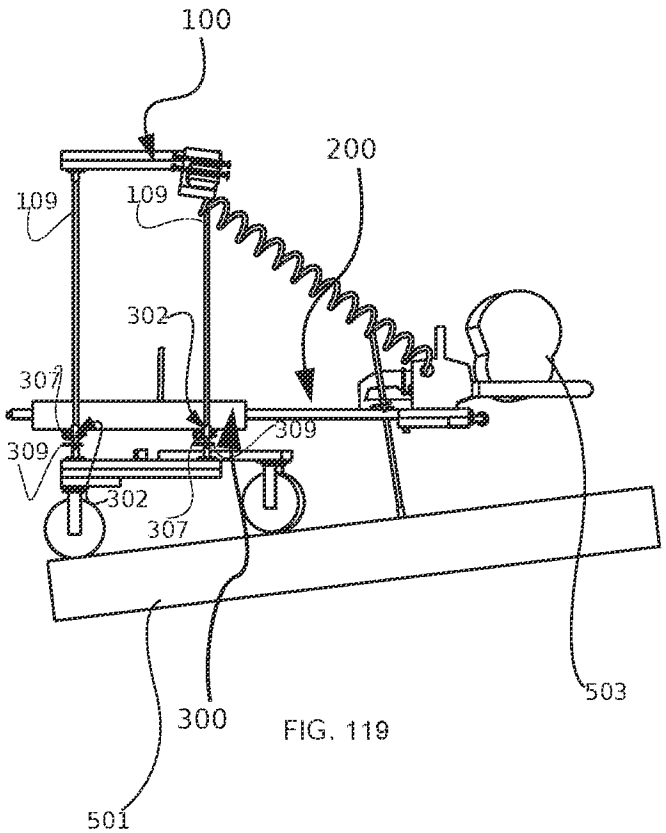
FIG. 119 is a side view of the strait down drop cut completed with the stopping leg 202 resting on the ground 501, with the frames 300 resting on all four post hitch pins 307, and with chainsaw 208 turned off; and, FIG. 120 is a perspective view of FIG. 119, according to one or more embodiments of the disclosed subject matter.

FIG. 107 is a side view of combination cut method and the position of the mobile assembly shortly after FIG. 105. The saw is now stopped after cutting through the material along the path of the blade of chainsaw 208 from FIG. 105 to its current position. One can notice that the stopping leg 212 has moved all the way forward. The blade of chainsaw 208 has completed going through all the material. The arm 200 is resting on the stopping leg 202 to prevent it from descending any further. On the bottom of the stopping leg 202, the button or trigger 216 is now being pressed as it is against the dirt and the weight of the arm is holding it down. This button will make the blade of chainsaw 208 stop running unnecessarily as the cut is complete. The front of the frame 300 is sitting on the front post hitch pins 307 and this is an additional option to stop the arm 200 from moving further in addition to the stopping leg 202. Sometime a small divot 505 created by digging a few shovels of dirt can be required to be taken out behind the log under the location the cut will occur to help ensure the blade of chainsaw 208 does not hit the dirt, especially if the tree has sunken into the ground when it fell. An option self-sharpening system can be used to sharpen the bladed of the chainsaw to help in the event the settings were not made properly, and the blade grazes the dirt by mistake.

The mobile assembly can be configured as a remote device by making the bottom base of the mobile assembly 100 into remote driving device using a functionality that is similar to the functionality of the remote of a remote-control car such that the mobile assembly can be moved around with a remote, in one embodiment. A winch will be added to the front of the top base 104 and it will connect to the handle of the chainsaw 208 to lift it up or lower the chainsaw 208 and arm with the remote. A winch will be added to the bottom of the top base 104 and connect to the middle support 313 to be able to raise or lower the frame 300 with the remote. The arm 200 extended will also be mechanical with a motor pushing it forward or pulling it back using something like a belt or gears.

FIG. 121 is a zoomed inside view the stopping leg 202. The stopping leg 202 is set to the correct height by removing the leg hitch pin 214 and sliding the leg post 215 to the correct height inside the leg mount 213. In the example FIG. 121 the height is set to stop the arm 200 right before the blade of chainsaw 208 touches the ground 501. The leg hitch pin 214 will then be inserted through both the leg mount 213 and leg post 215 to lock the height in place.

Figure 151:
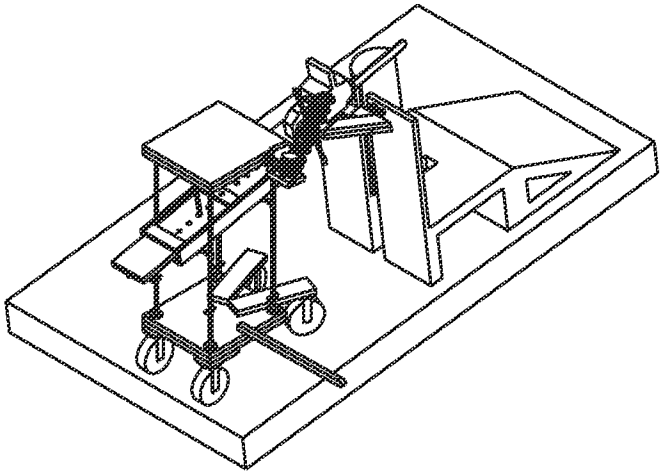

It is possible to material 503 in the form of split logs as shown in the FIGS. 150-157 by cutting the material 503 straight through the grain using the log stand 506. The log stand 506 can act like a chop saw by the user holding the built in handle of the chainsaw 208 to lift it up and down. The chainsaw 208 will turn off in the down position due to the switch on the stopping leg 202. The user can feed thin material under the blade of chainsaw 208 on the log stand 506 as the user or operator lifts the saw up and lets it drop down to make many quick cuts. To split a log using the stand, the user will place the material 503 on the slit where it will be cut. FIGS. 150 through 157 illustrate only half the material 503 in order to see where the blade of chainsaw 208 is throughout the cutting process. FIGS. 150-151 shows one example of how the device will be setup before the chainsaw is turned on to make the cut. After the saw it turned on for a short period of time, the blade of chainsaw 208 will run and drop down as shown in FIGS. 152 through 153. FIG. 152 is a side view of a material 503 being cut on the log stand 506 after a short period of time while cutting through the top of the material 503 as seen by the position of the blade of chainsaw 208. The picture of the material 503 is a crosscut view to show the blade of chainsaw 208 as it cuts through center of the material 503.

FIG. 154 is a side view of a material 503 being split using the log stand 506. The saw is cutting through the bottom of the material 503 as seen by the position of the blade of chainsaw 208. The picture of the material 503 is a crosscut view to show the blade of chainsaw 208 as it cuts through center of the material 503.

FIG. 156 is a side view of a material 503 being split using the log stand 506. The saw cut has been completed and the arm is resting on the stopping leg 202 and the chainsaw 208 is turned off. The picture of the material 503 is a crosscut view to show the blade of chainsaw 208 as it cuts through center of the material 503.

As the saw continues to cut, it will advance to a lower position as shown in FIGS. 154-155. The saw will complete the cut and turn of with the switch 223 on the bottom of the stopping leg 202 and rest on the stopping leg 202 as seen in FIGS. 156-157.

FIG. 168 is a side view of the mobile assembly 100 with the frame 300 aimed upwards. One can notice that there is about equal spacing between the front sliding lateral bar 302 and the front and back of the longer brace 306. FIG. 170 is a side view of the mobile assembly 100 with the frame 300 level. One can notice that there is now no spacing between the front sliding lateral bar 302 and the back of the longer brace 306. FIG. 172 is a side view of the mobile assembly 100 with the frame 300 aimed downwards. One can notice that there is more spacing between the front sliding lateral bar 302 and the front of the longer brace 306. FIGS. 178 through 183 demonstrate how the device still can make a straight-line cut using the longer brace 306. A longer brace 306 can be used in the front, the rear, or for both. This embodiment may not require the longer brace 306 as there is enough play with rear braces 311. Also, an upstanding pipe 115 or similar structure used in the posts 109 have a small amount of flex in them. FIG. 180 is a side view of the mobile assembly 100 and frame 300 with front post hitch pins 307 inserted into the longer braces 306. This is after the frame 300 dropped down the posts 109 from the previous FIG. 178. FIG. 182 is a side view of the mobile assembly 100 and frame 300 with front post hitch pins 307 inserted into the longer braces 306 after dropping down the posts 109 from the previous FIG. 180. The arm 200 is now resting on the post hitch pins 307 and will not descend further.

In various embodiments, the assembly for cutting wood can include further additional features as described below.

In some embodiments, the movement of the frame up and down the post(s) is configured to be electronically controlled. In one embodiment, this is accomplished by the provision of a winch configured to slide or move the frame up and down the post based on electronic signals received at the winch or at a controller that is in communication with the winch (with the controller being positioned at the assembly in one embodiment), wherein the electronic signals can be received at the assembly via a wired connection or a wireless connection. It is to be noted that other means of moving the frame up and down the post(s) are within the scope of the subject matter as disclosed herein.

In some embodiments, the stopping leg is not used. In some embodiments, instead of the stopping leg, other means of limiting the downward movement of the chainsaw blade can be provided. For example, in one embodiment, an electronic tape measure can be positioned below the chainsaw, with the electronic tape measure configured to send a signal to the chainsaw, or to a controller is communication with the chainsaw, whenever the gap between a lowest point of the chainsaw blade and the ground is lower than a predetermined value, with the chainsaw configured to be turned off automatically on receipt of this signal from the electronic tape measure. It is to be noted that other means of ensuring that the chainsaw stops at a predetermined minimum height above the ground are within the scope of the subject matter as disclosed herein.

In some embodiments, the assembly as disclosed herein, and its mobility in particular, can be configured similar to that of a wheel barrow. For example, in one embodiment, the assembly can include one wheel and two supports extending from the base with two handles extending roughly laterally from the assembly for holding and pushing the assembly therewith. Accordingly, the assembly is capable of being moved around similar to wheel barrow—with the mobile assembly having an arm including a chainsaw attached thereto extending out for cutting wood.

In some embodiments, the assembly configured similar to a wheel barrow can further include the feature of being operated in an automated fashion with the use of a remote control. In such an automated embodiment, the assembly can be controlled by a user or by a computerized image/terrain/tree recognition software whereby the mobility of the mobile assembly, the movement of the frame up and down the post(s), the sliding of the arm about the frame, can the operation of the chainsaw can all be automated, whereby the above listed steps can be controlled from a remote location either by the user or by a computer software program. This can advantageously allow for the mobile assembly to be moved around with a remote control by the user or the computer software program. The mobile assembly can accordingly be maneuvered to where it needs to make the cut, the frame moved up or down as needed, the arm electronically extended out, and the chainsaw operated to make the cut. In some embodiments, the arm can further include an automated counterweight system/mechanism for applying a correct pressure to the chainsaw blade. One way of accomplishing the counterweight mechanism can be by causing a weight to automatically move closer to, or further away from, the chainsaw to adjust the pressure applied by the chainsaw blade on the wood being cut, with the movement of the weight controlled automatically via remote control(s). The assembly can further include the ability to retract the arm back, and to move the frame/arm up and down the post(s) automatically via remote control(s). This can advantageously permit the assembly to be able to be perform a cutting operation without manual intervention, and further permit the assembly to be maneuvered from one cut to the next cut without manual intervention.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

The terminology used herein was chosen to best explain the principles of the embodiments, the practical application or technical improvement over technologies found in the marketplace, or to enable others of ordinary skill in the art to understand the embodiments disclosed herein.

These and other changes can be made to the disclosure in light of the Detailed Description. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

What is claimed is:

1. A mobile assembly for cutting wood, the assembly comprising:

a base supported by wheels, the wheels configured for moving the assembly during cutting operations and during transporting of the assembly;

a first distal post and a first proximal post extending upwards from the base;

a frame removably coupled to the first distal post and the first proximal post, the frame configured to pivot relative to at least one of the first distal post and the first proximal post when coupled to the at least one of the first distal post and the first proximal post, the frame configured for positioning at different heights along the at least one of the first distal post and the first proximal post; and an arm supported by the frame and configured for sliding about and parallel with the frame, the arm including a chainsaw attached to a distal end of the arm, wherein the distal end of the arm is positioned outwardly of the first distal post whereby a whole of the chainsaw is spaced apart from the first distal post, wherein the distal end of the of the arm is restricted from traveling within a span bound by the first distal post and the first proximal post, wherein the arm further comprises a caster at the distal end, the caster positioned below the chainsaw, the caster configured to roll on a surface that it comes in contact with.

2. The assembly of claim 1, further comprising a second distal post and a second proximal post, wherein the assembly further comprises two lateral bars, wherein a first lateral bar of the two lateral bars extends between the first distal post and second distal post, and a second lateral bar of the two lateral bars extends between the first proximal post and second proximal post, each of the first lateral bar and second lateral bar supporting an underside of the frame, each of two ends of the first lateral bar removably secured to a respective one of the first distal post and second distal post, each of two ends of the second lateral bar removably secured to a respective one of the first proximal post and second proximal post, wherein the frame is pivotally attached to each of the two lateral bars.

3. The assembly of claim 2, wherein the frame is attached to at least one of the two lateral bars by at least one brace.

4. The assembly of claim 2, wherein the frame is configured to slide up and down about the first distal post and second distal post, and the first proximal post and second proximal post.

5. The assembly of claim 2, wherein the first distal post, the second distal post, the first proximal post, and the second proximal post each includes a respective plurality of openings, each opening of the respective plurality of openings configured to receive a hitch pin.

6. The assembly of claim 1, further comprising a lubricant reservoir attachable to a lubricant receiving opening of the chainsaw.

7. The assembly of claim 1, further comprising a stopping leg extending downwardly from the arm, the stopping leg configured to prevent a chainsaw blade from descending below a predetermined height from a ground surface.

8. The assembly of claim 7, wherein the stopping leg includes an opening therethrough for receiving a sliding weight in the opening, wherein one end of a cable is removably attached to a chainsaw trigger and another end of the cable is coupled to the sliding weight, wherein the chainsaw is stopped when a bottom end of the sliding weight contacts a ground or other solid surface.

9. The assembly of claim 7, wherein the chainsaw is electrically operated, wherein the stopping leg includes a chainsaw turn-off switch at a bottom end of the stopping leg, wherein the chainsaw is stopped when a bottom end of the turn-off switch contacts a ground or other solid surface.

10. The assembly of claim 7, wherein a bottom end of the stopping leg includes a power cut-off switch, wherein the chainsaw is stopped when a bottom end of the power cut-off switch contacts a ground or other solid surface.

11. The assembly of claim 1, further comprising a reservoir configured to hold a lubricant for lubricating the chainsaw, wherein the reservoir is in fluid communication with a lubricant receiving opening of the chainsaw.

12. The assembly of claim 1, further comprising a counterweight attached to the arm for increasing a force applied by a chainsaw blade against an article being cut.

13. The assembly of claim 1, further comprising a counterweight attached to the arm for reducing a force applied by a chainsaw blade against an article being cut.

14. A mobile assembly for cutting wood, the assembly comprising:

a base supported by wheels, the wheels configured for moving the assembly during cutting operations and during transporting of the assembly;

a first distal post and a first proximal post extending upwards from the base;

a frame removably coupled to the first distal post and the first proximal post, the frame configured to pivot relative to at least one of the first distal post and the first proximal post when coupled to the at least one of the first distal post and the first proximal post, the frame configured for positioning at different heights along the at least one of the first distal post and the first proximal post;

an arm supported by the frame and configured for sliding about and parallel with the frame, the arm including a chainsaw attached to a distal end of the arm, wherein the distal end of the arm is positioned outwardly of the first distal post whereby a whole of the chainsaw is spaced apart from the first distal post, wherein the distal end of the of the arm is restricted from traveling within a span bound by the first distal post and the first proximal post; and a stopping leg extending downwardly from the arm, the stopping leg configured to prevent a chainsaw blade from descending below a predetermined height from a ground surface, wherein a bottom end of the stopping leg includes a power cut-off switch, and wherein the chainsaw is stopped when a bottom end of the power cut-off switch contacts a ground or other solid surface.

* * * * *